US010022979B2

(12) United States Patent
Okushima et al.

(10) Patent No.: US 10,022,979 B2
(45) Date of Patent: Jul. 17, 2018

(54) LIQUID EJECTION HEAD, LIQUID EJECTION APPARATUS, AND MANUFACTURING METHOD

(71) Applicant: CANON KABUSHIKI KAISHA, Tokyo (JP)

(72) Inventors: Shingo Okushima, Kawasaki (JP); Takatsuna Aoki, Yokohama (JP); Seiichiro Karita, Saitama (JP); Noriyasu Nagai, Tokyo (JP); Tamaki Sato, Kawasaki (JP); Tetsushi Ishikawa, Tokyo (JP); Yasuaki Tominaga, Kawasaki (JP); Manabu Otsuka, Kawasaki (JP); Shuzo Iwanaga, Kawasaki (JP); Tatsurou Mori, Yokohama (JP); Kazuhiro Yamada, Yokohama (JP); Akira Yamamoto, Yokohama (JP); Zentaro Tamenaga, Sagamihara (JP); Akio Saito, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/388,792

(22) Filed: Dec. 22, 2016

(65) Prior Publication Data

US 2017/0197439 A1 Jul. 13, 2017

(30) Foreign Application Priority Data

Jan. 8, 2016 (JP) ..... 2016-003077
Dec. 9, 2016 (JP) ..... 2016-239697

(51) Int. Cl.
*B41J 2/185* (2006.01)

(52) U.S. Cl.
CPC ..... *B41J 2/185* (2013.01)

(58) Field of Classification Search
CPC ... B41J 2/18; B41J 2/185; B41J 2/1721; B41J 2202/12
See application file for complete search history.

(56) References Cited

U.S. PATENT DOCUMENTS

| | | | |
|---|---|---|---|
| 5,478,606 | A | 12/1995 | Ohkuma et al. |
| 5,774,151 | A | 6/1998 | Sugitani et al. |
| 5,933,163 | A | 8/1999 | Koizumi et al. |
| 6,652,702 | B2 | 11/2003 | Miyazaki et al. |
| 7,347,534 | B2 | 3/2008 | Silverbrook et al. |
| 7,625,072 | B2 | 12/2009 | Saito et al. |
| 7,789,499 | B2 | 9/2010 | Iwanaga et al. |
| 7,980,676 | B2 | 7/2011 | Hirosawa et al. |
| 7,985,531 | B2 | 7/2011 | Kanri et al. |
| 8,157,356 | B2 | 4/2012 | Yamamoto et al. |
| 8,227,043 | B2 | 7/2012 | Kubota et al. |

(Continued)

OTHER PUBLICATIONS

U.S. Appl. No. 15/390,847, Shingo Okushima, Seiichiro Karita, Takatsuna Aoki, Noriyasu Nagai, filed Dec. 27, 2016.

*Primary Examiner* — Juanita D Jackson
(74) *Attorney, Agent, or Firm* — Fitzpatrick, Cella, Harper & Scinto

(57) ABSTRACT

A liquid ejection head capable of suppressing a change in pressure of a pressure chamber, a liquid ejection apparatus, and a manufacturing method are provided. For that reason, a lid member is formed on a wafer-shaped element board and the element board is cut into chips to manufacture a print element board.

22 Claims, 54 Drawing Sheets

(56) References Cited

U.S. PATENT DOCUMENTS

| | | | | |
|---|---|---|---|---|
| 8,517,518 | B2 * | 8/2013 | Kashu | B41J 2/1404 347/66 |
| 8,573,744 | B2 | 11/2013 | Kashu et al. | |
| 8,613,141 | B2 | 12/2013 | Okano et al. | |
| 9,126,409 | B2 | 9/2015 | Tamenaga et al. | |
| 9,248,647 | B2 | 2/2016 | Iwanaga et al. | |
| 9,254,658 | B2 | 2/2016 | Yamada et al. | |
| 2016/0059551 | A1 | 3/2016 | Miyazaki et al. | |

* cited by examiner

LIQUID EJECTION HEAD, LIQUID EJECTION APPARATUS, AND MANUFACTURING METHOD

BACKGROUND OF THE INVENTION

Field of the Invention

The present invention relates to a liquid ejection head that ejects a liquid from an ejection opening, a liquid ejection apparatus, and a manufacturing method.

Description of the Related Art

In recent years, there has been an increasing demand for a high-accuracy and high-quality printing operation since a printing apparatus has been used for various applications. In order to print an image with higher accuracy, a plurality of ejection openings need to be disposed with high density in the liquid ejection head capable of selectively ejecting a liquid from the plurality of ejection openings. Further, in order to print an image with higher quality, there is a need to eject a liquid droplet having a uniform size.

In order to dispose the ejection openings with high density, there is also a need to decrease the size of a liquid supply passage to the ejection opening. The specification of U.S. Pat. No. 7,347,534 discloses a method of processing a member for supplying ink to an element board. Here, a head support member is laminated by a sealing film integrated in a longitudinal direction of a line head and a supply opening is processed by a laser. Subsequently, a print element board is mounted on the sealing film provided with the supply opening.

However, in the method disclosed in the specification of U.S. Pat. No. 7,347,534, the supply opening is processed in the sealing film serving as the support member of the print element board and the print element board is mounted on the sealing film while being positioned to correspond to the formed supply opening. In such a configuration, it is difficult to realize a further decrease in size or a further increase in density of the supply opening or the passage near the rear face of the print element board from the viewpoint of the positioning accuracy of a passage near a rear face of the print element board and the supply opening of the sealing film.

SUMMARY OF THE INVENTION

An object of the invention is to provide a liquid ejection head capable of realizing a further decrease in size or a further increase in density of a passage structure near a rear face of a print element board, a liquid ejection apparatus, and a manufacturing method.

For that reason, according to the invention, there is provided a method of manufacturing a liquid ejection head including an element board including a plurality of ejection openings ejecting a liquid, an element provided to correspond to each of the plurality of ejection openings and generating energy used to eject a liquid from the ejection openings, and a supply path supplying a liquid to the ejection opening, the method including: a lid member forming step of forming a lid member provided with an opening communicating with the supply path at a face opposite to a face provided with the ejection openings of a plurality of the element boards adjacently connected to each other; and a cutting step of cutting the plurality of adjacent element boards into chips after the lid member forming step.

According to the invention, it is possible to realize a liquid ejection head capable of suppressing a change in pressure of a pressure chamber, a liquid ejection apparatus, and a manufacturing method.

Further features of the present invention will become apparent from the following description of exemplary embodiments (with reference to the attached drawings).

DESCRIPTION OF THE EMBODIMENTS

Hereinafter, preferred application examples and embodiments of the invention will be described with reference to the drawings. A liquid ejection head ejecting a liquid such as ink and a liquid ejection apparatus including the liquid ejection head of the invention can be applied to a printer, a copying machine, a facsimile machine having a communication system, and a word processor having a printer. Further, the liquid ejection head and the liquid ejection apparatus can be applied to an industrial printing apparatus combined with various processing devices. For example, the liquid ejection head and the liquid ejection apparatus can be used to manufacture a biochip or print an electronic circuit.

Further, since application examples and embodiments to be described below are detailed examples of the invention, various technical limitations thereof can be made. However, the application examples and the embodiments are not limited to the application examples, the embodiments, and the other detailed methods and can be modified within the spirit of the invention.

(First Application Example)

(Description of Inkjet Printing Apparatus)

Figure 1:
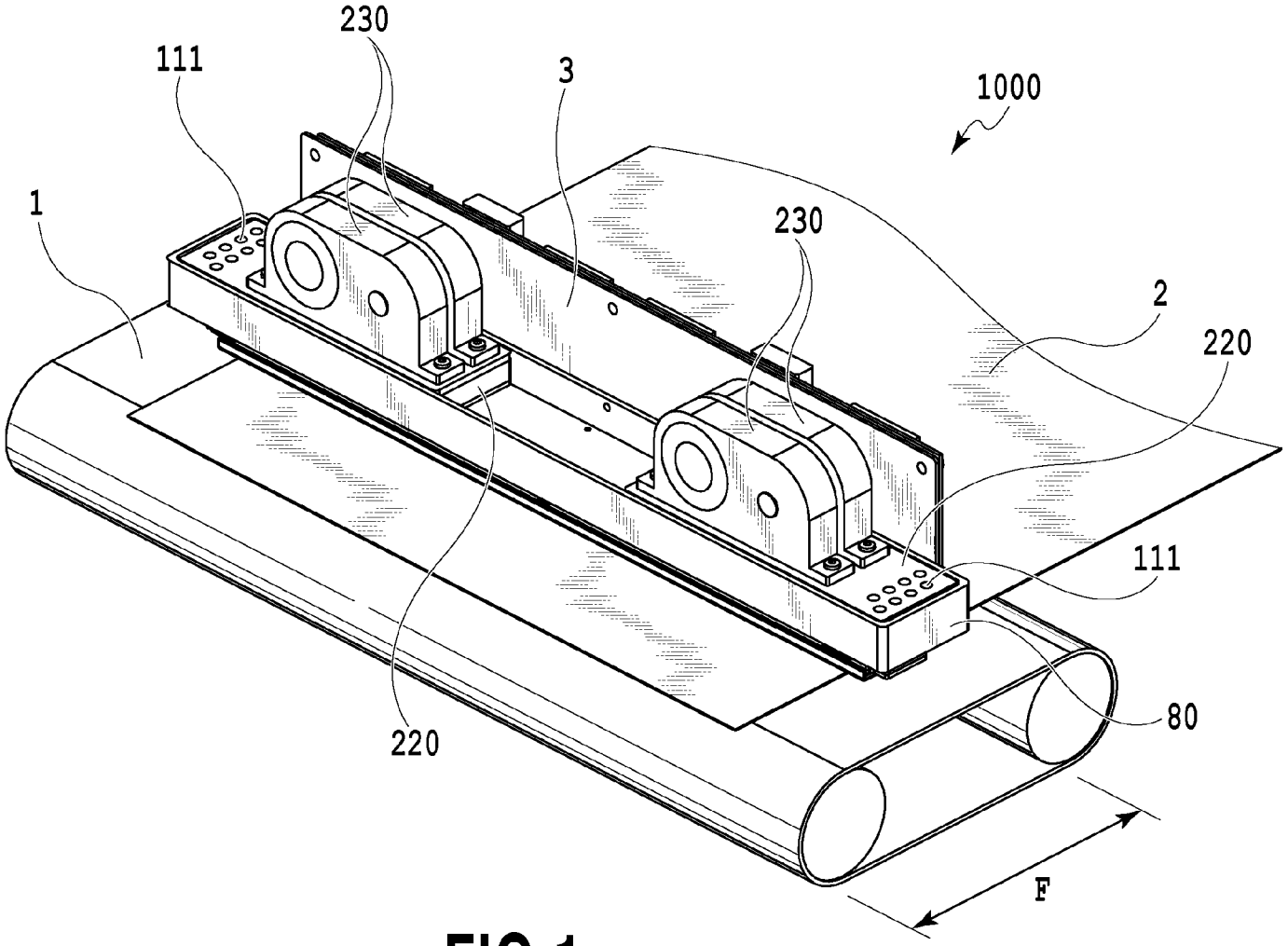
FIG. 1 is a diagram illustrating a schematic configuration of a liquid ejection apparatus that ejects a liquid.

FIG. 1 is a diagram illustrating a schematic configuration of a liquid ejection apparatus that ejects a liquid in the invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium.

The liquid ejection head 3 can print a full color image by inks of cyan C, magenta M, yellow Y, and black K and is fluid-connected to a liquid supply member, a main tank, and a buffer tank (see FIG. 2 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation mode includes a first circulation mode in which the liquid is circulated by the activation of two circulation pumps (for high and low pressures) at the downstream side of the liquid ejection head 3 and a second circulation mode in which the liquid is circulated by the activation of two circulation pumps (for high and low pressures) at the upstream side of the liquid ejection head 3. Hereinafter, the first circulation mode and the second circulation mode of the circulation will be described.

(Description of First Circulation Mode)

Figure 2:
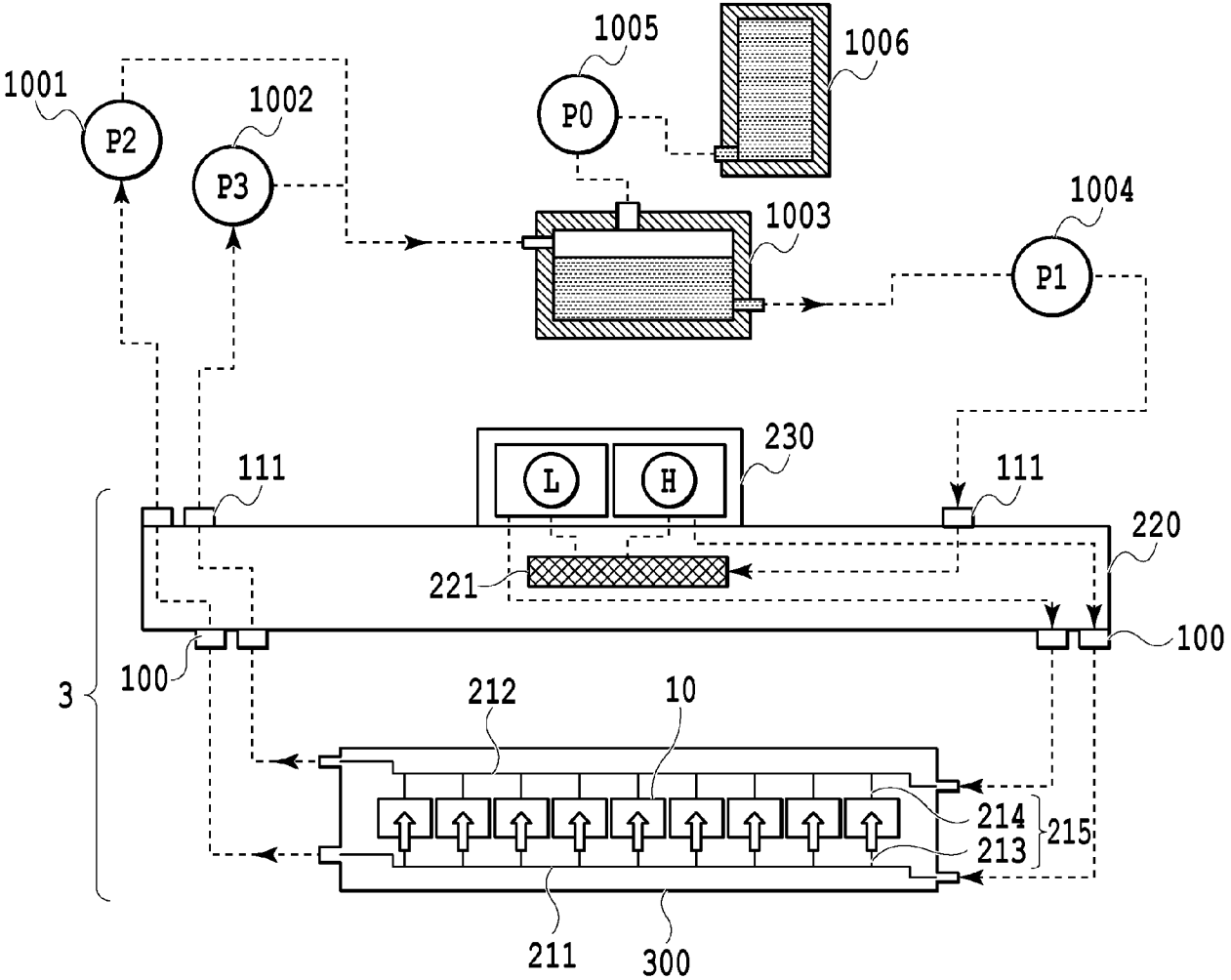
FIG. 2 is a schematic diagram illustrating a first circulation mode in a circulation path applied to a printing apparatus.

FIG. 2 is a schematic diagram illustrating the first circulation mode in the circulation path applied to the printing apparatus 1000 of the application example. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation mode, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality.

Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow rate of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure.

As an example, a mechanism such as a so-called "pressure reduction regulator" can be employed. In the circulation passage of the application example, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004. As illustrated in FIG. 2, the negative pressure control unit 230 includes two negative pressure adjustment mechanisms respectively having different control pressures. Among two negative pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220.

The liquid ejection unit 300 is provided with the common supply passage 211, the common collection passage 212, and an individual passage 215 (an individual supply passage 213 and an individual collection passage 214) communicating with the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 2) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the application example can print a high-quality image at a high speed.

(Description of Second Circulation Mode)

Figure 3:
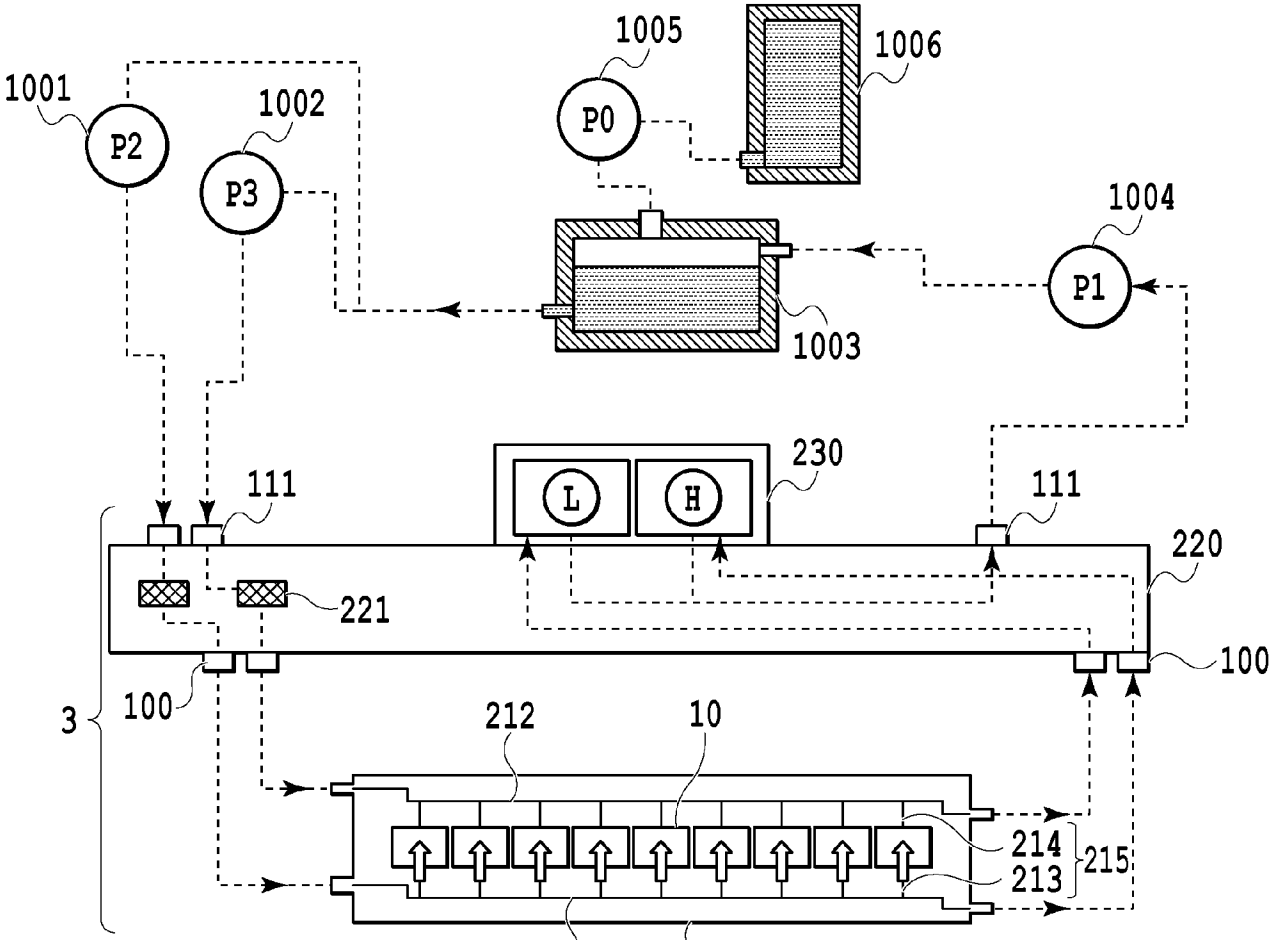
FIG. 3 is a schematic diagram illustrating a second circulation mode in the circulation path applied to the printing apparatus.

FIG. 3 is a schematic diagram illustrating the second circulation mode which is a circulation mode different from the first circulation mode in the circulation path applied to the printing apparatus of the application example. A main difference from the first circulation mode is that two negative pressure control mechanisms constituting the negative pressure control unit 230 both control a pressure at the upstream side of the negative pressure control unit 230 within a predetermined range from a desired set pressure. Further, another difference from the first circulation mode is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation mode, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation mode, the negative pressure control unit 230 stabilizes a change in pressure at the upstream side (that is, the liquid ejection unit 300) of the negative pressure control unit 230 within a predetermined range from a predetermined pressure even when a change in flow rate is caused by a change in ejection amount per unit area. In the circulation passage of the application example, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options.

Instead of the second circulation pump 1004, for example, a water head tank disposed to have a predetermined water head difference with respect to the negative pressure control unit 230 can be also used. Similarly to the first circulation mode, in the second circulation mode, the negative pressure control unit 230 includes two negative pressure control mechanisms respectively having different control pressures. Among two negative pressure adjustment mechanisms, a high pressure side (indicated by "H" in FIG. 3) and a low pressure side (indicated by "L" in FIG. 3) are respectively connected to the common supply passage 211 or the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the liquid is formed from the common supply passage 211 to the common collection passage 212 through the individual passage 215 and the passages formed inside the print element boards 10.

In such a second circulation mode, the same liquid flow as that of the first circulation mode can be obtained inside the liquid ejection unit 300, but has two advantages different from those of the first circulation mode. As a first advantage, in the second circulation mode, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation mode, a maximal value of the flow rate necessary for the liquid from the buffer tank 1003 to the liquid ejection head 3 is smaller than that of the first circulation mode. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening x the ejection frequency per unit time x the number of the ejection openings).

Figure 4:
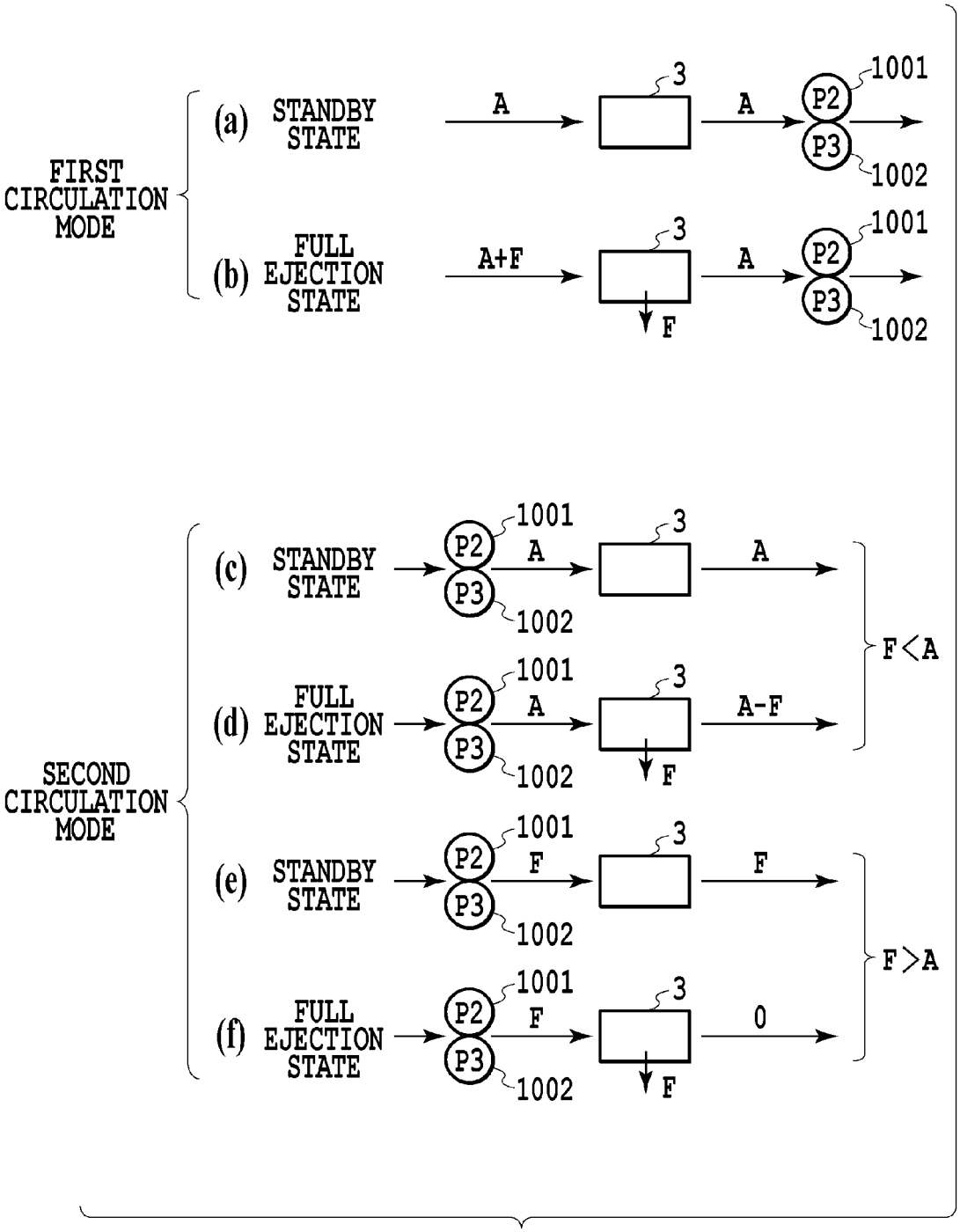
FIG. 4 is a schematic diagram illustrating a difference in ink inflow amount to a liquid ejection head.

FIG. 4 is a schematic diagram illustrating a difference in ink inflow amount to the liquid ejection head between the first circulation mode and the second circulation mode. Part (a) of FIG. 4 illustrates the standby state in the first circulation mode and part (b) of FIG. 4 illustrates the full ejection state in the first circulation mode. Parts (c) to (f) of FIG. 4 illustrate the second circulation passage. Here, part (c) and (d) of FIG. 4 illustrate a case where the flow rate F is lower than the flow rate A and parts (e) and (f) of FIG. 4 illustrate a case where the flow rate F is higher than the flow rate A. In this way, the flow rates in the standby state and the full ejection state are illustrated.

In the case of the first circulation mode (parts (a) and (b) of FIG. 4) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of the flow rate A+the flow rate F since the flow rate F is added to the flow rate A (part (b) of FIG. 4).

Meanwhile, in the case of the second circulation mode (parts (c) to (f) of FIG. 4) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation mode. Thus, when the flow rate A is higher than the flow rate F (parts (c) and (d) of FIG. 4) in the second circulation mode in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (part (d) of FIG. 4).

However, when the flow rate F is higher than the flow rate A (parts (e) and (f) of FIG. 4), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (part (f) of FIG. 4). In addition, if the liquid is not ejected in the full ejection state when the flow rate F is higher than the flow rate A, the liquid which is attracted by the amount consumed by the ejection of the flow rate F is discharged from the liquid ejection head 3. Further, when the flow rate A and the flow rate F are equal to each other, the flow rate A (or the flow rate F) is supplied to the liquid ejection head 3 and the flow rate F is consumed by the liquid ejection head 3. For this reason, the flow rate discharged from the liquid ejection head 3 becomes almost zero.

In this way, in the case of the second circulation mode, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation mode becomes smaller than the maximal value (the flow rate A+the flow rate F) of the supply flow rate necessary for the first circulation mode.

For that reason, in the case of the second circulation mode, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

Meanwhile, the first circulation mode is more advantageous than the second circulation mode. That is, in the second circulation mode, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink.

Meanwhile, in the case of the first circulation mode, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation modes can be desirably selected in consideration of the specifications (the ejection flow rate F, the minimal circulation flow rate A, and the passage resistance inside the head) of the liquid ejection head and the printing apparatus body.

(Description of Configuration of Liquid Ejection Head)

Figure 5A:
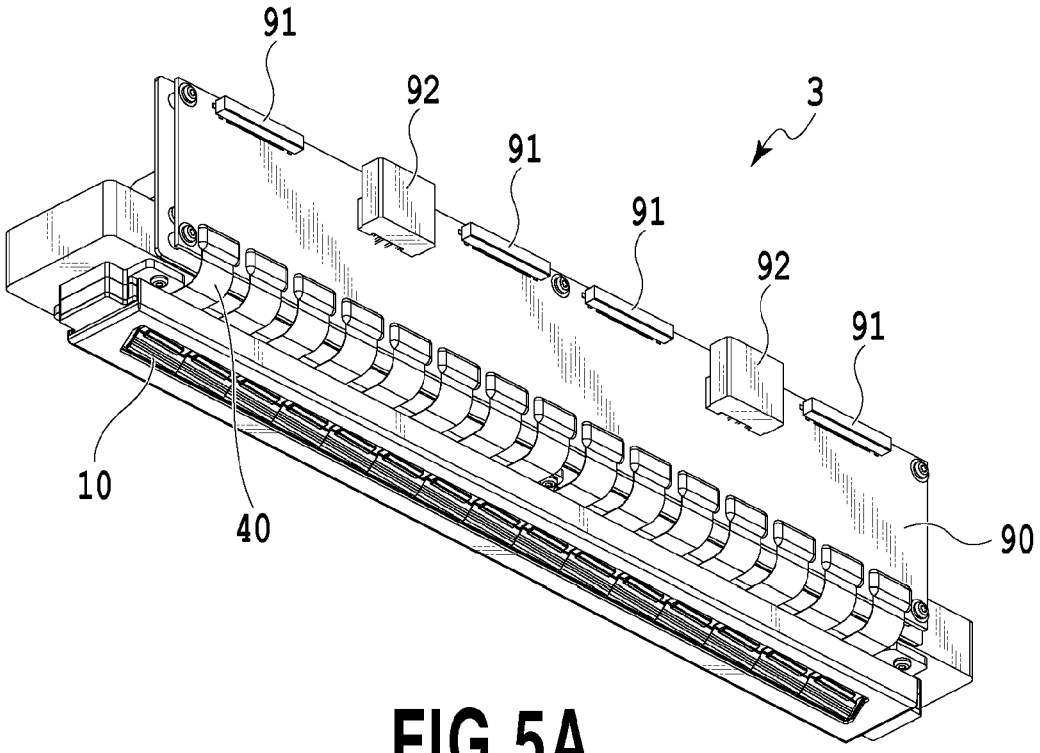
FIG. 5A is a perspective view illustrating the liquid ejection head.
Figure 5B:
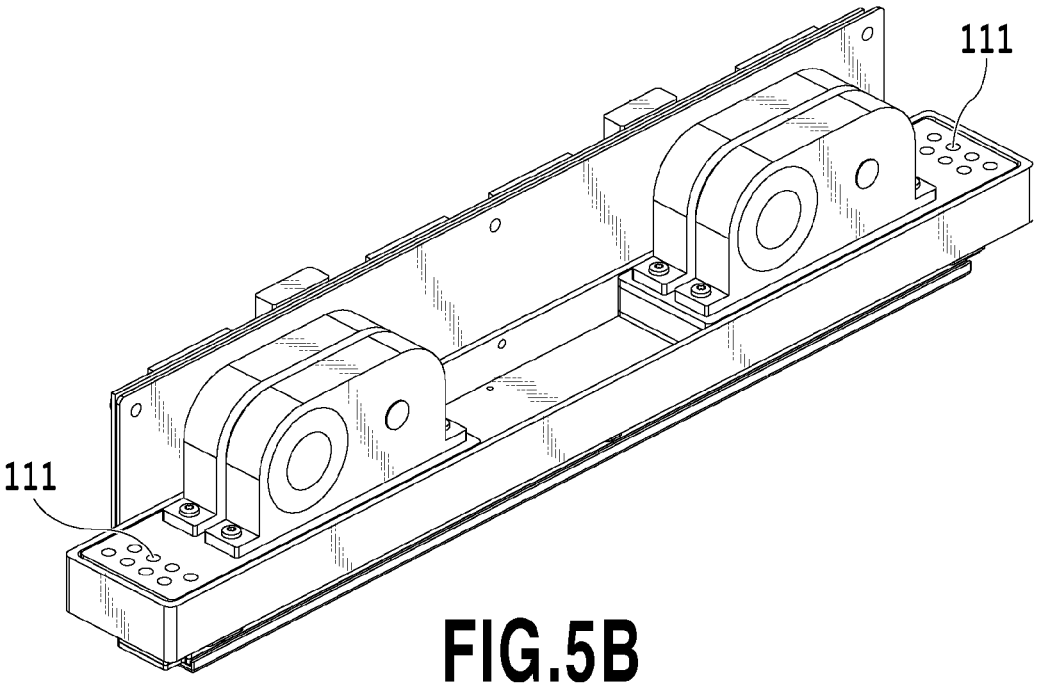
FIG. 5B is a perspective view illustrating the liquid ejection head.

A configuration of the liquid ejection head 3 according to the first application example will be described. FIGS. 5A and 5B are perspective views illustrating the liquid ejection head 3 according to the application example. The liquid ejection head 3 is a line type liquid ejection head in which fifteen print element boards 10 capable of ejecting inks of four colors of cyan C, magenta M, yellow Y, and black K are arranged in series on one print element board 10 (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10.

The signal input terminal 91 and the power supply terminal 92 are electrically connected to the control unit of the printing apparatus 1000 so that an ejection drive signal and power necessary for the ejection are supplied to the print element board 10. When the wirings are integrated by the electric circuit inside the electric wiring board 90, the number of the signal input terminals 91 and the power supply terminals 92 can be decreased compared with the number of the print element boards 10. Accordingly, the number of electrical connection components to be separated when the liquid ejection head 3 is assembled to the printing apparatus 1000 or the liquid ejection head is replaced decreases.

As illustrated in FIG. 5B, the liquid connection portions 111 which are provided at both ends of the liquid ejection head 3 are connected to the liquid supply system of the printing apparatus 1000. Accordingly, the inks of 3 four colors including cyan C, magenta M, yellow Y, and black K4 are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 6:
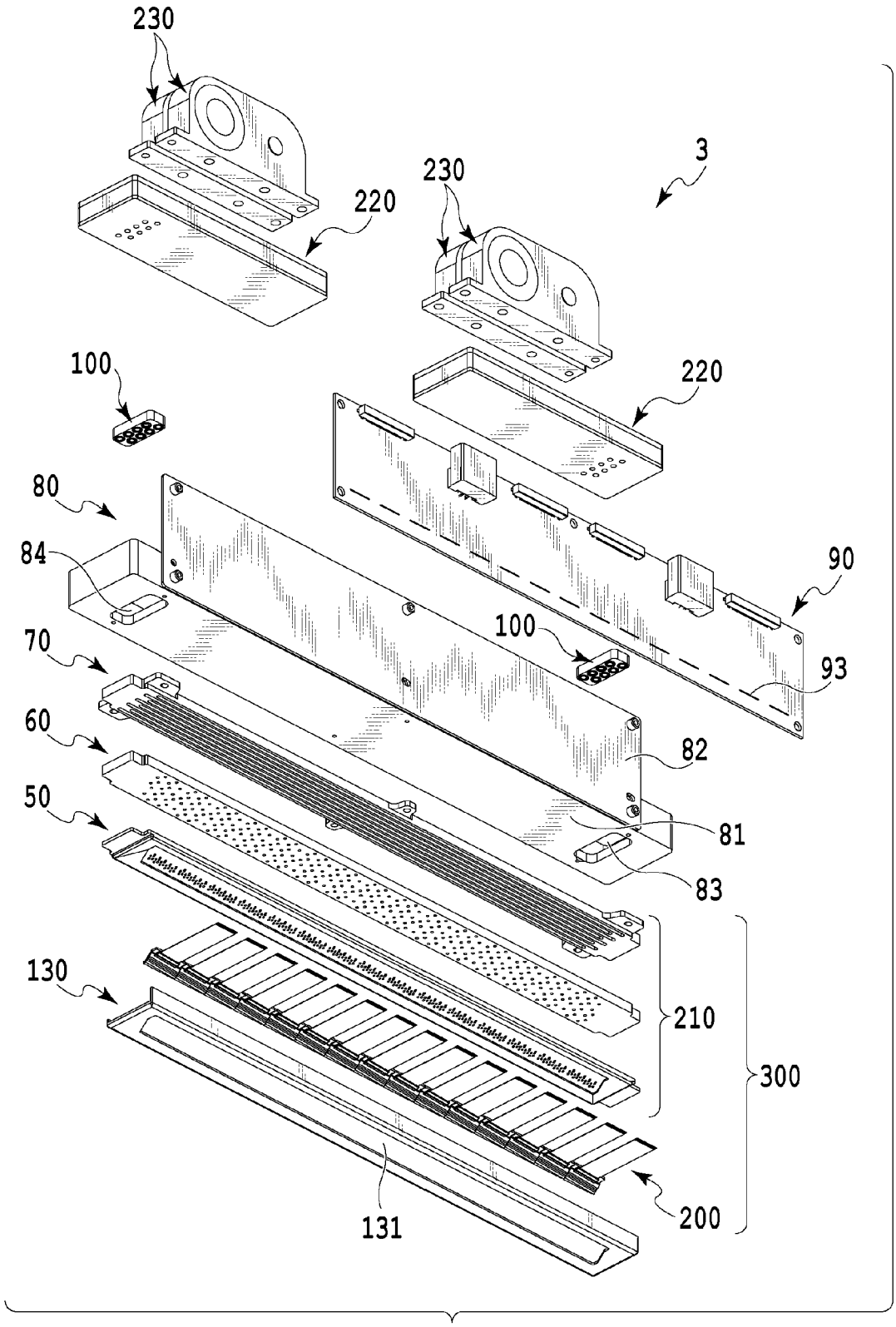
FIG. 6 is an exploded perspective view illustrating components or units constituting the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign material in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color.

The negative pressure control unit 230 is a unit which includes different colors of negative pressure control valves. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change negative pressure at the downstream side (the liquid ejection unit 300 side) of the negative pressure control unit 230 within a predetermined range. As described in FIG. 2, two negative pressure control valves of different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed.

For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
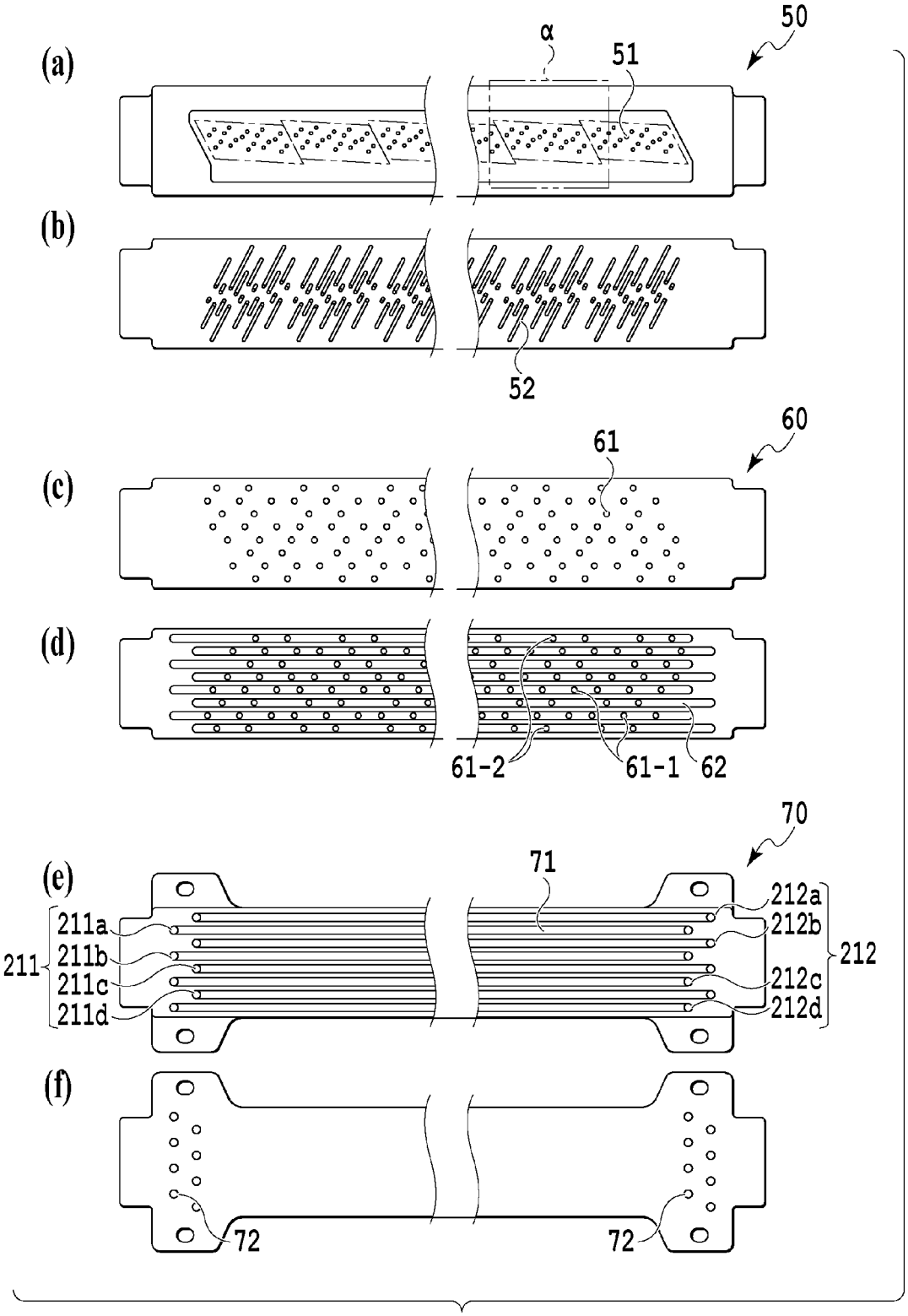
FIG. 7 is a diagram illustrating front and rear faces of first to third passage members.

Parts (a) to (f) of FIG. 7 are diagrams illustrating front and rear faces of the first to third passage members. Part (a) of FIG. 7 illustrates a face onto which the ejection module 200 is mounted in the first passage member 50 and part (f) of FIG. 7 illustrates a face with which the liquid ejection unit support portion 81 comes into contact in the third passage member 70. The first passage member 50 and the second passage member 60 are bonded to teach other so that the parts illustrated in parts (b) and (c) of FIG. 7 and corresponding to the contact faces of the passage members face each other and the second passage member and the third passage member are bonded to each other so that the parts illustrated in parts (d) and (e) of FIG. 7 and corresponding to the contact faces of the passage members face each other. When the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members.

Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see part (f) of FIG. 7) of the third passage member 70 communicates with the holes of the joint rubber 100 and is fluid-connected to the liquid supply unit 220 (see FIG. 6). A bottom face of the common passage groove 62 of the second passage member 60 is provided with a plurality of communication openings (a communication opening 61-1 communicating with the common supply passage 211 and a communication opening 61-2 communicating with the common collection passage 212) and communicates with one end of an individual passage groove 52 of the first passage member 50. The other end of the individual passage groove 52 of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 8:
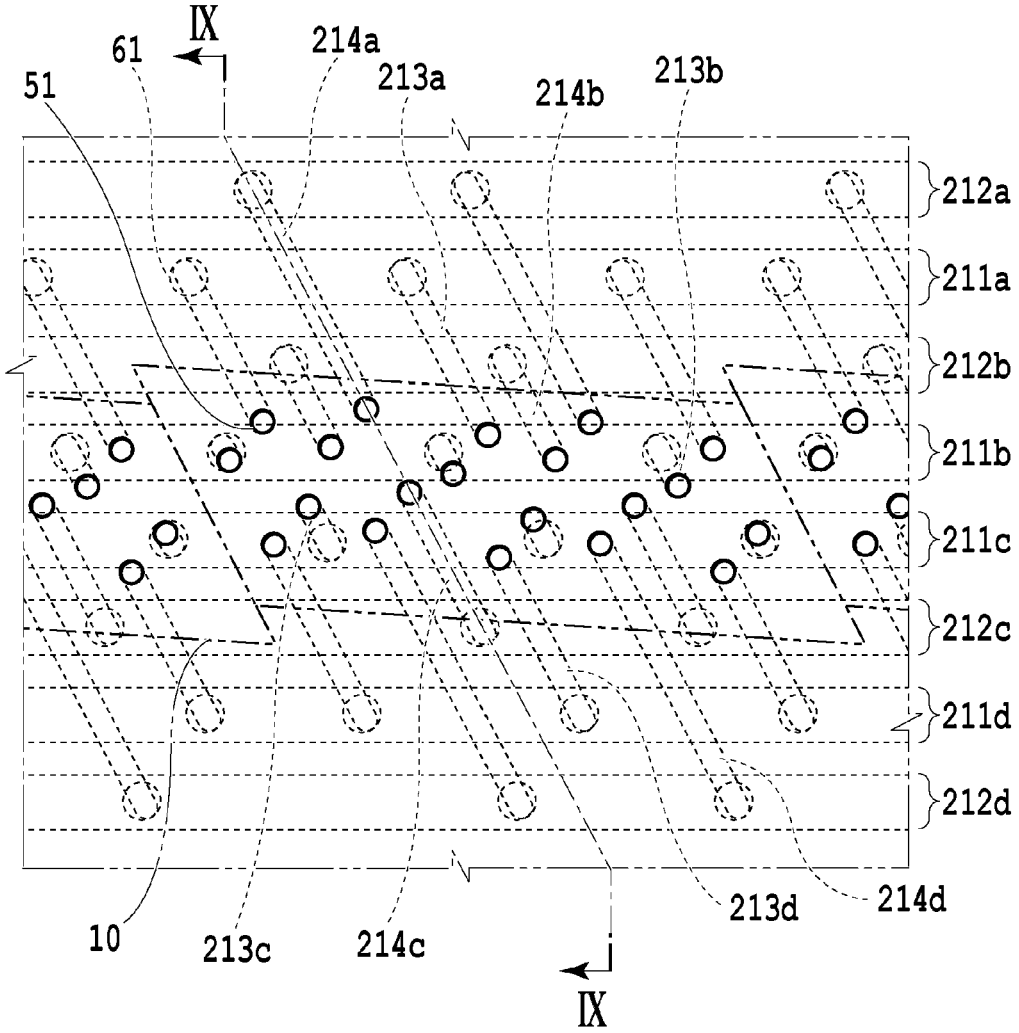
FIG. 8 is a perspective view illustrating a part $\alpha$ of FIG. 7(*a*) when viewed from an ejection module mounting face.

FIG. 8 is a partially enlarged perspective view illustrating a part α of part (a) of FIG. 7 and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
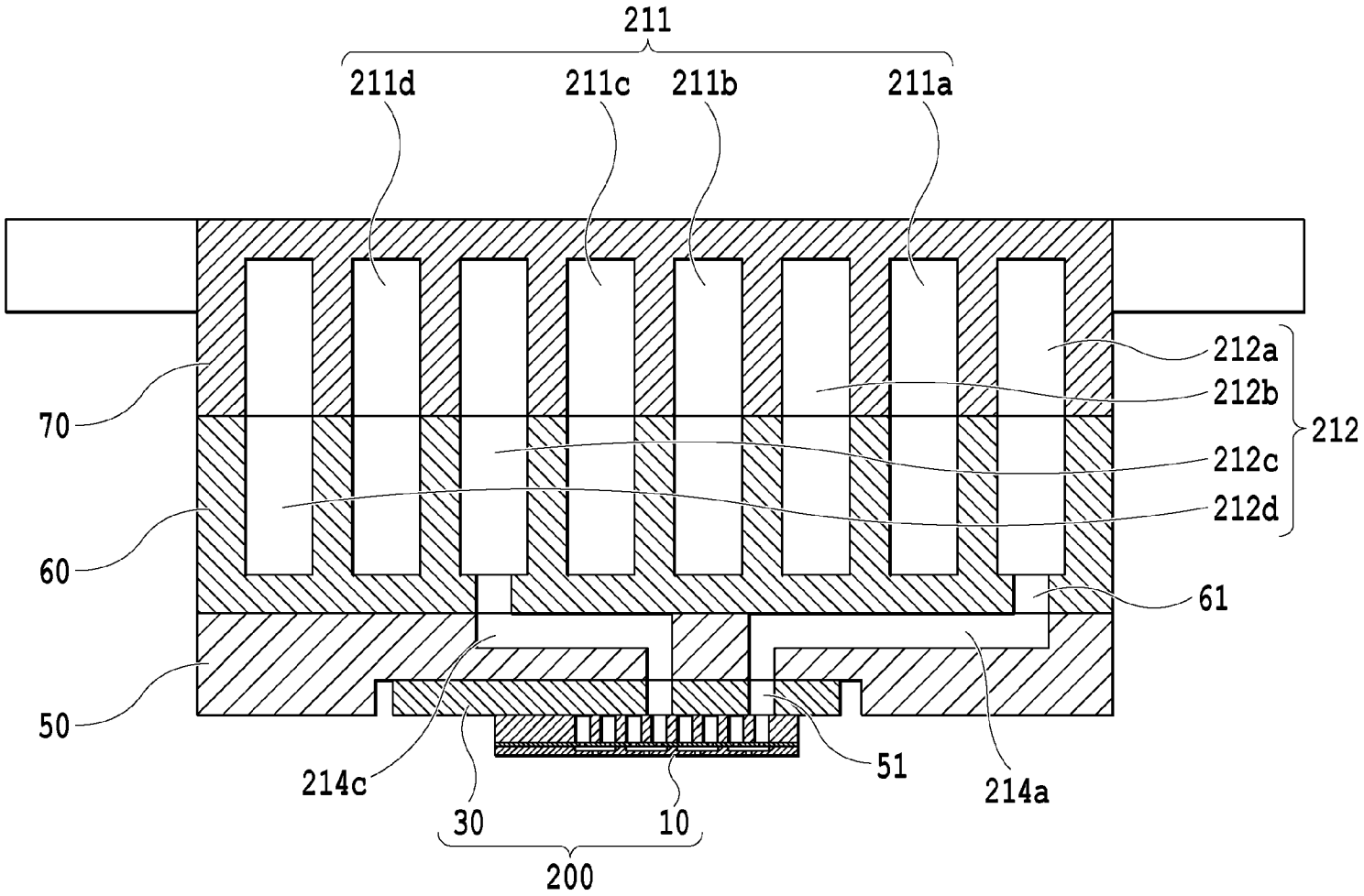
FIG. 9 is a cross-sectional view taken along a line IX-IX of FIG. 8.

FIG. 9 is a cross-sectional view taken along a line IX-IX of FIG. 8. The individual collection passage (214*a*, 214*c*) communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 10A:
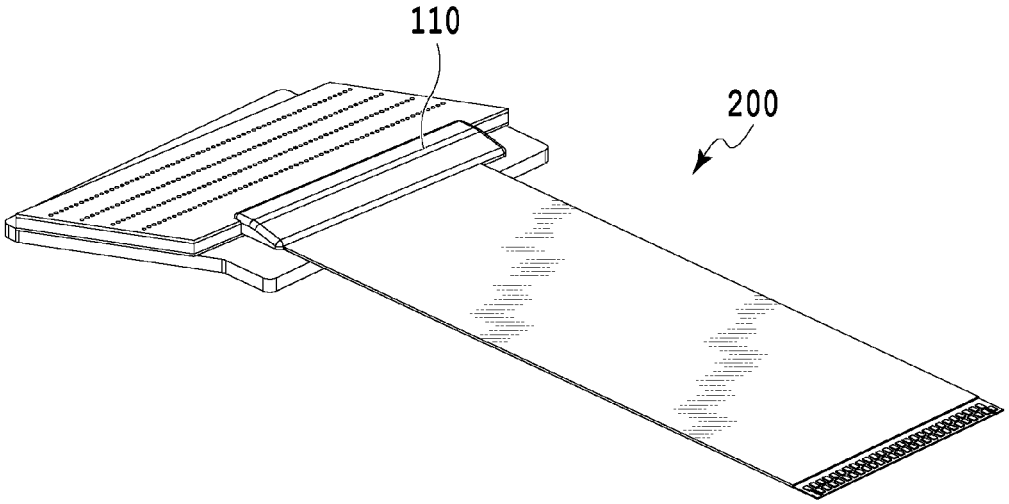
FIG. 10A is a perspective view illustrating one ejection module.
Figure 10B:
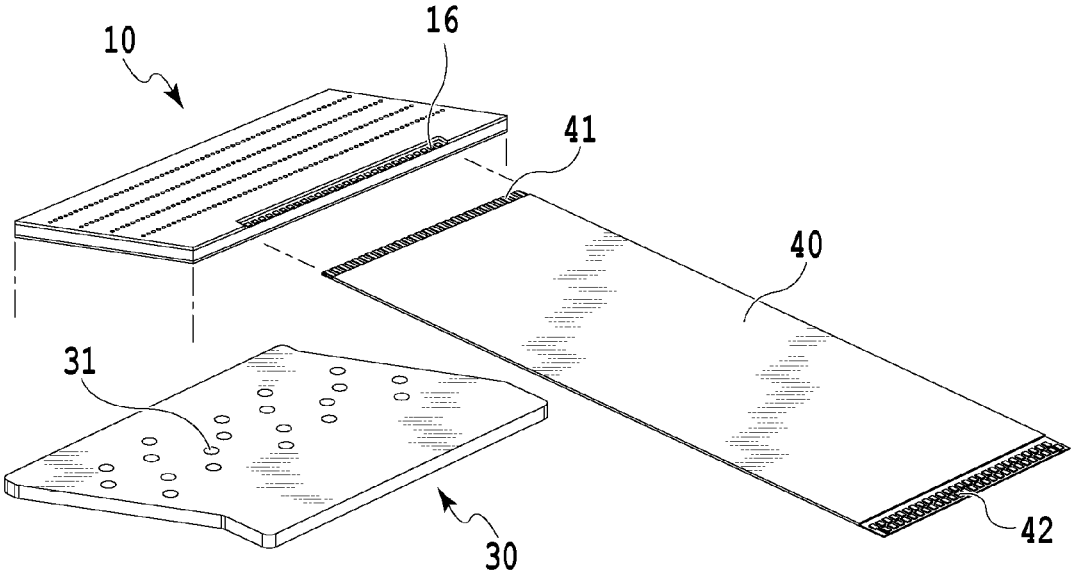
FIG. 10B is an exploded view illustrating one ejection module.

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110.

A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
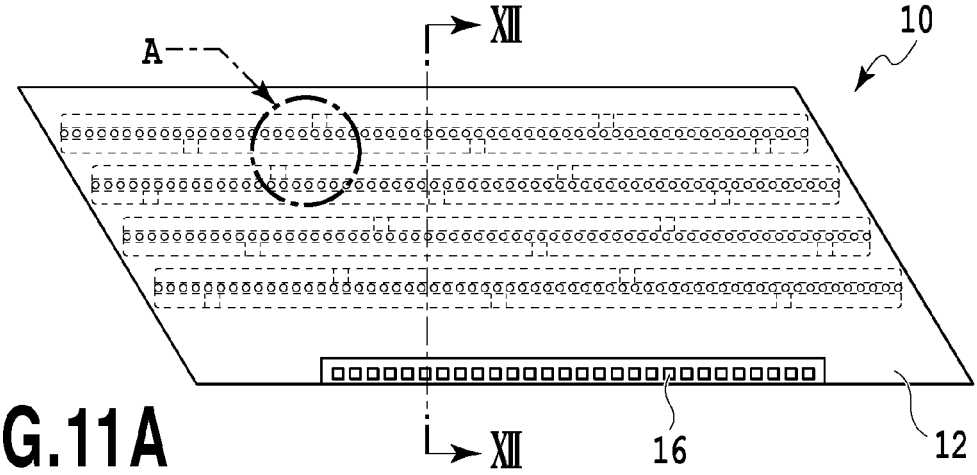
FIG. 11A is a diagram illustrating a print element board.
Figure 11B:
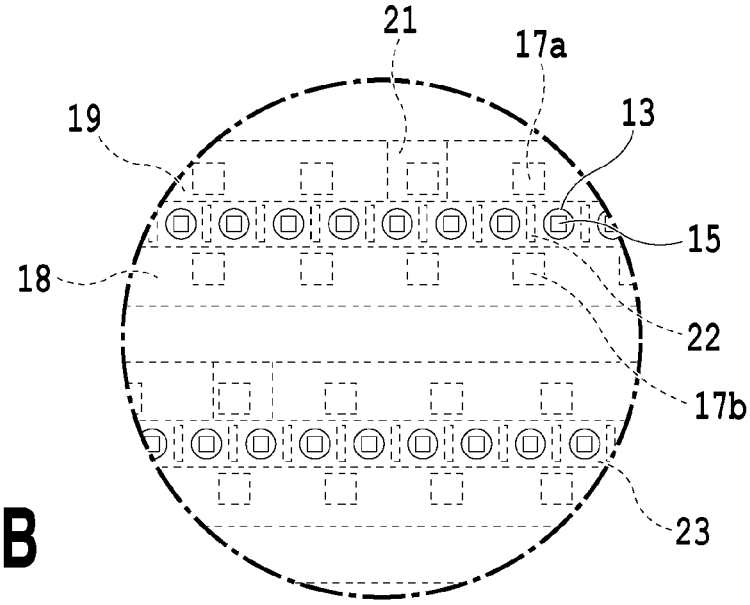
FIG. 11B is a diagram illustrating the print element board.
Figure 11C:
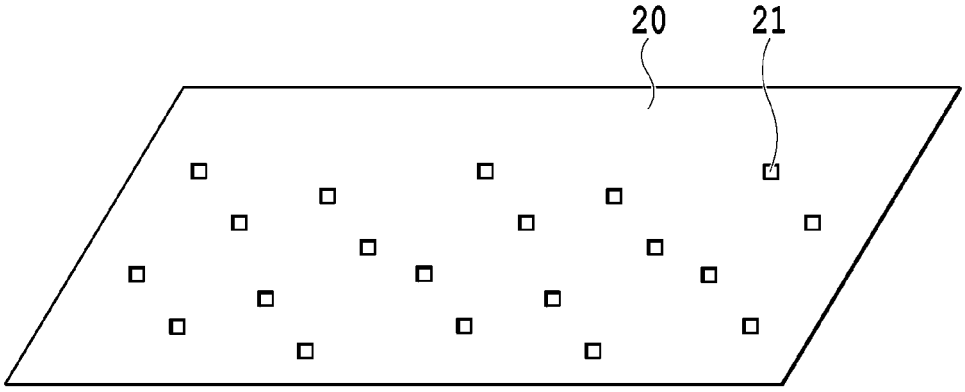
FIG. 11C is a diagram illustrating the print element board.

FIG. 11A is a top view illustrating a face provided with an ejection opening 13 in the print element board 10, FIG. 11B is an enlarged view of a part A of FIG. 11A, and FIG. 11C is a top view illustrating a rear face of FIG. 11A. Here, a configuration of the print element board of the application example will be described. As illustrated in FIG. 11A, an ejection opening forming member of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as an ejection energy generation element for ejecting the liquid by heat energy is disposed at a position corresponding to each ejection opening 13. A pressure chamber 23 provided inside the print element 15 is defined by a partition wall 22.

The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member (resin film) 20 made of resin material is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 which is a common flow path extending along the longitudinal direction of the print element board 10 and two openings 21 for each liquid collection path 19 which is a common collection path extending along the longitudinal direction of the print element board 10. In the present invention, the number of the openings 21 is not limited to this. For example, two supply side openings 21 for one of the liquid supply paths 18 and one collection side opening 21 for one of the liquid collection paths 19 may be configured. Considering the pressure loss in the flow path portion, it is preferable that at least two or more openings are provided in either the liquid supply path 18 or the liquid collection path 19.

As illustrated in FIG. 11B, openings 21 of the lid member 20 communicate with the communication openings 51 illustrated in part (a) of FIG. 7.

It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member 20 by a photosensitive resin film with a thin thickness in consideration of pressure loss.

Figure 12:
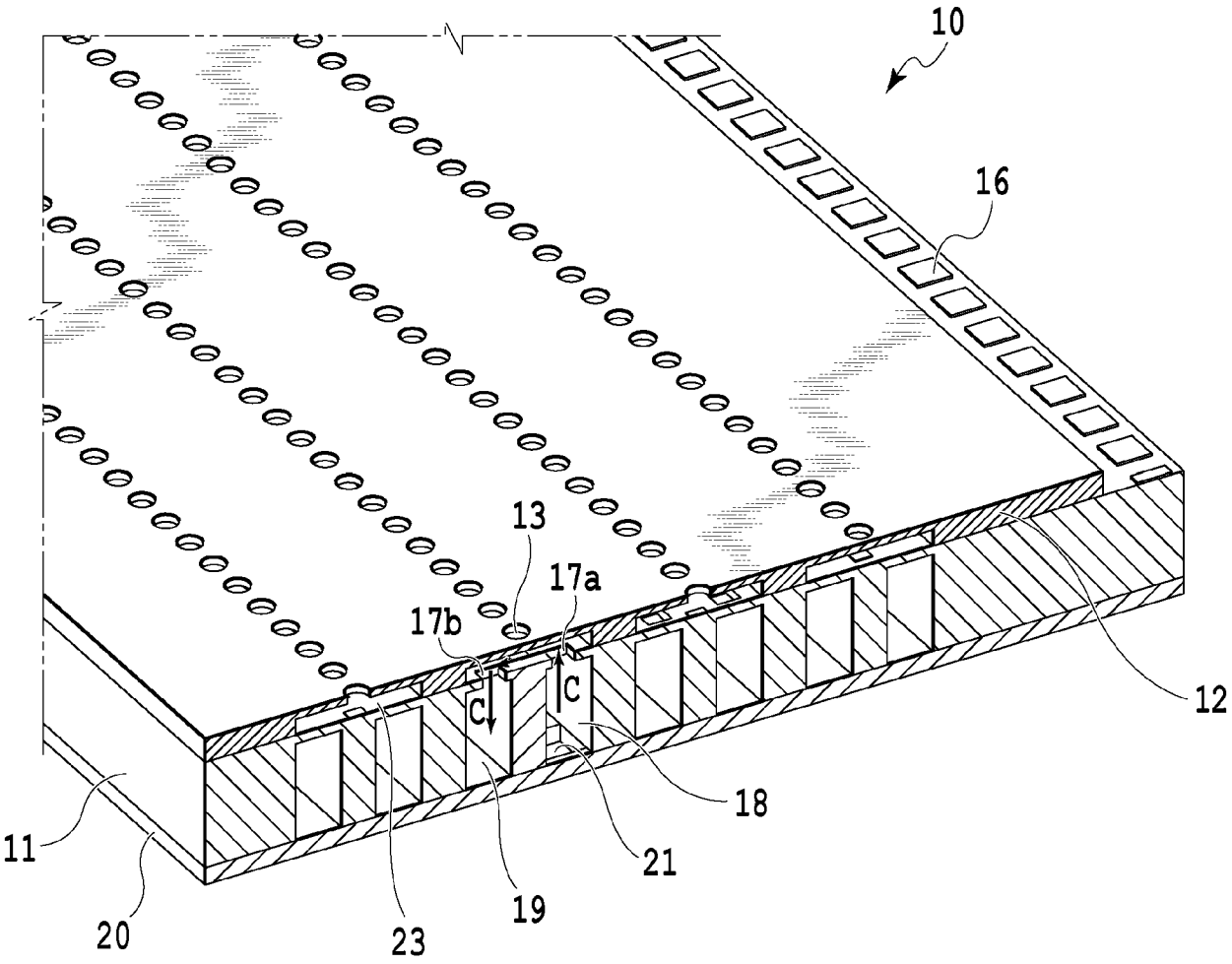
FIG. 12 is a perspective view illustrating cross-sections of the print element board and a lid member.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row.

The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed.

The liquid which is collected to the liquid collection path 19 is collected in order of the communication opening 51 (see part (a) of FIG. 7) inside the passage member 210, the individual collection passage 214, and the common collection passage 212 through the opening 21 of the lid member 20 and the liquid communication opening 31 (see FIG. 10B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11.

In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening 51 and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the first circulation mode illustrated in FIG. 2, the liquid which flows from the liquid connection portion 111 is supplied to the joint rubber 100 through the negative pressure control unit 230. Further, in the second circulation mode illustrated in FIG. 3, the liquid which is collected from the pressure chamber 23 passes through the joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 23 through the individual supply passage 213*a*.

That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the large passage with a small flow resistance as in the application example. In this way, since the thickening of the liquid in the vicinity of the ejection opening or the pressure chamber 23 can be suppressed in the liquid ejection head 3 of the application example, a slippage or a non-ejection can be suppressed. As a result, a high-quality image can be printed.

(Description of Positional Relation Among Print Element Boards)

Figure 13:
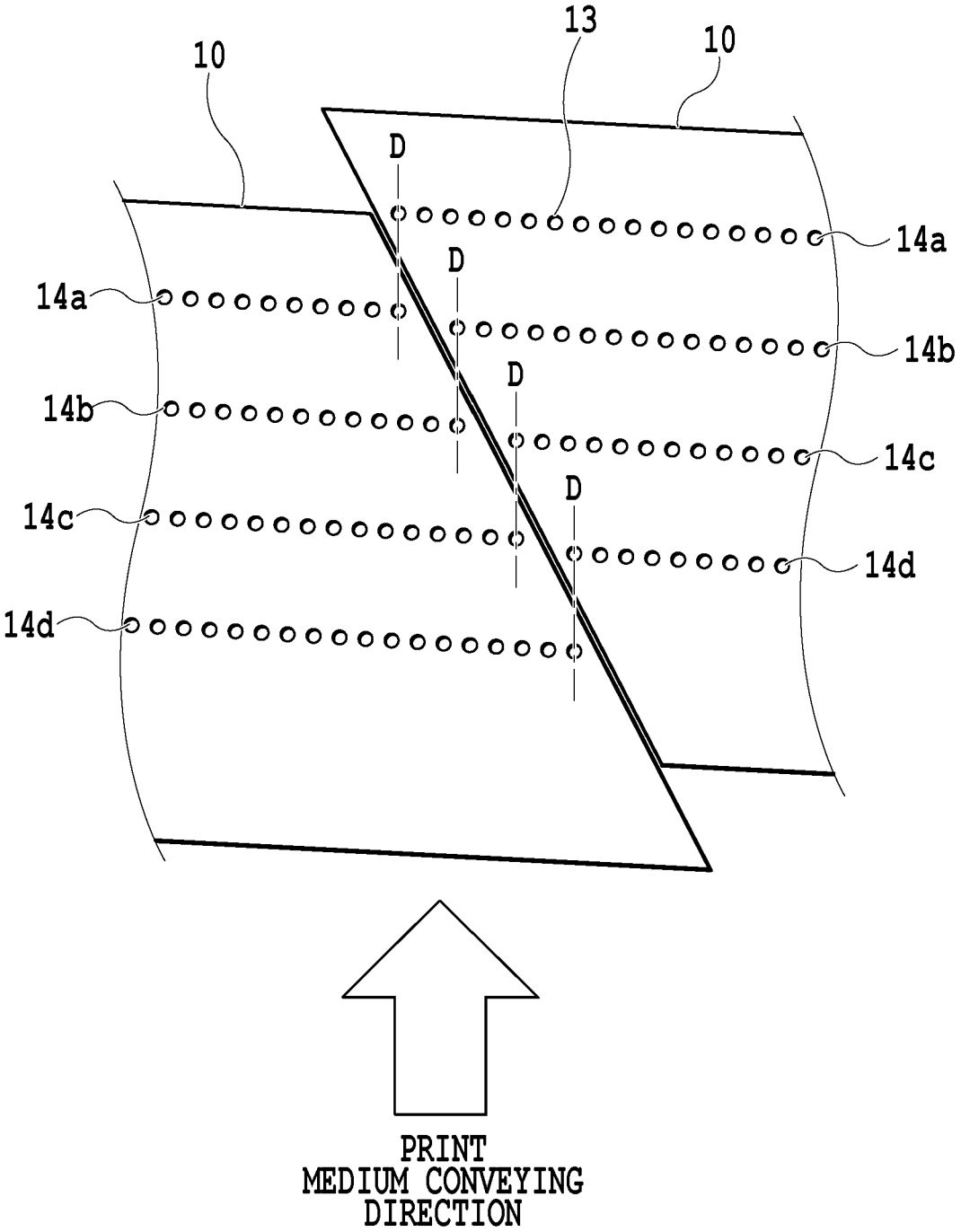
FIG. 13 is a partially enlarged top view of an adjacent portion of the print element board.

FIG. 13 is a partially enlarged top view illustrating an adjacent portion of the print element board in two adjacent ejection modules. In the application example, a substantially parallelogram print element board is used. Among the parallelograms, as shown in FIG. 13, it is particularly suitably applicable to parallelograms in which angles formed by mutually adjacent sides are not 90 degrees. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other.

With such an arrangement, even when a position of the print element board 10 is slightly deviated from a predetermined position, black streaks or missing of a print image cannot be seen by a driving control of the overlapping ejection openings. Even when the print element boards 10 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 13. Further, in the application example, a principal plane of the print element board has a parallelogram shape, but the invention is not limited thereto. For example, even when the print element boards having a rectangular shape, a trapezoid shape, and the other shapes are used, the configuration of the invention can be desirably used.

(Second Application Example)

Hereinafter, configurations of an inkjet printing apparatus 2000 and a liquid ejection head 2003 according to a second application example of the invention will be described with reference to the drawings. In the description below, only a difference from the first application example will be described and a description of the same components as those of the first application example will be omitted.

(Description of Inkjet Printing Apparatus)

Figure 21:
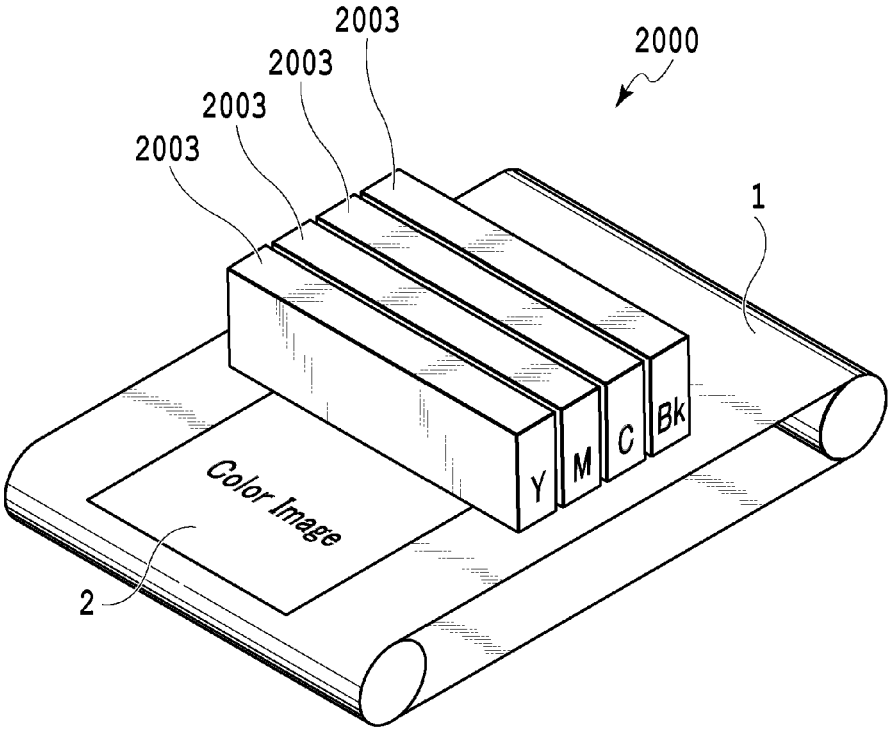
FIG. 21 is a diagram illustrating an inkjet printing apparatus that prints an image by ejecting a liquid.

FIG. 21 is a diagram illustrating the inkjet printing apparatus 2000 according to the application example used to eject the liquid. The printing apparatus 2000 of the application example is different from the first application example in that a full color image is printed on the print medium by a configuration in which four monochromic liquid ejection heads 2003 respectively corresponding to the inks of cyan C, magenta M, yellow Y, and black K are disposed in parallel. In the first application example, the number of the ejection opening rows which can be used for one color is one. However, in the application example, the number of the ejection opening rows which can be used for one color is twenty. For this reason, when print data is appropriately distributed to a plurality of ejection opening rows to print an image, an image can be printed at a higher speed.

Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first application example, the supply system, the buffer tank 1003 (see FIGS. 2 and 3), and the main tank 1006 (see FIGS. 2 and 3) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first application example, the first and second circulation modes illustrated in FIG. 2 or 3 can be used as the liquid circulation mode between the printing apparatus 2000 and the liquid ejection head 2003.

(Description of Structure of Liquid Ejection Head)

Figure 14A:
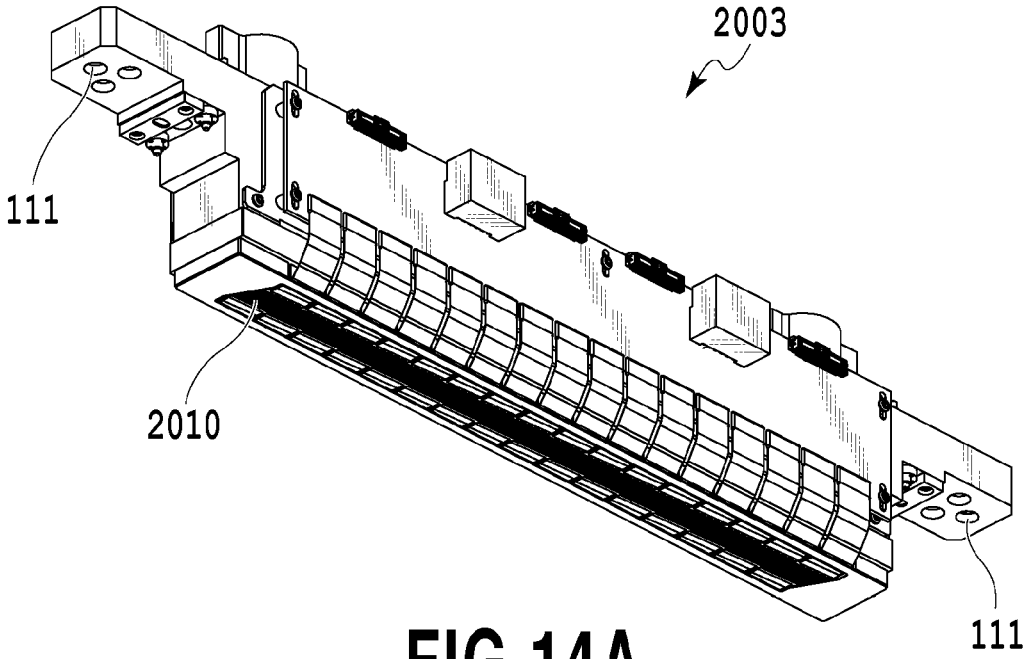
FIG. 14A is a perspective view illustrating the liquid ejection head.
Figure 14B:
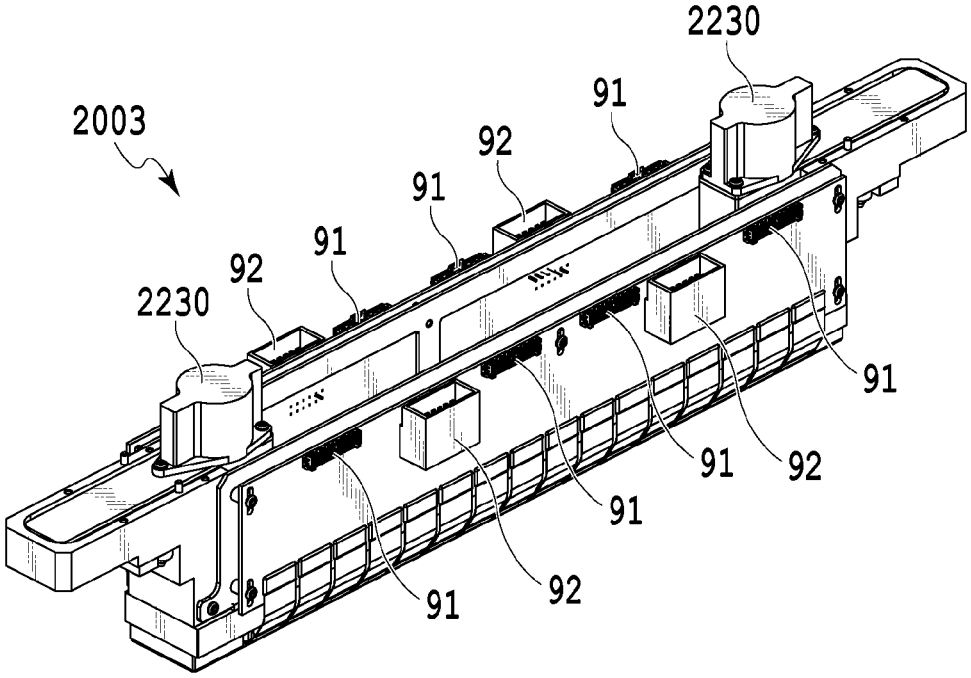
FIG. 14B is a perspective view illustrating the liquid ejection head.

FIGS. 14A and 14B are perspective views illustrating the liquid ejection head 2003 according to the application example. Here, a structure of the liquid ejection head 2003 according to the application example will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first application example, the liquid ejection head 2003 includes the liquid connection portion 111, the signal input terminal 91, and the power supply terminal 92. However, since the liquid ejection head 2003 of the application example includes many ejection opening rows compared with the first application example, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 15:
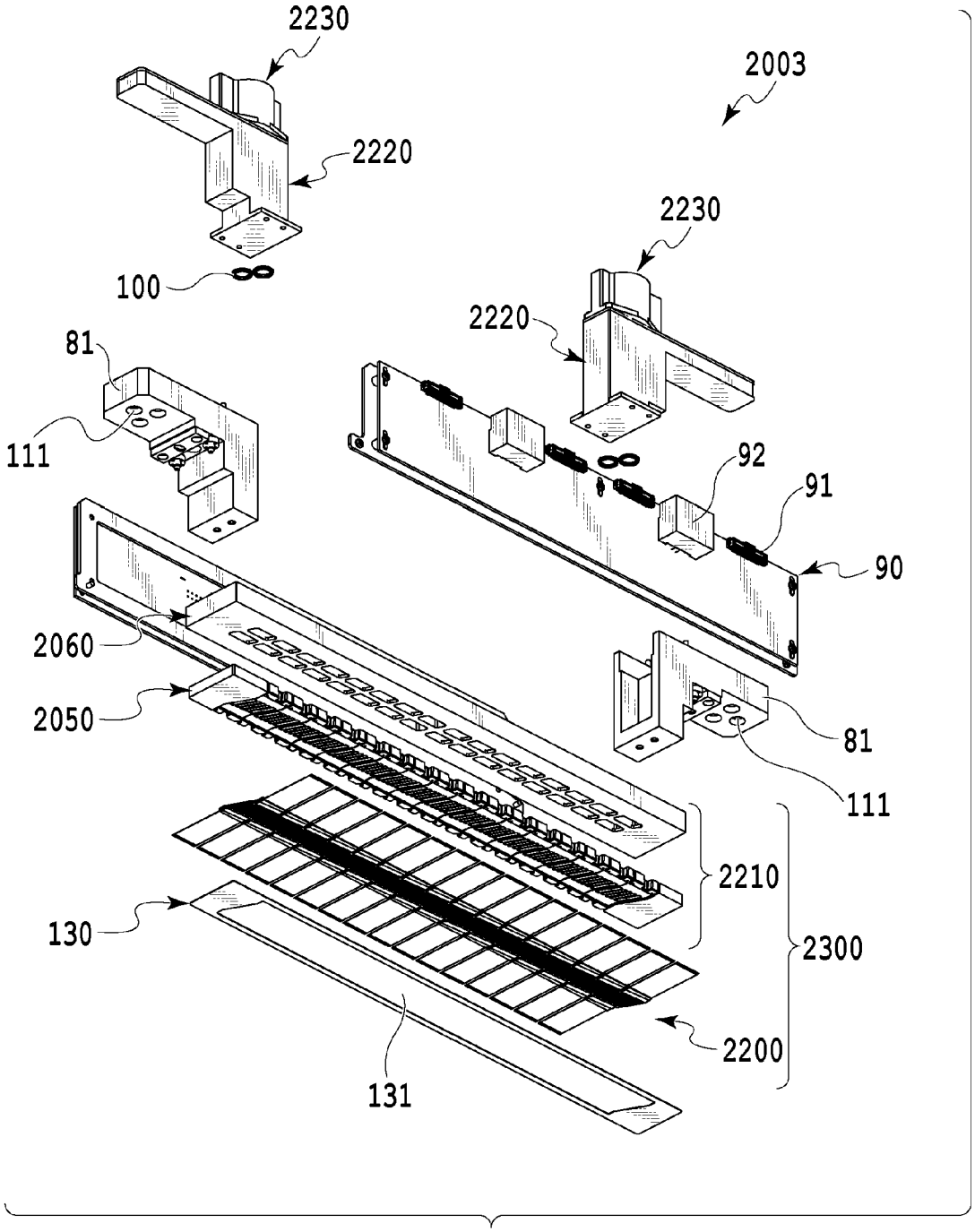
FIG. 15 is an oblique exploded view illustrating the liquid ejection head.

FIG. 15 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the first application example, but the function of guaranteeing the rigidity of the liquid ejection head is different. In the first application example, the rigidity of the liquid ejection head is mainly guaranteed by the liquid ejection unit support portion 81, but in the liquid ejection head 2003 of the second application example, the rigidity of the liquid ejection head is guaranteed by a second passage member 2060 included in a liquid ejection unit 2300.

The liquid ejection unit support portion 81 of the application example is connected to both ends of the second passage member 2060 and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 81. Each of two liquid supply units 2220 includes a filter (not illustrated) built therein.

Two negative pressure control units 2230 are set to control a pressure at different and relatively high and low negative pressures. Further, as in FIGS. 14B and 15, when the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 15, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 16:
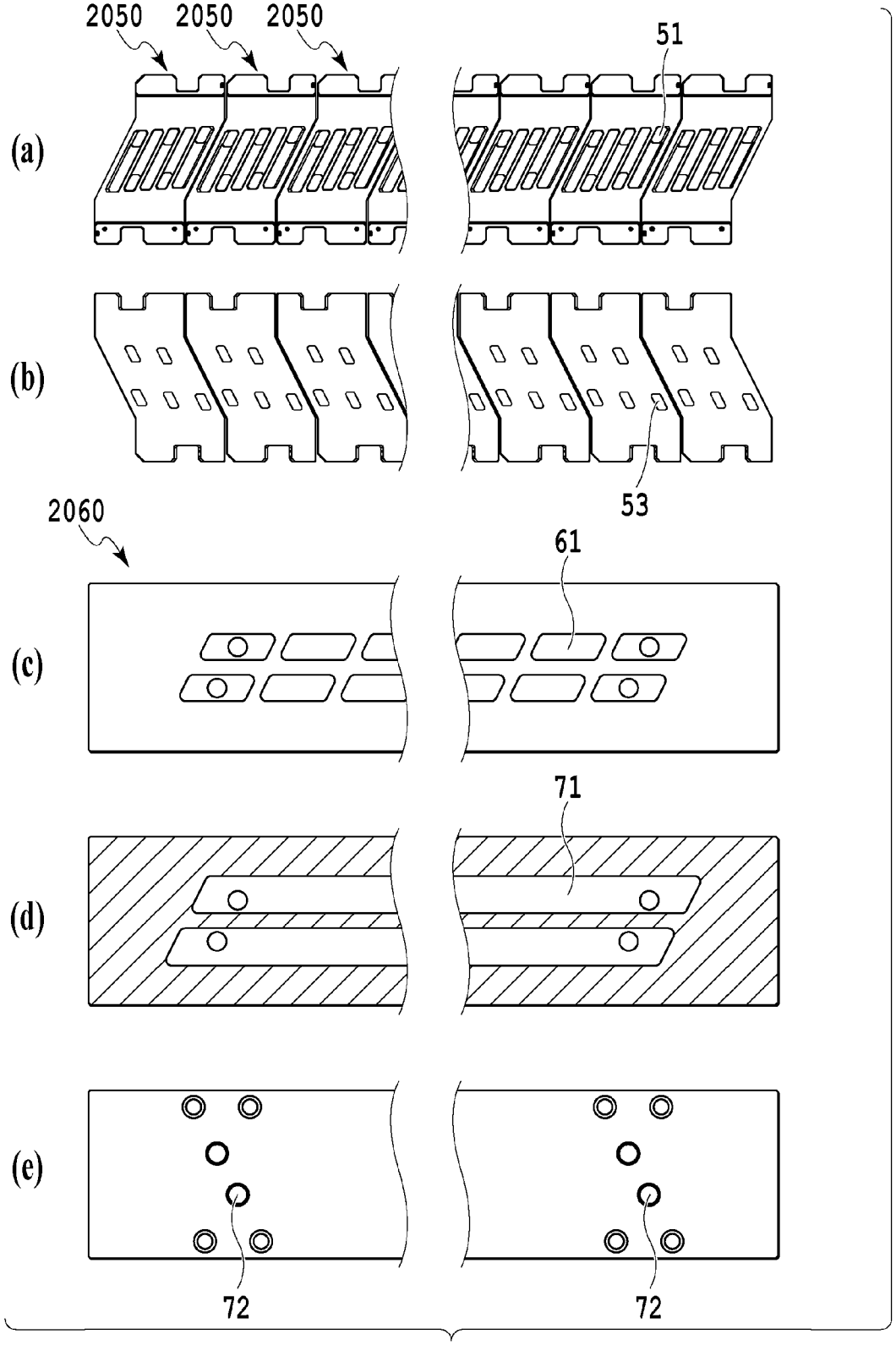
FIG. 16 is a diagram illustrating the first passage member.

Part (a) of FIG. 16 is a diagram illustrating a face onto which the ejection module 2200 is mounted in the first passage member 2050 and part (b) of FIG. 16 is a diagram illustrating a rear face thereof and a face contacting the second passage member 2060. Differently from the first application example, the first passage member 2050 of the application example has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more.

As illustrated in part (a) of FIG. 16, the communication opening 51 of the first passage member 2050 fluid-communicates with the ejection module 2200. As illustrated in part (b) of FIG. 16, the individual communication opening 53 of the first passage member 2050 fluid-communicates with the communication opening 61 of the second passage member 2060. Part (c) of FIG. 16 illustrates a contact face of the second passage member 60 with respect to the first passage member 2050, part (d) of FIG. 16 illustrates a cross-section of a center portion of the second passage member 60 in the thickness direction, and part (e) of FIG. 16 is a diagram illustrating a contact face of the second passage member 2060 with respect to the liquid supply unit 2220. The function of the communication opening or the passage of the second passage member 2060 is similar to each color of the first application example. The common passage groove 71 of the second passage member 2060 is formed such that one side thereof is a common supply passage 2211 illustrated in FIG. 17 and the other side thereof is a common collection passage 2212. These passages are respectively provided along the longitudinal direction of the liquid ejection head 2003 so that the liquid is supplied from one end thereof to the other end thereof. The application example is different from the first application example in that the liquid flow directions in the common supply passage 2211 and the common collection passage 2212 are opposite to each other.

Figure 17:
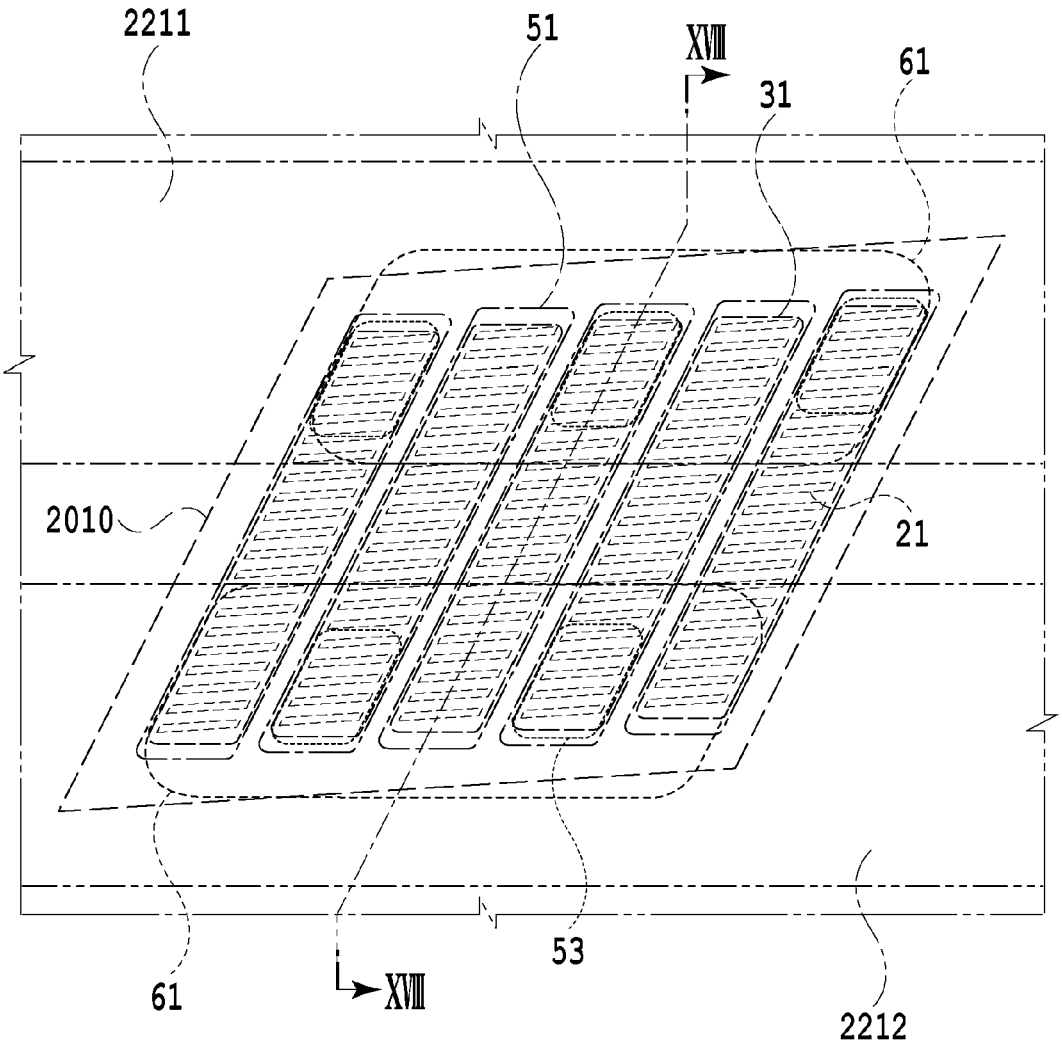
FIG. 17 is a perspective view illustrating a liquid connection relation between the print element board and the passage member.

FIG. 17 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 18:
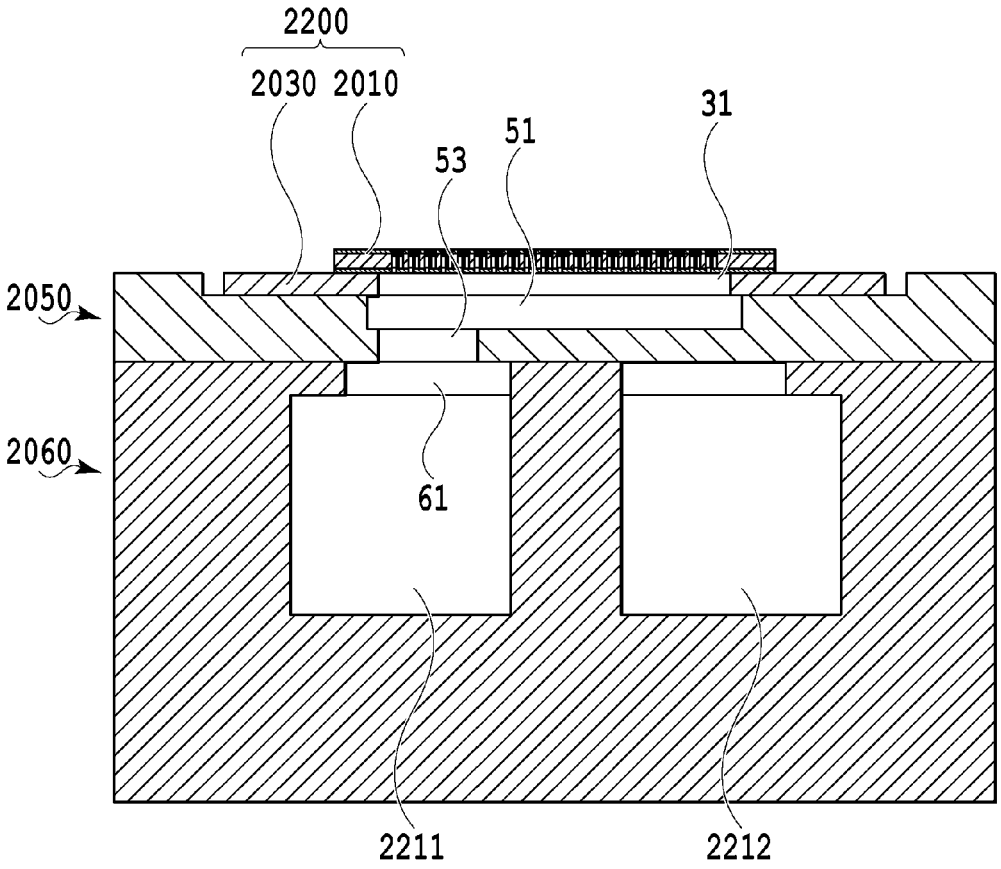
FIG. 18 is a cross-sectional view taken along a line XVIII-XVIII of FIG. 17.

FIG. 18 is a cross-sectional view taken along a line XVIII-XVIII of FIG. 17. The common supply passage 2211 is connected to the ejection module 2200 through the communication opening 61, the individual communication opening 53, and the communication opening 51. Although not illustrated in FIG. 18, it is obvious that the common collection passage 2212 is connected to the ejection module 2200 by the same path in a different cross-section in FIG. 17. Similarly to the first application example, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first application example, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 19A:
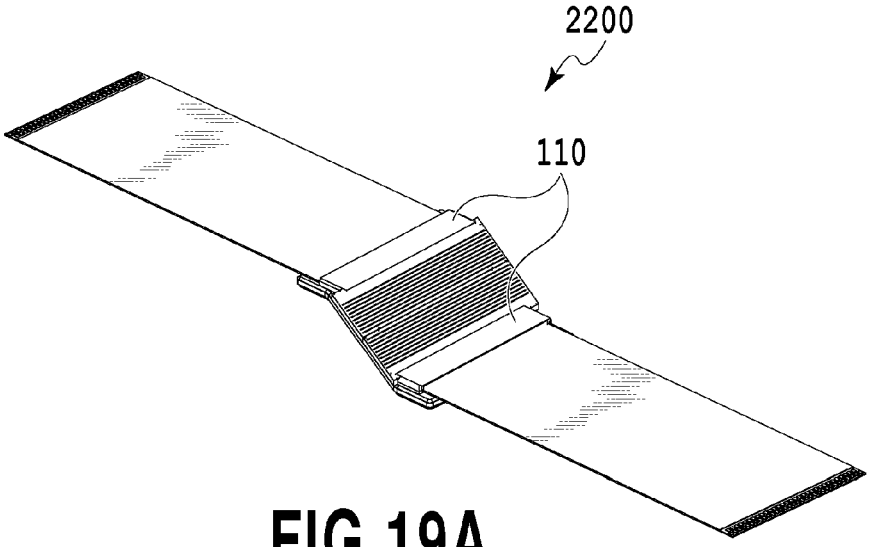
FIG. 19A is a perspective view illustrating one ejection module.
Figure 19B:
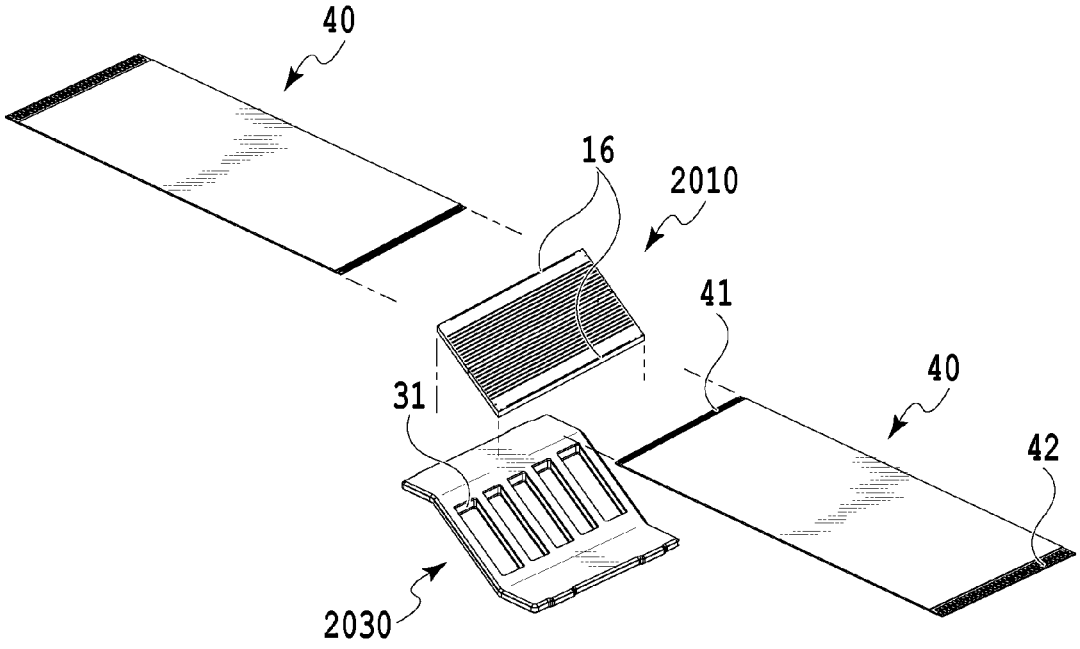
FIG. 19B is an exploded view illustrating one ejection module.

FIG. 19A is a perspective view illustrating one ejection module 2200 and FIG. 19B is an exploded view thereof. A difference from the first application example is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first application example. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first application example.

(Description of Structure of Print Element Board)

Figure 20:
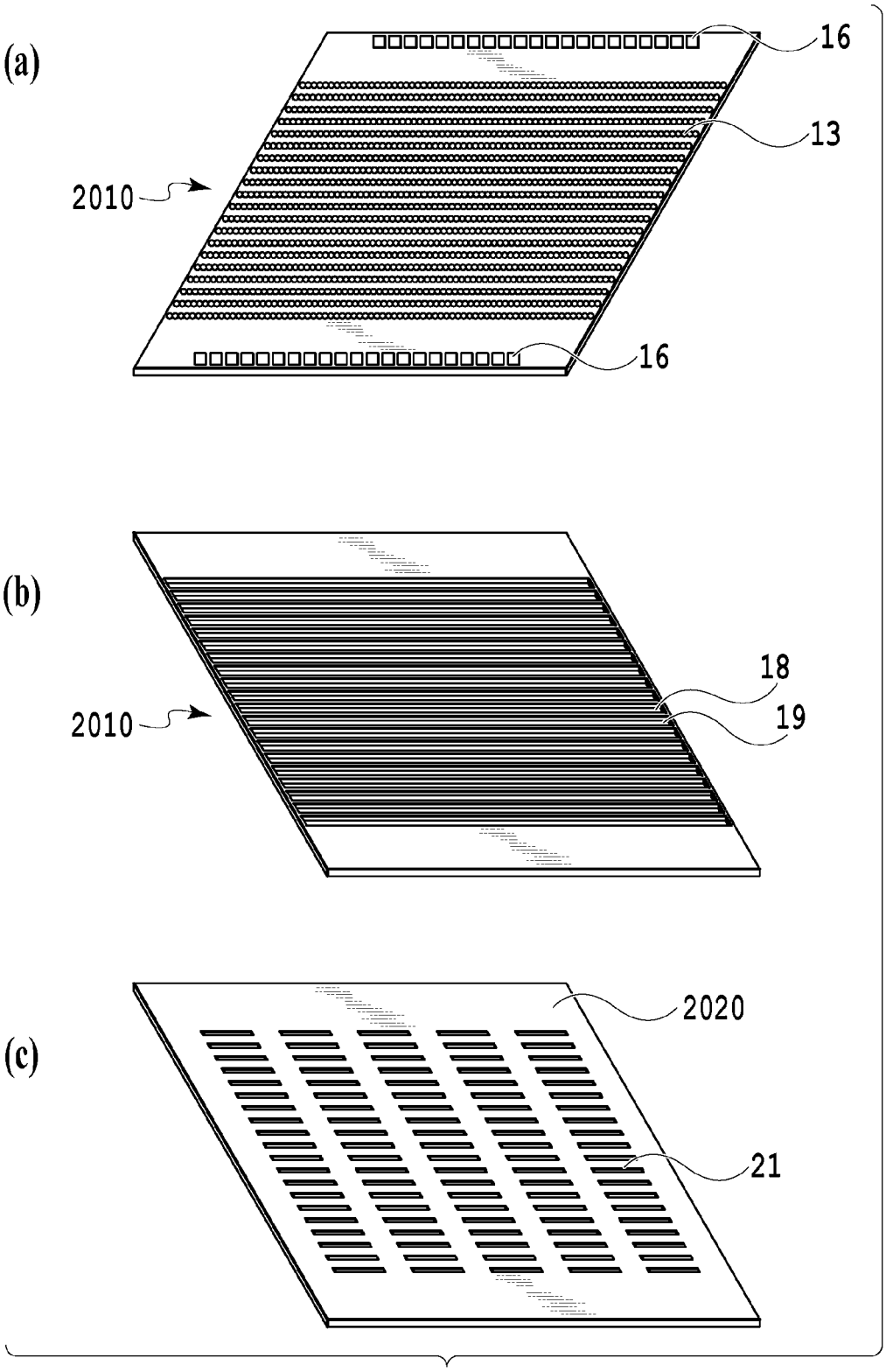
FIG. 20 is a schematic diagram illustrating the print element board.

Part (a) of FIG. 20 is a schematic diagram illustrating a face on which the ejection opening 13 is disposed in the print element board 2010 and part (c) of FIG. 20 is a schematic diagram illustrating a rear face of the face of part (a) of FIG. 20. Part (b) of FIG. 20 is a schematic diagram illustrating a face of the print element board 2010 when a lid member 2020 provided in the rear face of the print element board 2010 in part (c) of FIG. 20 is removed. As illustrated in part (b) of FIG. 20, the liquid supply path 18 and the liquid collection path 19 are alternately provided along the ejection opening row direction at the rear face of the print element board 2010.

The number of the ejection opening rows is larger than that of the first application example. However, a basic difference from the first application example is that the terminal 16 is disposed at both sides of the print element board in the ejection opening row direction as described above. A basic configuration is similar to the first application example in that a pair of the liquid supply path 18 and the liquid collection path 19 is provided in each ejection opening row and the lid member 2020 is provided with the opening 21 communicating with the liquid communication opening 31 of the support member 2030.

In addition, the description of the above-described application example does not limit the scope of the invention. As an example, in the application example, a thermal type has been described in which bubbles are generated by a heating element to eject the liquid. However, the invention can be also applied to the liquid ejection head which employs a piezo type and the other various liquid ejection types.

In the application example, the inkjet printing apparatus (the printing apparatus) has been described in which the liquid such as ink is circulated between the tank and the liquid ejection head, but the other application examples may be also used. In the other application examples, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the application example, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

(First Embodiment)

Hereinafter, a first embodiment of the invention will be described with reference to the drawings. Further, since a basic configuration of the embodiment is similar to that of the above-described application example, only characteristic configurations will be described below.

Hereinafter, a liquid ejection head and a liquid ejection apparatus according to the embodiment of the invention will be described with reference to the drawings. In the embodiments below, a liquid ejection head ejecting a liquid (hereinafter, also referred to as ink), a liquid ejection apparatus, and a manufacturing method will be described as detailed configurations, but the invention is not limited thereto. The liquid ejection head, the liquid ejection apparatus, and the manufacturing method of the invention can be applied to a printer, a copying machine, a facsimile having a communication system, a word processor having a printer, and an industrial printing apparatus combined with various processing devices. For example, the liquid ejection head, the liquid ejection apparatus, and the manufacturing method of the invention can be used to manufacture a biochip or print an electronic circuit.

Further, since the embodiments to be described below are detailed examples of the invention, various technical limitations thereof can be made. However, the embodiments are not limited to the embodiments or the other detailed methods of the specification as long as the embodiments are based on the spirit of the invention.

(Print Element Board and Lid Member)

Figure 22:
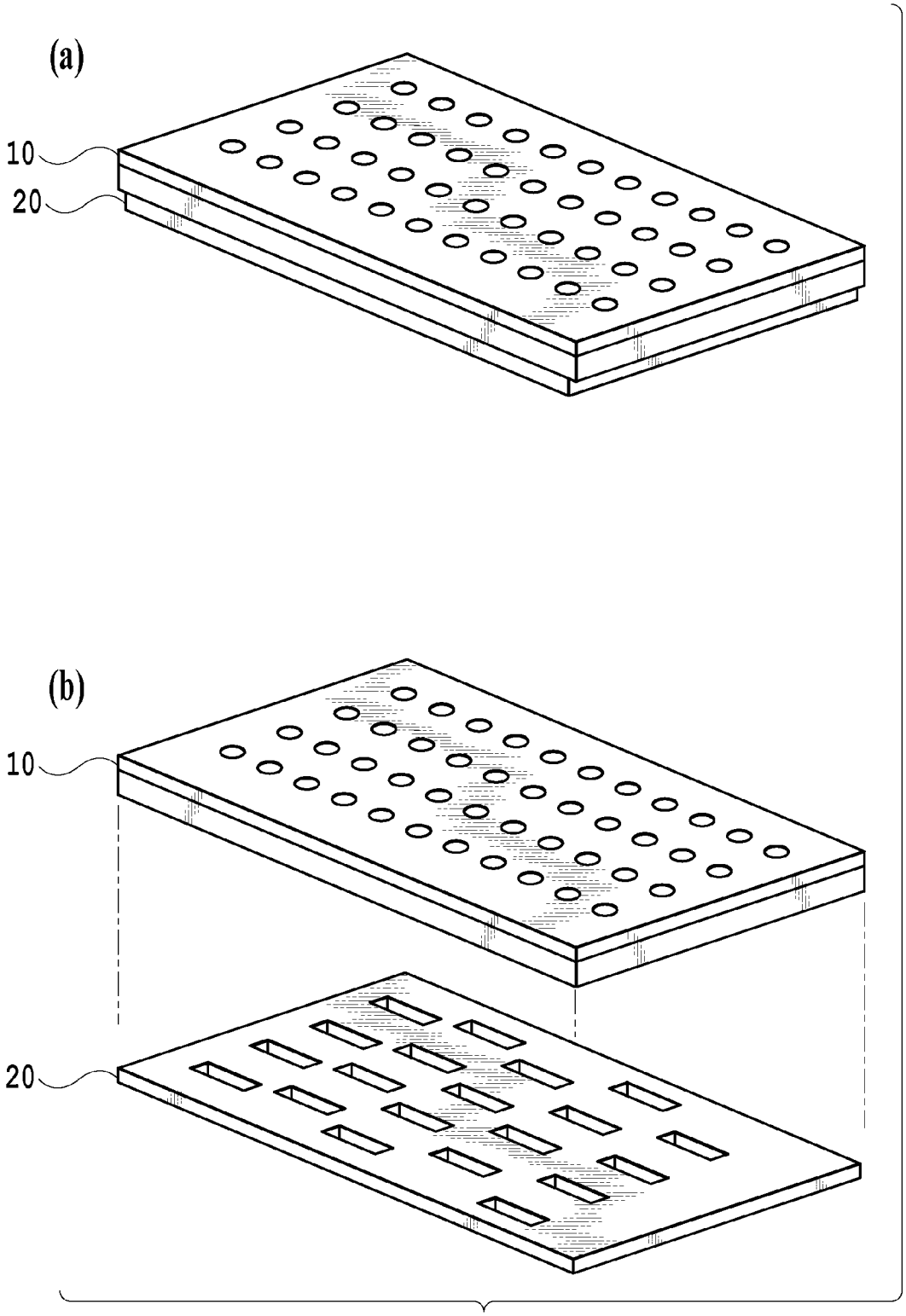
FIG. 22 is a diagram illustrating a print element board and a lid member.

FIG. 22 is a diagram illustrating a print element board 10 and a lid member 20 of the embodiment. The lid member 20 is a member that serves as a lid for a passage formed in a rear face of the print element board 10 (a face opposite to a face provided with an ejection opening forming member 12) illustrated in part (a) of FIG. 22 and is provided with a third passage layer to be described later as illustrated in part (b)

of FIG. 22. In the invention, both the print element board 10 and the lid member 20 are formed in a wafer shape in a wafer step and are divided.

(Configuration Example of Liquid Ejection Head)

FIGS. 23A to 23E are perspective views illustrating liquid ejection heads. The liquid ejection head of FIG. 23A includes one print element board 10 and has a configuration in which a support member 30 and the print element board 10 are disposed on a first passage member 50. The liquid ejection head is used in a so-called serial scan type liquid ejection printing apparatus. The liquid ejection printing apparatus is configured to print an image on a print medium by repeating a scanning operation in which ink is ejected from an ejection opening while the liquid ejection head is moved in a main scan direction corresponding to a direction of the arrow X and a conveying operation in which the print medium is conveyed in a sub-scan direction corresponding to a direction of the arrow Y and intersecting the main scan direction. The main scan direction is a direction intersecting (in the case of this example, orthogonal to) a first direction in which an ejection opening row 14 extends.

Figure 23A:
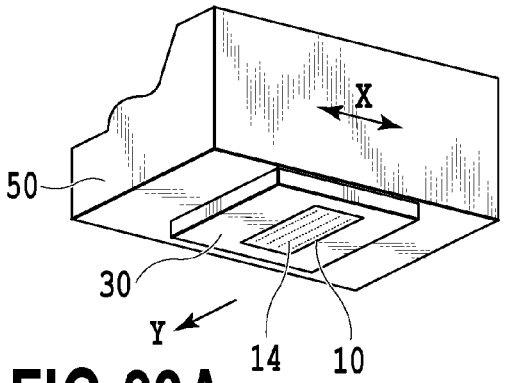
FIG. 23A is a perspective view illustrating a liquid ejection head.
Figure 23C:
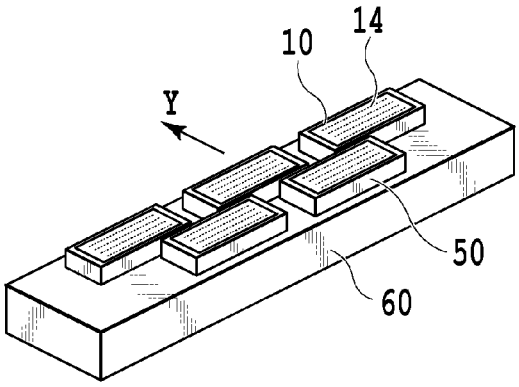
FIG. 23C is a perspective view illustrating the liquid ejection head.
Figure 23B:
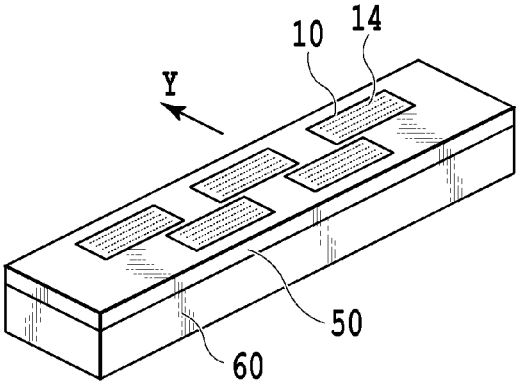
FIG. 23B is a perspective view illustrating the liquid ejection head.

The liquid ejection head of FIGS. 23B and 23C is an elongated line head in which a plurality of print element boards 10 are disposed in a zigzag shape. In the configuration illustrated in FIG. 23B, the first passage member 50 is commonly disposed on the plurality of print element boards 10. Then, in the configuration of FIG. 23C, the first passage member 50 is individually disposed on each print element board 10. Such a liquid ejection head is used in a so-called full line type liquid ejection printing apparatus. The liquid ejection printing apparatus is configured to continuously print an image on the print medium by ejecting the ink from the liquid ejection head at a fixed position while continuously conveying the print medium in the direction of the arrow Y and intersecting (in the case of this example, orthogonal to) the first direction in which the ejection opening row 14 extends.

Figure 23D:
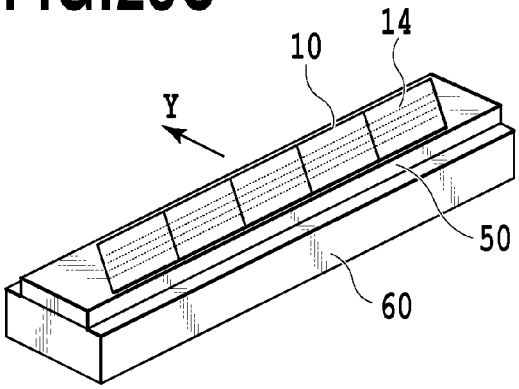
FIG. 23D is a perspective view illustrating the liquid ejection head.
Figure 23E:
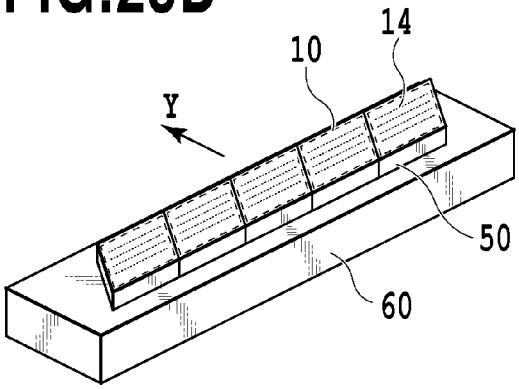
FIG. 23E is a perspective view illustrating the liquid ejection head.

The liquid ejection head of FIGS. 23D and 23E is an elongated line head in which the print element board 10 is disposed in one row and is used in a so-called full line type liquid ejection printing apparatus. In the configuration of FIG. 23D, the first passage member 50 is commonly disposed on the plurality of print element boards 10. Then, in the configuration of FIG. 23E, the first passage member 50 is individually disposed on the print element board 10. It is desirable that the print element board 10 of such a liquid ejection head be formed in the same shape as that of a fourth embodiment to be described later.

(Printing Apparatus)

Figure 24A:
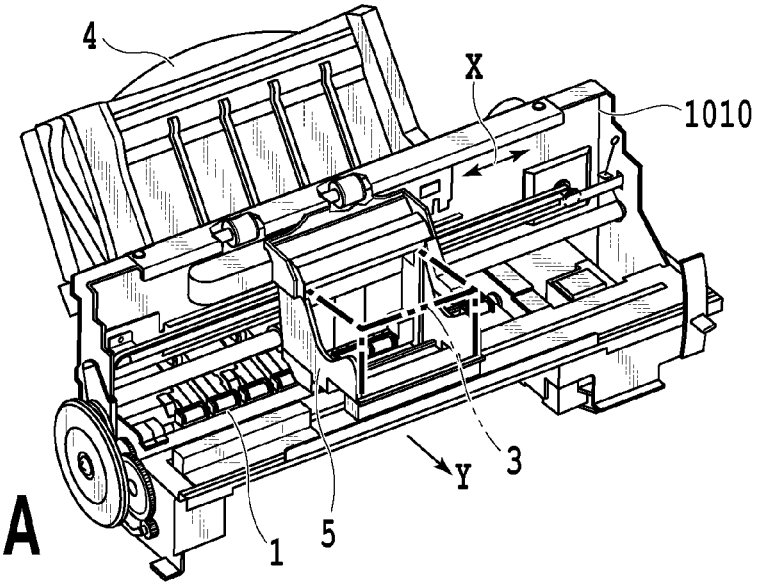
FIG. 24A is a diagram illustrating an outline of a liquid ejection printing apparatus.
Figure 24B:
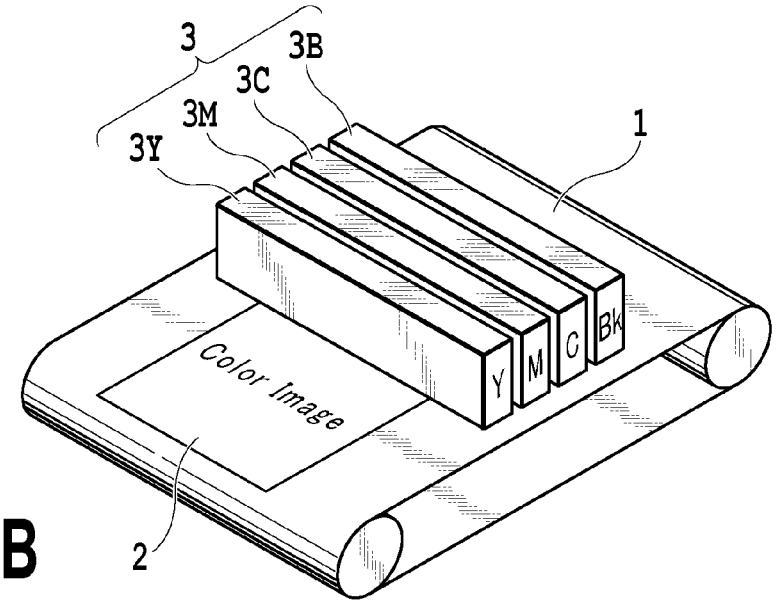
FIG. 24B is a diagram illustrating an outline of the liquid ejection printing apparatus.
Figure 24C:
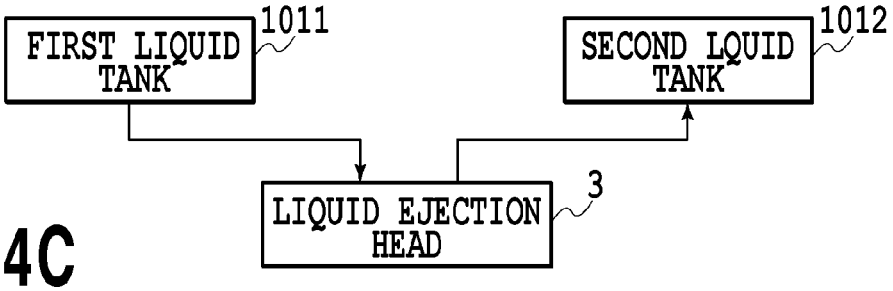
FIG. 24C is a diagram illustrating a passage structure of the liquid ejection printing apparatus.

FIGS. 24A to 24C are diagrams illustrating a passage structure and an outline of a liquid ejection printing apparatus (a liquid ejection apparatus) that employs the liquid ejection head of the invention. The printing apparatus of FIG. 24A is a serial scan type printing apparatus that uses a liquid ejection head having the same configuration as that of the liquid ejection head 3 illustrated in FIG. 23A. A chassis 1010 is formed by a plurality of plate-shaped metal members having predetermined rigidity and forms a frame of the printing apparatus. A feeding unit 4, a conveying unit 1, and a carriage 5 equipped with the liquid ejection head 3 and being movable in the main scan direction of the arrow X in a reciprocating manner are assembled to the chassis 1010. The main scan direction is a direction intersecting (in the case of this example, orthogonal to) the extension direction of the ejection opening row of the liquid ejection head 3.

The feeding unit 4 automatically feeds a sheet-shaped print medium (not illustrated) into the printing apparatus and the conveying unit 1 conveys the print medium fed one by one from the feeding unit 4 in the sub-scan direction corresponding to the direction of the arrow Y. The sub-scan direction is a direction intersecting (in the case of this example, orthogonal to) the main scan direction. Such a printing apparatus prints an image on the print medium by repeating a scanning operation in which the ink is ejected from the ejection opening of the liquid ejection head 3 while the liquid ejection head 3 is moved in the main scan direction along with the carriage 5 and a conveying operation in which the print medium is conveyed in the sub-scan direction. The ink is supplied from an ink tank (not illustrated) to the liquid ejection head 3.

The printing apparatus of FIG. 24B is a full line type liquid ejection printing apparatus that uses the elongated liquid ejection head 3 illustrated in FIGS. 23B, 23C, 23D, and 23E and includes the conveying unit 1 that continuously conveys a sheet (a print medium) 2 in the direction of the arrow Y. As the conveying unit 1, a conveyer roller may be used instead of the conveyor belt of this example. In this example, four liquid ejection heads 3Y, 3M, 3C, and 3B ejecting yellow (Y), magenta (M), cyan (C), and black (Bk) are provided as the liquid ejection heads 3. Corresponding inks are supplied to the liquid ejection heads 3 (3Y, 3M, 3C, and 3B). When the ink is ejected from the liquid ejection head 3 at a fixed position while the sheet 2 is continuously conveyed in the direction of the arrow Y, a color image is continuously printed on the sheet 2.

FIG. 24C is an explanatory diagram illustrating an ink supply system for the liquid ejection head 3. The ink inside a first liquid tank 1011 is supplied to a common supply passage 211 (see FIGS. 2 and 3) of the liquid ejection head 3, passes through a pressure chamber 23, and is collected from a common collection passage 212 (see FIGS. 2 and 3) to a second liquid tank 1012. As a method of generating an ink circulation flow to be described below inside the liquid ejection head 3, for example, a method of using a water head difference between the first liquid tank 1011 and the second liquid tank 1012 is known.

Alternatively, a method of generating a pressure difference between the first liquid tank 1011 and the second liquid tank 1012 by controlling the pressures inside the first liquid tank 1011 and the second liquid tank 1012 is also known. Further, the ink circulation flow can be also generated by a pump or the like. A configuration of the ink supply system and a method of generating the ink circulation flow are not limited to this example and may be arbitrarily set. That is, a differential pressure generator that generates a pressure difference necessary to circulate the ink inside the pressure chamber may be used.

Additionally, a method described herein is merely an example and does not limit the scope of the invention. For example, a circulation path may be formed in which the ink which is collected to the second liquid tank 1012 is supplied to the liquid ejection head 3 again through the first liquid tank 1011. Further, the liquid ejection head may include only the liquid tank 1011 to form a circulation path in which the ink is returned from the liquid tank 1011 to the liquid tank 1011 through the liquid ejection head and is supplied to the liquid ejection head 3 again.

(Liquid Ejection Unit)

Figure 25:
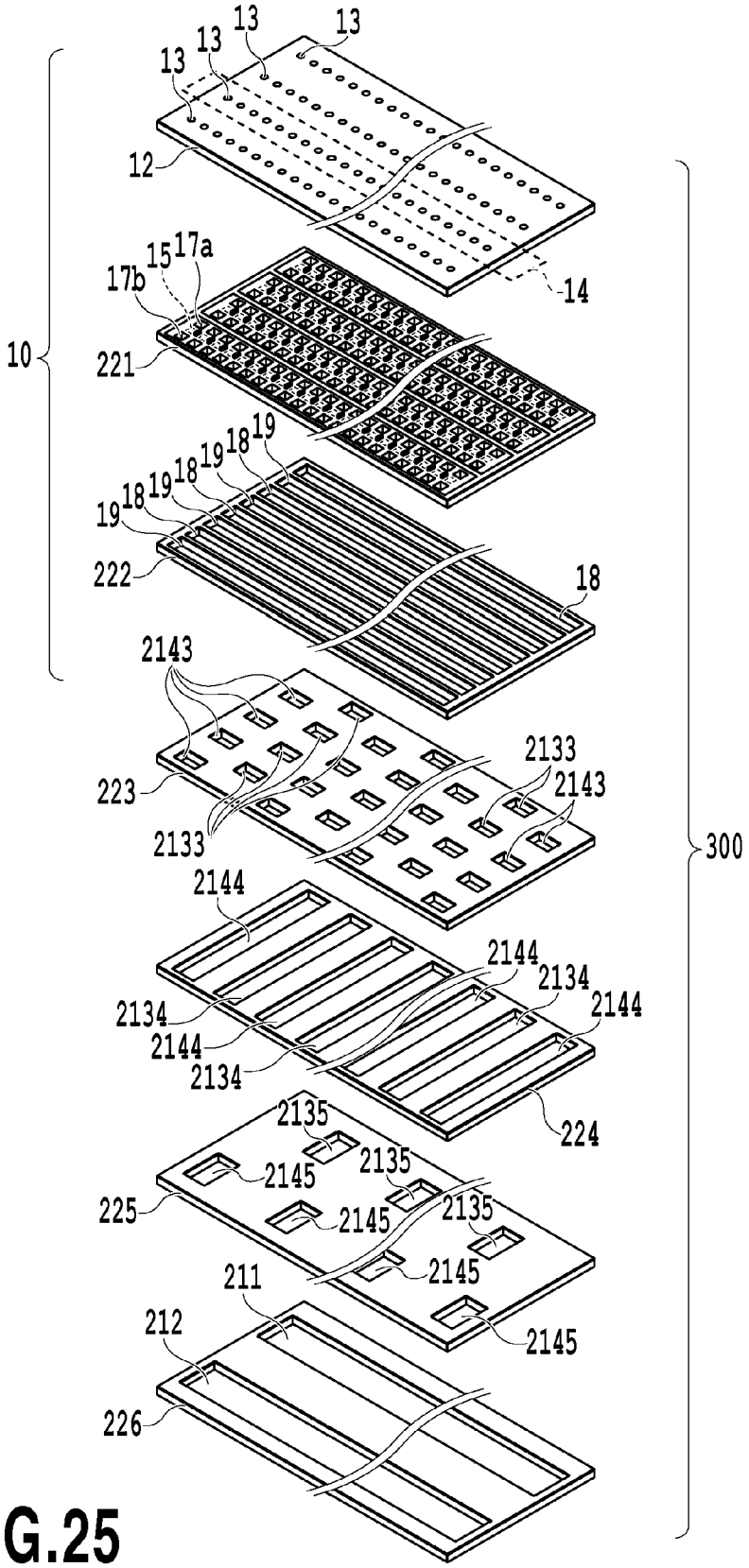
FIG. 25 is an exploded perspective view illustrating a liquid ejection unit.
Figure 26:
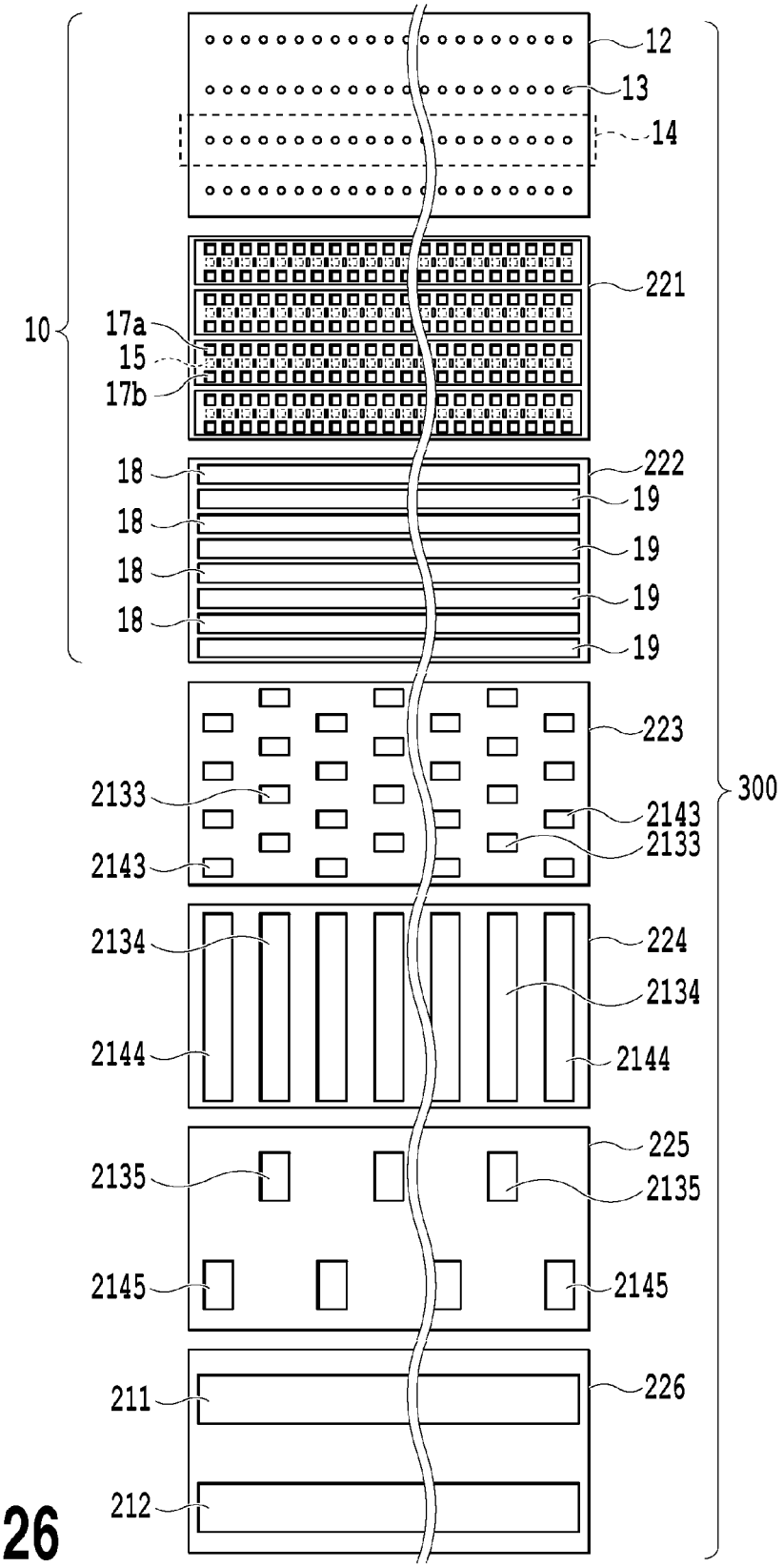
FIG. 26 is an exploded perspective view illustrating the liquid ejection unit.

FIGS. 25 and 26 are exploded perspective views illustrating a liquid ejection unit 300. As illustrated in FIGS. 25 and 26, the liquid ejection unit 300 of the embodiment includes the ejection opening forming member 12 and a six-lamination passage structure including a first passage layer 221, a second passage layer 222, a third passage layer 223, a fourth passage layer 224, a fifth passage layer 225, and a sixth passage layer 226. The print element board 10 includes a print element 15, the ejection opening forming member 12, and the passage structure (the first passage layer 221 to the second passage layer 222). The print element board 10 includes a substrate including the print element 15 and the ejection opening forming member 12 including the ejection opening. Here, the substrate including the print element 15 is formed as a Si substrate and is provided with a passage supplying the ink to the print element 15. The passage includes a liquid supply path 18 and a liquid collection path 19 which extend in the arrangement direction of the ejection opening 13. Further, the passage includes a plurality of supply openings 17*a* which communicate with the liquid supply path 18 and are arranged along the liquid supply path 18 and a plurality of collection openings 17*b* which communicate with the liquid collection path 19 and are arranged along the liquid collection path 19.

In the present invention, the substrate including the print element 15 may include a single layer or a plurality of layers. In the case of the single layer illustrated in FIG. 12, one Si substrate 11 is provided with the liquid supply path 18, the liquid collection path 19, the plurality of supply openings 17*a*, and the plurality of collection openings 17*b*. In the case of two layers of first and second Si substrates illustrated in FIG. 28, a first Si substrate 11 is provided with the plurality of supply openings 17*a* and the plurality of collection openings 17*b* and a second Si substrate 115 is provided with the liquid supply path 18 and the liquid collection path 19. Regardless of one or a plurality of Si substrates, a lid member 20 including a plurality of openings 21 is provided at a rear face of the Si substrate. The opening 20 includes a supply opening 20 which supplies the liquid to the liquid supply path 18 and a collection opening 20 which collects the liquid from the liquid collection path 19. The plurality of openings 20 are arranged along the liquid supply path 18 and the liquid collection path 19. The invention is not limited to such an example. For example, the first passage layer 221 may be formed at the first Si substrate and the second passage layer 222 may be formed at the second Si substrate. Further, at least one opening 20 may be provided at the liquid supply path 18 and the liquid collection path 19.

As the print element 15, a thermoelectric element (heater) or a piezoelectric element can be used. In a case where the heater is used, the ink inside the pressure chamber 23 is changed into bubbles by the heat and the ink is ejected from the ejection opening 13 by using foaming energy.

Figure 27:
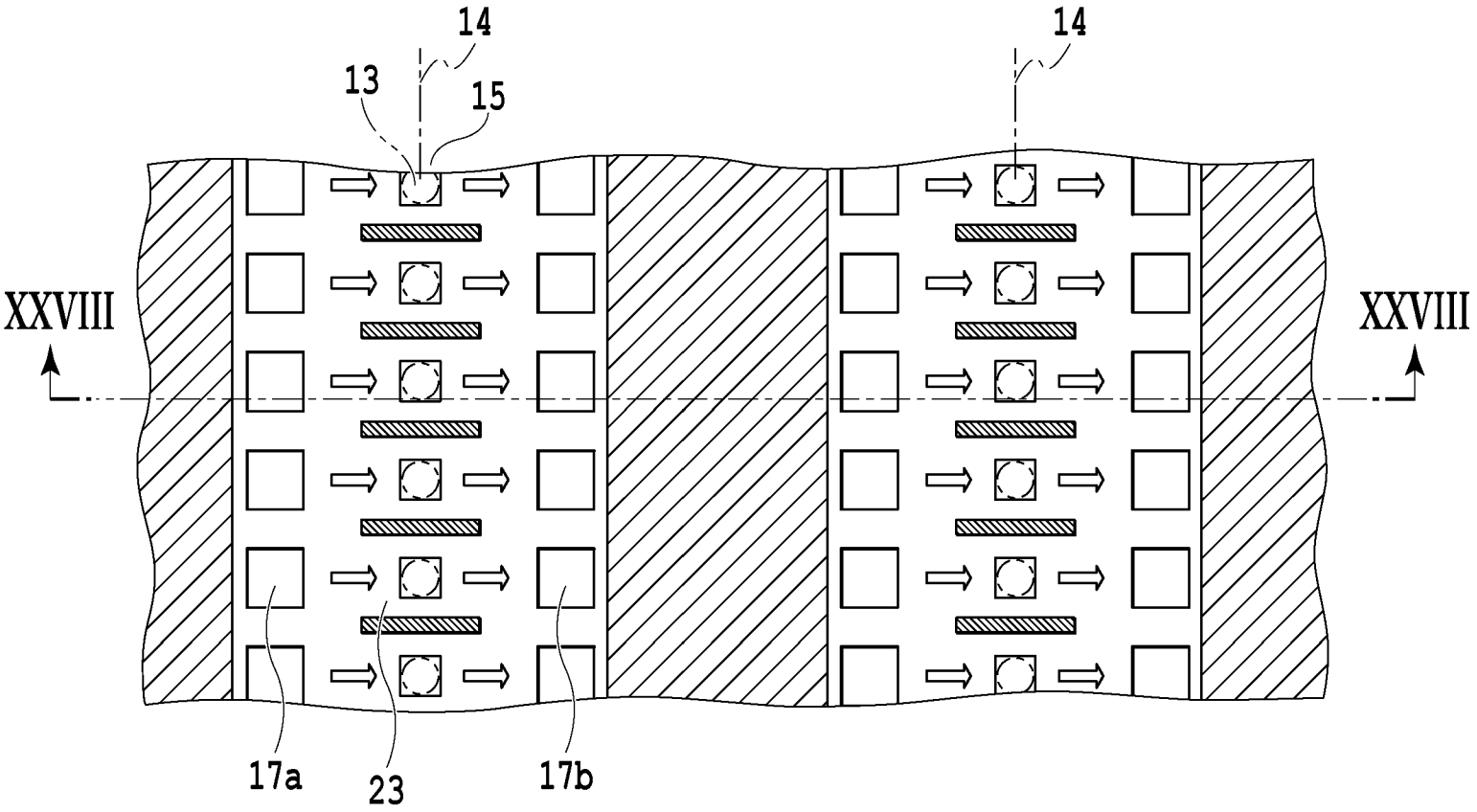
FIG. 27 is a diagram illustrating an ejection opening which overlaps a partially enlarged view of a first passage layer.

FIG. 27 is a diagram illustrating the ejection opening 13 of the ejection opening forming member 12 which overlaps a partially enlarged view of the first passage layer 221. As illustrated in FIG. 27, a plurality of the ejection openings 13 are densely arranged to form the ejection opening row 14. In this example, one liquid ejection unit 300 is provided with four ejection opening rows 14.

Figure 28:
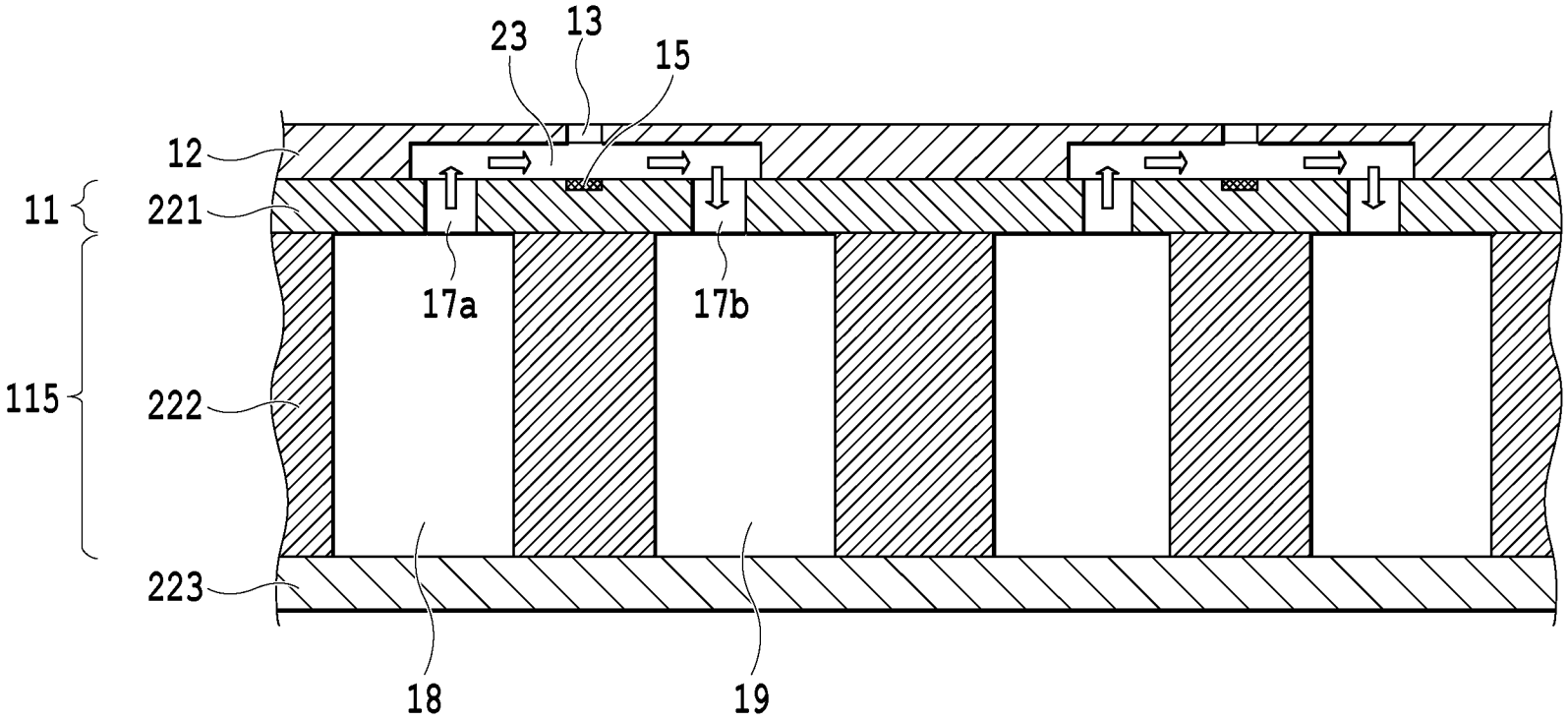
FIG. 28 is a cross-sectional view illustrating a liquid supply path and a liquid collection path of a second passage layer.
Figure 29:
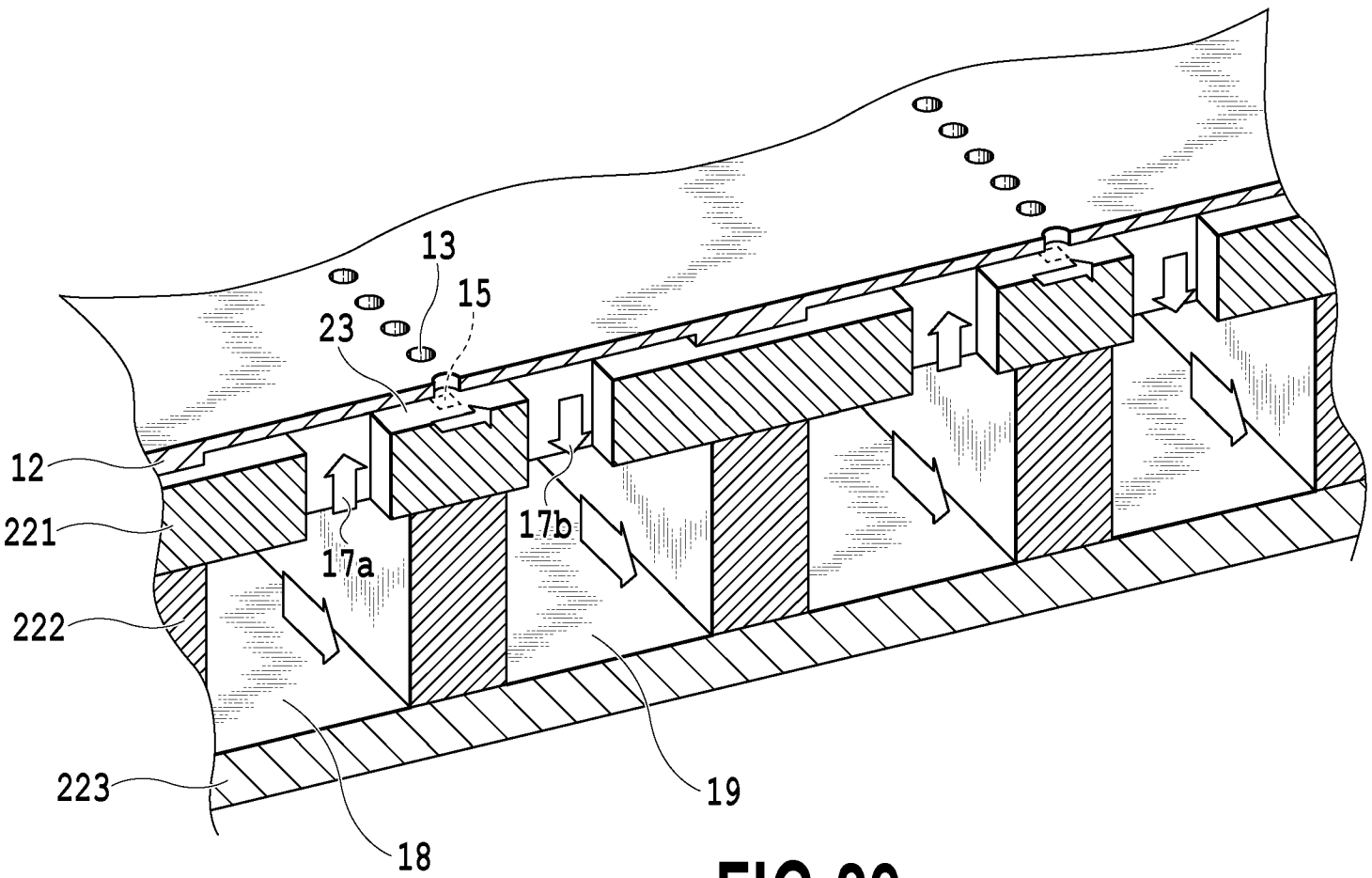
FIG. 29 is a perspective view illustrating the liquid supply path and the liquid collection path of the second passage layer.

FIG. 28 is a cross-sectional view illustrating the liquid supply path 18 and the liquid collection path 19 of the second passage layer 222 and FIG. 29 is a perspective view thereof. As illustrated in FIG. 28, the liquid supply path 18 of the second passage layer 222 communicates with one side (the left side of FIG. 28) of each pressure chamber 23 through an individual supply opening 17*a* corresponding to each pressure chamber 23. Similarly, the liquid collection path 19 of the second passage layer 222 communicates with the other side (the right side of FIG. 28) of each pressure chamber 23 through the individual collection opening 17*b* from the pressure chamber 23.

The liquid supply path 18 communicates with a liquid supply opening 2133 formed at the third passage layer 223 serving as a lid member and is formed so that the ink is supplied thereto from the liquid supply opening 2133. Similarly, the liquid collection path 19 communicates with a liquid collection opening 2143 formed at the third passage layer 223. A plurality of the liquid supply openings 2143 are arranged in the arrangement direction (the first direction) of the ejection opening of the ejection opening row 14 to form a row of the liquid supply opening 2133. Similarly, a plurality of the liquid collection openings 2143 are arranged in the first direction similarly to the row of the liquid supply opening 2133 to form a row of the liquid collection opening 2143. The row of the liquid supply opening 2133 and the row of the liquid collection opening 2143 are alternately arranged at the third passage layer 223.

The fourth passage layer 224 is provided with a common supply path 2134 and a common collection path 2144 and the fifth passage layer 225 is provided with an individual supply opening 2135 and an individual collection opening 2145. The sixth passage layer 226 is provided with the common supply passage 211 and the common collection passage 212.

The liquid supply path 18 is formed such that one side (a side of the first passage layer 221) of the second passage layer 222 in the thickness direction communicates with the plurality of supply openings 17*a* and the other side (a side of the third passage layer 223) communicates with the plurality of liquid supply openings 2133. Similarly, the liquid collection path 19 is formed such that one side of the second passage layer 222 in the thickness direction communicates with the plurality of collection openings 17*b* and the other side thereof communicates with the plurality of liquid collection openings 2143. The common supply path 2134 is formed such that one side of the fourth passage layer 224 in the thickness direction communicates with the plurality of liquid supply openings 2133 and the other side thereof communicates with the plurality of second supply openings 2135.

Similarly, the common collection path 2144 is formed such that one side of the fourth passage layer 224 in the thickness direction communicates with the liquid collection opening 2143 and the other side thereof communicates with the individual collection opening 2145. Further, the common supply passage 211 of the sixth passage layer 226 communicates with the plurality of individual supply openings 2135 and the common collection passage 212 communicates with the plurality of individual collection openings 2145.

The arrangement density of the plurality of individual supply openings 2135 and the arrangement density of the plurality of individual collection openings 2145 are lower than the arrangement density of the plurality of liquid supply openings 2133 and the arrangement density of the plurality of liquid collection openings 2143. Further, the arrangement density of the plurality of liquid supply openings 2133 and the arrangement density of the plurality of liquid collection openings 2143 are lower than the arrangement density of the plurality of supply openings 17*a* and the arrangement density of the plurality of collection openings 17*b*. The liquid supply path 18 and the liquid collection path 19 are formed in parallel along the first direction and the common supply path 2134 and the common collection path 2144 are formed in parallel along a second direction. The common supply passage 211 and the common collection passage 212 are disposed in parallel along the first direction.

The liquid ejection unit 300 of this example includes a plurality of passage layers and the plurality of passage layers are laminated. The passage forming density of the passage layers increases in order of the sixth passage layer 226, the fifth passage layer 225, the fifth passage layer 225, the fourth passage layer 224, the third passage layer 223, the second passage layer 222, and the first passage layer 221. Accordingly, it is possible to form the liquid ejection unit 300 in which the plurality of ejection opening rows 14 are densely arranged while suppressing an increase in size of the print element board and each passage member. Further, the six passage layers may be respectively formed as different members.

Further, both the first passage layer 221 and the second passage layer 222 are formed at the substrate 11 to form the print element board 10, the third passage layer 223 is formed at the lid member 20, and a part of the fourth passage layer 224 is formed at the support member 30. Then, the other part of the fourth passage layer 224 is formed at the first passage member 50 (see FIGS. 23B to 23E), a part of the fifth passage layer 225 and the sixth passage layer 226 are formed at the second passage member (see FIGS. 23B to 23E), and the other part of the sixth passage layer 226 is formed at the third passage member.

Further, both the first passage layer 221 and the second passage layer 222 are formed at the substrate 11 to form the print element board 10 and the third passage layer 223 is formed at the lid member 20. Then, a part of the fourth passage layer 224 is formed at the support member 30, the other part of the fourth passage layer 224 and the fifth passage layer 225 are formed at the first passage member 50, and the sixth passage layer 226 is formed at the second passage member 60. In this way, a relation between the passage layer and the member does not limit the invention. Further, the configurations of the individual supply path 214*a*, the individual collection path 214*b*, the individual supply opening 215*a*, and the individual collection opening 215*b* do not limit this configuration.

The ink which is supplied from the outside sequentially flows from the common supply passage 211 communicating with an ink inflow opening to the individual supply opening 2135, the common supply path 2134, the liquid supply opening 2133, the liquid supply path 18, and the supply opening 17*a* to be guided to the pressure chamber 23. The ink inside the pressure chamber 23 sequentially flows through the collection opening 17*b*, the liquid collection path 19, the liquid collection opening 2143, the common collection path 2144, the individual collection opening 2145, and the common collection passage 212 to flow to the outside from an outflow opening communicating with the common collection passage 212. In this way, when the ink inside the pressure chamber 23 is circulated to the outside, the thick ink or bubbles which easily stay inside the pressure chamber 23 flow to the outside. Accordingly, it is possible to suppress a change in color concentration of the ink and a decrease in ejection speed of the ink from the ejection opening 13. Hereinafter, such a forced ink flow will be referred to as an "ink circulation flow".

In this example, the supply opening 17*a* and the collection opening 17*b* are disposed to face each other with the ejection opening 13 interposed therebetween as illustrated in FIGS. 27, 28, and 29. In this way, when the pressure chamber 23 is interposed between the supply opening 17*a* and the collection opening 17*b*, an ink circulation flow is generated inside the pressure chamber 23 with high efficiency. Accordingly, it is possible to highly efficiently suppress a decrease in ink ejection speed and a change in color concentration of the ink. Further, the supply opening 17*a* and the collection opening 17*b* are formed at a plurality of positions in the first direction in which the ejection opening row 14 extends to correspond to the plurality of pressure chamber 23.

In this way, when the supply opening 17*a* and the collection opening 17*b* are separately formed at a plurality of positions, it is possible to dispose an electric wire for driving the print element 15 between the adjacent supply openings 17*a* and the adjacent collection openings 17*b*. For that reason, since there is no need to dispose a wire extending in the first direction between the supply opening 17*a* and the ejection opening 13 and between the collection opening 17*b* and the ejection opening 13, a gap therebetween can be further decreased in size. A relation in number between the supply opening 17*a* and the ejection opening 13 may be one to one, one to two, or one to five. Here, the number of the pressure chambers 23 communicating with the supply openings 17*a* is not limited to a relation of one to one with respect to the number of the supply openings 17*a* and the ejection openings 13 of this example.

In this example, a passage is formed as below in order to generate the ink circulation flow through the pressure chamber 23 and the ejection opening 13. The liquid supply path 18 extends in the first direction to communicate with the plurality of supply openings 17*a* and communicates with the pressure chamber 23 through each supply opening 17*a*. Similarly, the liquid collection path 19 extends in the first direction to communicate with the plurality of collection openings 17*b* and communicates with the pressure chamber 23 through each collection opening 17*b*.

It is desirable that the second passage layer 222 and the first passage layer 221 provided with the liquid supply path 18 and the liquid collection path 19 be members formed of the same material. In this example, the first passage layer 221 and the second passage layer 222 are formed at the substrate 11 formed as a silicon (Si) substrate. Further, the substrate 11 which is formed as the silicon substrate and is provided with the first passage layer 221 and the second substrate 115 which is formed as the same silicon substrate and is provided with the second passage layer 222 are laminated and bonded to each other and the second passage layer 222 is provided with the liquid supply path 18 and the liquid collection path 19.

It is more desirable to bond the substrate 11 and the second substrate 115 to each other without an adhesive. For example, surfactant bonding or fusion bonding may be used for the bonding. This is because an influence of a protrusion of the adhesive is reduced in a case where the substrate 11 and the second substrate 115 are bonded to each other so that the highly dense ejection openings correspond to the highly dense ink passages. Thus, the substrate 11 and the second substrate 115 which are formed of silicon are integrated with each other by surfactant bonding or fusion bonding and the supply opening 17*a*, the collection opening 17*b*, the liquid supply path 18, and the liquid collection path 19 are formed inside the integrated member.

In this way, the first passage layer 221 and the second passage layer 222 are provided with a series of ink passages which respectively correspond to the ejection opening rows 14 and are formed by the supply opening 17*a*, the collection opening 17*b*, the liquid supply path 18, and the liquid collection path 19. Thus, it is possible to generate the ink circulation flow inside the pressure chamber 23 of the first passage layer 221 and the ejection opening 13 of the ejection opening forming member 12 through such ink passages.

Further, as illustrated in FIGS. 28 and 29, side walls forming the supply opening 17*a*, the collection opening 17*b*, the liquid supply path 18, and the liquid collection path 19 are substantially orthogonal to the front and rear faces (in the drawing, the upper and lower faces) of the first passage layer 221. Here, the substantial orthogonal state includes an inclination of a taper shape which is formed by processing the first passage layer 221 and the second passage layer 222. The supply opening 17*a*, the collection opening 17*b*, the liquid supply path 18, and the liquid collection path 19 are formed by, for example, dry etching.

Further, these members may be formed by laser processing or a combination of dry etching and laser processing. The depth directions (the vertical directions of FIG. 28) of the supply opening 17*a*, the collection opening 17*b*, the liquid supply path 18, and the liquid collection path 19 are substantially perpendicular to a front face of the first passage layer 221. Accordingly, since the ink passages are efficiently and densely formed, it is possible to highly efficiently generate the ink circulation flow inside the ejection opening 13 and the pressure chamber 23 densely formed at the first passage layer 221.

(Lid Member Manufacturing Method and Lid Member Shape)

Figure 30:
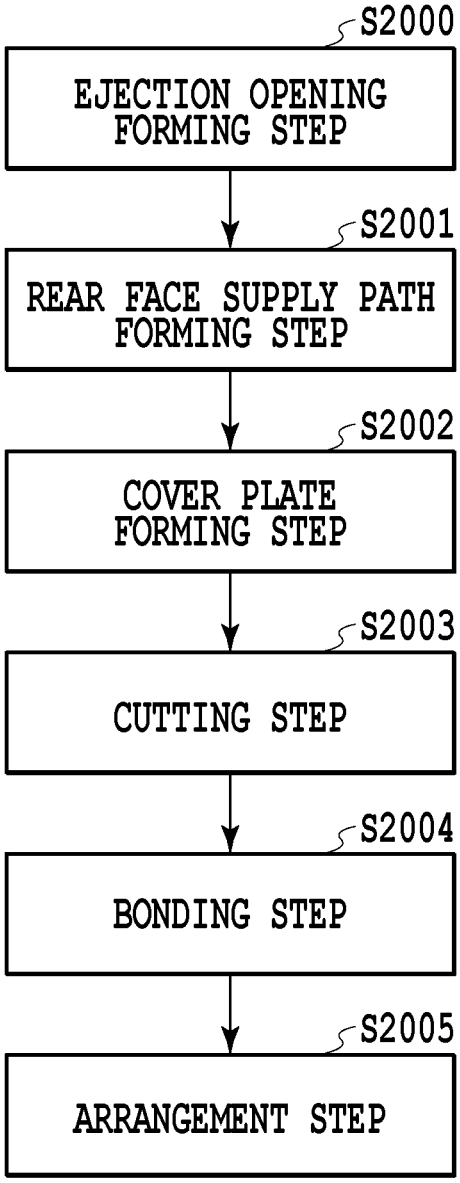
FIG. 30 is a flowchart illustrating an example of a process of manufacturing the liquid ejection head.

FIG. 30 is a flowchart illustrating an example of a process of manufacturing the liquid ejection head of the embodiment. In an ejection opening forming step 2000, an ejection opening is formed on the print element board 10 provided with the print element 15 or a necessary circuit. In a rear face supply path forming step 2001, a rear face of the print element board 10 is provided with the liquid supply path 18 and the liquid collection path 19. Further, in a lid member forming step 2002, a rear face of the print element board 10 is provided with the lid member (the third passage layer 223) covering a rear face supply path. In the invention, the liquid supply path 18 and the liquid collection path 19 are formed at a rear face side of the Si substrate formed in a wafer shape and the lid member 20 (223) is provided at the rear face of the Si substrate having a wafer shape. In this state, the plurality of openings 21 (2133, 2143) which are smaller than the liquid supply path 18 and the liquid collection path 19 are formed by patterning. Subsequently, in a cutting step 2003, an outer shape of the print element board 10 is processed from a wafer shape into a chip shape.

Furthermore, in a bonding step 2004, the print element board 10 is bonded to the support member 30 or the first passage member 50. In an arrangement step 2005, the bonded members are disposed at a predetermined position to manufacture the liquid ejection head. In the description above, a method of manufacturing the liquid ejection head including the supply path supplying the liquid to the pressure chamber has been described. However, the present invention can be also applied to the liquid ejection head that includes the liquid collection path 19 collecting the liquid from the pressure chamber illustrated in FIG. 29. The print element board including the liquid supply path 18 and the liquid collection path 19 are provided at the rear face of the print element board and a film-shaped lid member is provided at the rear face of the print element board to cover the liquid supply path 18 and the liquid collection path 19 formed at the rear face of the print element board. Subsequently, the lid member is provided with the plurality of liquid supply openings 2133 which communicate with the liquid supply path 18 and are smaller than the liquid supply path and the plurality of liquid collection openings 2143 which communicate with the liquid collection path 19 and are smaller than the liquid collection path. Next, the plurality of print element boards including the lid member are cut from a wafer and the print element boards are bonded to the support member so that the liquid ejection head having the plurality of print element boards arranged therein is manufactured.

In this way, in the present invention, the liquid supply path 18 and the liquid collection path 19 are first formed in a wafer shape and the lid member 20 is provided to cover the liquid supply path 18 and the liquid collection path 19. Next, the liquid supply opening 2133 communicating with the liquid supply path 18 and the liquid collection opening 2143 communicating with the liquid collection path 19 are provided. Accordingly, it is possible to form the liquid supply path 18 or the liquid collection path 19 with higher density and to form the opening (the liquid supply opening 2133, the liquid collection opening 2143) having a small opening dimension with high accuracy. Hereinafter, a method of manufacturing the print element board will be described in detail.

Figure 31A:
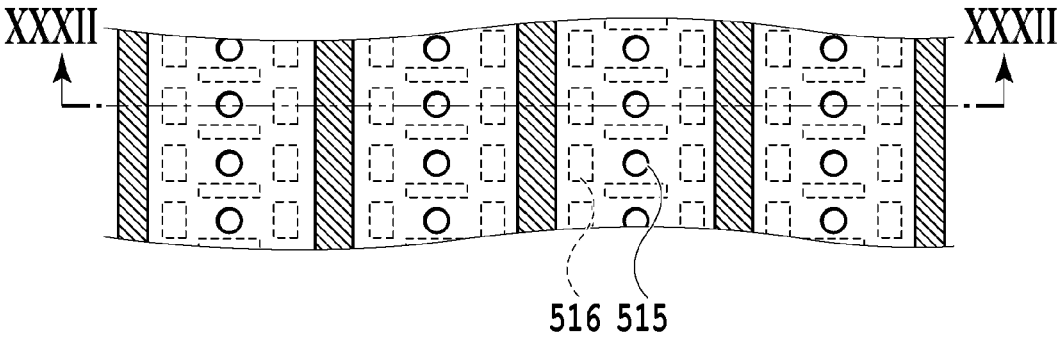
FIG. 31A is a diagram illustrating a print element board.
Figure 31B:
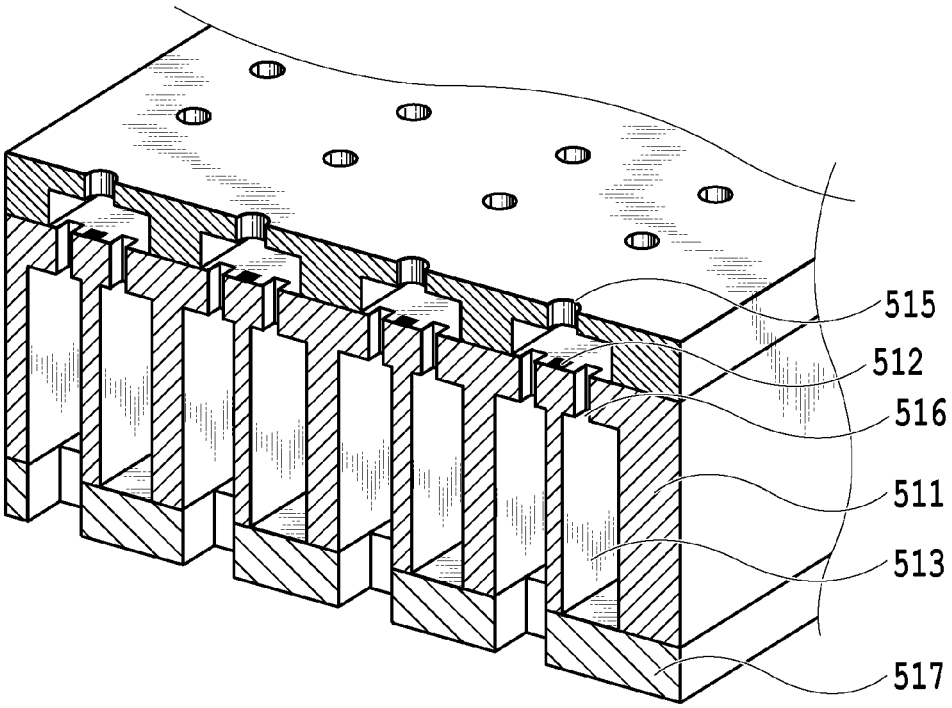
FIG. 31B is a diagram illustrating the print element board.

FIGS. 31A and 31B are diagrams illustrating a print element board provided with a lid member 517 and FIG. 32A to FIG. 32F and FIG. 33A to FIG. 33E are cross-sectional views taken along a line XXXII-XXXII of FIG. 31A. Additionally, a method of manufacturing the print element board will be described below. However, in order to distinguish the members of a finished product in the manufacturing process, the reference numerals of the members of the finished product and the reference numerals of the members in the manufacturing process will be separately described. FIG. 32A to FIG. 32F illustrate a part of the print element board. However, a plurality of print element boards are formed at the same time on a wafer and are cut into small pieces of print element boards. In this way, individual print element boards are manufactured. First, a pattern 521 which forms a passage is formed on a front face of a silicon substrate 511 provided with a print element or a necessary circuit by the use of a positive photosensitive resin. First, a photosensitive resin is provided on the substrate 511 by spin coating, spray coating, or film laminating and is patterned by photolithography to form an ink passage. In this way, a passage member can be formed.

Figure 32A:
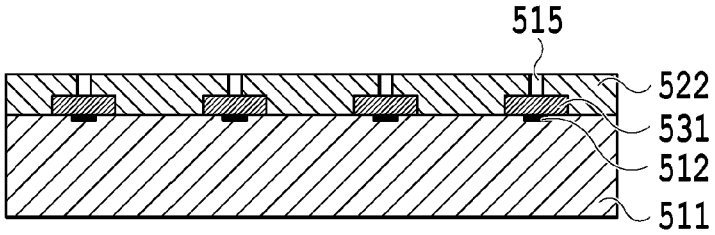
FIG. 32A is a cross-sectional view taken along a line XXXII-XXXII of FIG. 31A.

As the positive photosensitive resin, for example, a high molecular main chain degradation photosensitive resin mainly including polymethylisopropenylketone or methacrylic acid ester is used. The positive photosensitive resin layer can be formed in a desired pattern while being exposed to an exposure wavelength suitable for a material. Next, an ejection opening forming member 522 is formed at a front face of the substrate 511 by the use of a negative photosensitive resin layer (FIG. 32A). As the negative photosensitive resin, a negative photosensitive resin using a radical polymerization reaction or a negative photosensitive resin using a cation polymerization reaction is exemplified.

Further, one kind of the negative photosensitive resin may be used solely or two kinds or more thereof may be used in a mixed state. Further, an additive or the like can be appropriately added if necessary. Further, as the negative photosensitive resin, "SU-8 series" and "KMPR-1000" (product name) manufactured by Nippon Kayaku Co., Ltd. and "TMMR S2000" and "TMMF S2000" (product name) manufactured by Tokyo Ohka Kogyo Co., Ltd. can be used.

Further, a method of coating a negative photosensitive resin composition onto a pattern of a passage is not particularly limited. For example, spin coating, laminating, spray coating, or the like can be appropriately selected and the ejection opening is formed by photolithography.

Additionally, a plurality of negative photosensitive resin layers may be formed by the negative photosensitive resin and the ejection opening forming member 522 may be formed by photolithography other than the ejection opening forming step.

Figure 32B:
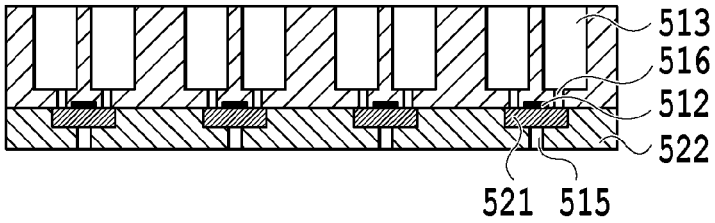
FIG. 32B is a cross-sectional view taken along a line XXXII-XXXII of FIG. 31A.
Figure 32C:
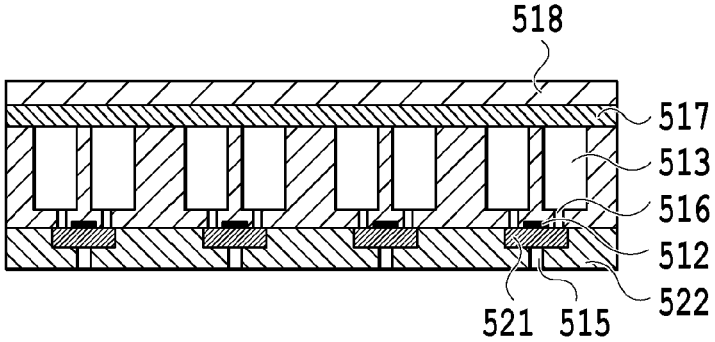
FIG. 32C is a cross-sectional view taken along a line XXXII-XXXII of FIG. 31A.

Next, the common liquid chamber 513 (corresponding to the liquid supply path 18 and the liquid collection path 19) and the ink supply opening 516 for supplying the ink are formed at the rear face by the use of photolithography and Si depth etching (FIG. 32B). Subsequently, a resin film to be used as a lid member is provided at a face provided with the common liquid chamber 513 of the substrate 511. In a case where the lid member 517 is bonded by an adhesive, the adhesive protrudes to the common liquid chamber 513 so that a bad influence on a substantial passage shape occurs. Accordingly, it is desirable to perform a bonding operation without an adhesive.

Figure 32D:
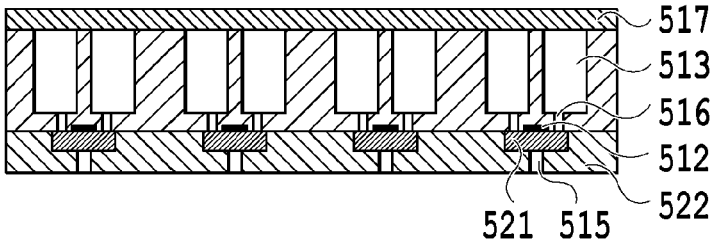
FIG. 32D is a cross-sectional view taken along a line XXXII-XXXII of FIG. 31A.
Figure 32E:
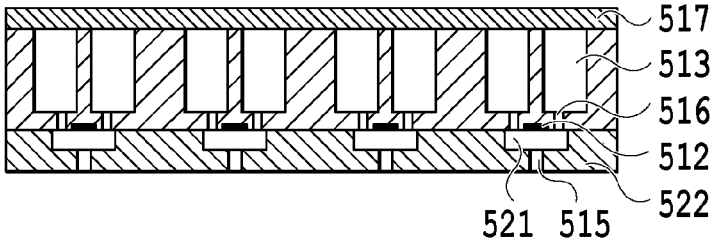
FIG. 32E is a cross-sectional view taken along a line XXXII-XXXII of FIG. 31A.
Figure 32F:
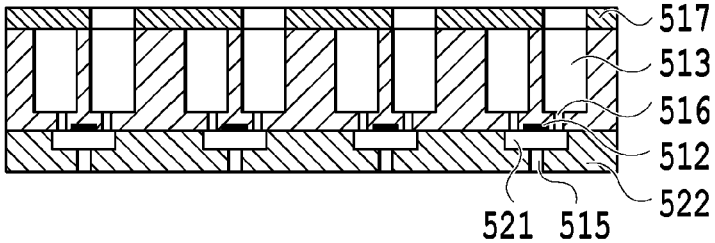
FIG. 32F is a cross-sectional view taken along a line XXXII-XXXII of FIG. 31A.

In a case where the lid member 517 is formed by a non-photosensitive thermosetting resin, a non-photosensitive resin is coated onto a base film 518 serving as a base (FIG. 32C) and the base film 518 is peeled (FIG. 32D). Subsequently, the pattern 521 of the passage is removed after curing (FIG. 32E) and an opening (corresponding to the supply opening 2133 and the collection opening 2143) is formed by laser processing (FIG. 32F).

Next, a method of forming the lid member by photolithography will be described with reference to FIG. 33A to FIG. 33F.

Figure 33A:
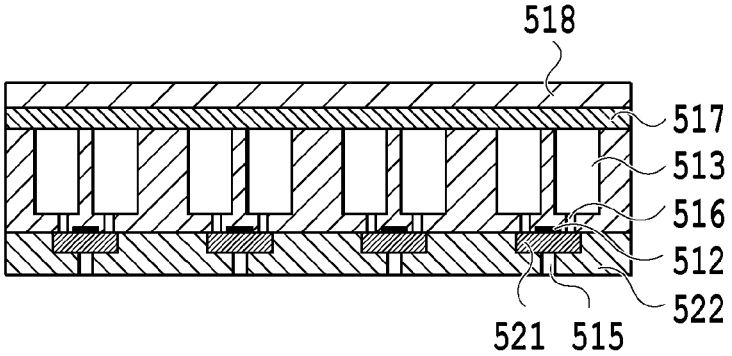
FIG. 33A is a cross-sectional view taken along a line XXXII-XXXII of FIG. 31A.

The lid member 517 can be formed by photolithography or the like. Accordingly, it is possible to avoid a damage of a substrate caused by an ablation in laser processing or to attain higher positional accuracy. A method of forming the common liquid chamber 513 and the ink supply opening 516 at the rear face is similar to that of FIG. 32B. Next, a lamination structure of the base film 518 and the photosensitive resin layer is transferred onto a face of the substrate 511 provided with the common liquid chamber 513 by the use of a lamination device (FIG. 33A). As a material of the photosensitive resin layer, a negative photosensitive resin using a radical polymerization reaction or a negative photosensitive resin using a cation polymerization reaction is exemplified. The negative photosensitive resin using a radical polymerization reaction is cured by polymerizing or cross-linking of molecules of radically polymerized monomer or prepolymer included in the photosensitive resin composition by the use of radicals generated from a photopolymerization initiator included in a photosensitive resin composition thereof.

As the photopolymerization initiator, for example, benzoins, benzophenones, thioxanthones, anthraquinones, acylphosphine oxides, titanocenes, acridines, or the like can be exemplified. As the radically polymerized monomer, monomer or prepolymer having an acryloyl group, a methacryloyl group, an acrylamide group, maleic diester, and an allyl group is desirable, but the present invention is not limited thereto. The negative photosensitive resin using a cation polymerization reaction is cured by polymerizing or cross-linking of molecules of cationically polymerized monomer or prepolymer included in the photosensitive resin by the use of cation generated from a photocationic initiator included in the photosensitive resin.

As the photocationic initiator, for example, aromatic iodonium salts or aromatic sulfonium salts can be exemplified. As the cationically polymerized monomer or prepolymer, monomer or prepolymer having an epoxy group, a vinyl ether group, or an oxetane group is desirable, but the present invention is not limited thereto. Further, one kind of the negative photosensitive resin may be used solely or two kinds or more thereof may be used in a mixed state. Further, an additive or the like can be appropriately added if necessary.

Further, as the negative photosensitive resin, "SU-8 series" and "KMPR-1000" (product name) manufactured by Nippon Kayaku Co., Ltd. and "TMMR S2000" and "TMMF S2000" (product name) manufactured by Tokyo Ohka Kogyo Co., Ltd. can be used. Further, a method of forming the negative photosensitive resin on the base film 518 is not particularly limited, and spin coating, slit die coating, or spray coating can be appropriately selected. Further, as a film thickness of the lid member 517, a thickness of 2 to 50 μm is desirable regardless of the dimension of the opening and the flow amount or the viscosity of the supplied ink. In a case where the film thickness of the lid member 517 is smaller than 2 μm the common liquid chamber 513 cannot be sufficiently coated and the ink easily leaks during the supply of the ink. Further, the lid member 517 is easily damaged by the ink supply pressure.

Figure 33B:
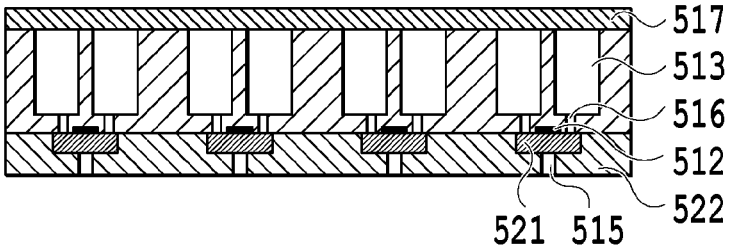
FIG. 33B is a cross-sectional view taken along a line XXXII-XXXII of FIG. 31A.
Figure 33C:
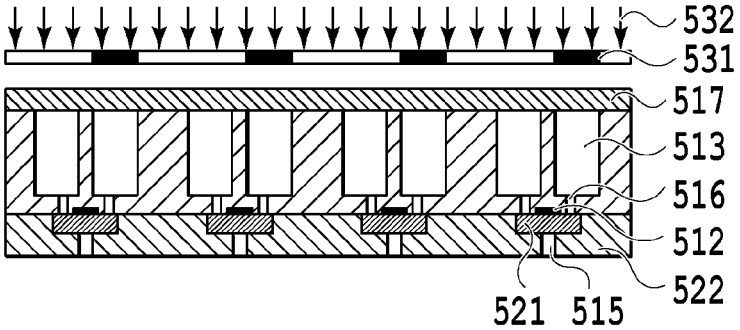
FIG. 33C is a cross-sectional view taken along a line XXXII-XXXII of FIG. 31A.
Figure 33D:
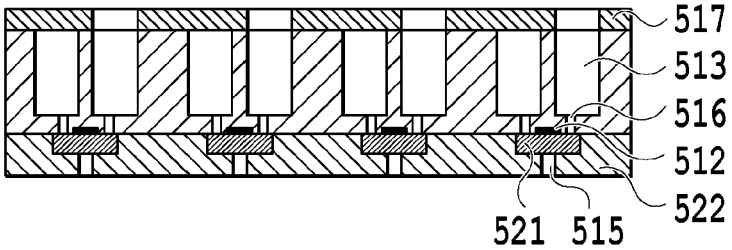
FIG. 33D is a cross-sectional view taken along a line XXXII-XXXII of FIG. 31A.
Figure 33E:
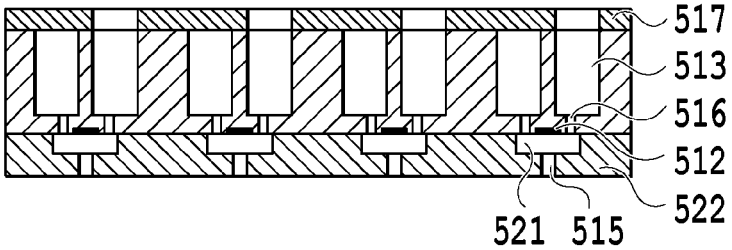
FIG. 33E is a cross-sectional view taken along a line XXXII-XXXII of FIG. 31A.

As the base film 518, for example, PET, polyimide, a fluorine film, or a hydrocarbon film is used. Next, the base film 518 is peeled (FIG. 33B) and an exposure light is irradiated through a mask 532 (FIG. 33C). Next, a lid member is formed by post-baking or developing (FIG. 33B). In order to keep the unevenness of the lid member 517, the resin is exposed and post-baked in a state where the negative photosensitive resin is supported by the base film 518 and the base film 518 is peeled and developed. Next, a curing step is performed after the pattern 521 of the passage is removed. Accordingly, a wafer-shaped print element board is manufactured (FIG. 33E). Further, a step of removing the pattern 521 of the passage may be performed before the lid member 517 is formed.

Further, since the liquid supply opening 2133 and the liquid collection opening 2143 can be processed in the lid member 517 by lithography, it is possible to improve the shape accuracy and the arrangement accuracy of each of the liquid supply path 18 and the liquid collection path 19. When a resin film having a film thickness of 50 μm or less is used, shape accuracy of ±5 μm or less and arrangement accuracy of ±5 μm or less can be obtained. Further, in a case where the film thickness is smaller than 25 μm, satisfactory shape accuracy can be obtained.

Although not illustrated in FIG. 32A to FIG. 32F and FIG. 33A to FIG. 33E, the opening formed at the lid member 517 is provided at a plurality of positions of the liquid supply path 18 and the liquid collection path 19 as illustrated in FIG. 11C.

Since the shape accuracy is improved by machining or molding when the lid member 517 is processed in the wafer step, a further microscopic hole can be formed with higher accuracy and thus the lid member 517 can be formed to be thinner. Further, the liquid supply path 18 and the liquid collection path 19 are formed on the face of the substrate, the lid member is provided at the face of the substrate, and then the lid member is provided with the plurality of openings 21 (2133, 2143). Accordingly, it is possible to form the microscopic opening 21 (2133, 2143) at the liquid supply path 18 and the liquid collection path 19 with high accuracy. When the photosensitive film serving as the lid member is coated on the wafer-shaped Si substrate and the opening is formed at the lid member by photolithography, the accuracy can be further improved.

In this way, when the lid member 517 is formed at the wafer-shaped element board and the shape accuracy of each of the liquid supply opening 2133 and the liquid collection opening 2143 is improved, it is possible to reduce a change in passage resistance between the liquid supply opening 2133 and the liquid collection opening 2143. Further, since the shape accuracy and the arrangement accuracy are improved, the liquid supply opening 2133 and the liquid collection opening 2143 can be further accurately arranged at a small size. Accordingly, it is possible to dispose the passage at the liquid supply path or the liquid collection path 19 disposed at higher density.

That is, it is possible to form the passage at the ejection opening rows 14 which are arranged at higher density. Particularly, as in the embodiment, since there is a need to dispose the liquid supply path 18 and the liquid collection path 19 at each of the ejection opening rows 14 in the liquid ejection head 3 generating the ink circulation flow, the paths are disposed at higher arrangement and thus an effect of the invention is large. Regarding the liquid supply path 18 and the liquid collection path 19 which are formed along the ejection opening row, the liquid supply path 18 or the liquid collection path 19 can be disposed with higher density and the plurality of openings each having a small opening dimension can be formed with high accuracy.

Figure 34A:
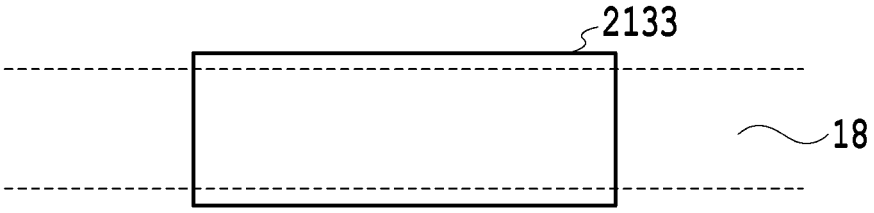
FIG. 34A is a diagram illustrating an arrangement relation between a liquid supply opening and a liquid supply path.
Figure 34B:
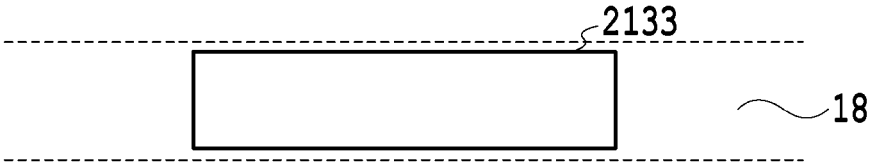
FIG. 34B is a diagram illustrating an arrangement relation between the liquid supply opening and the liquid supply path.
Figure 34C:
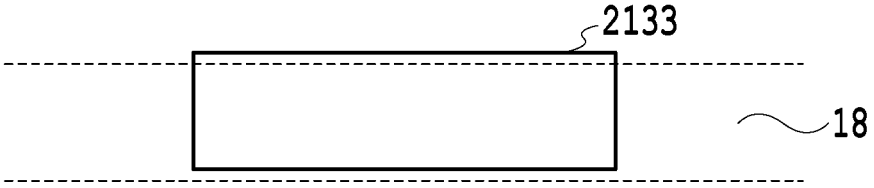
FIG. 34C is a diagram illustrating an arrangement relation between the liquid supply opening and the liquid supply path.

FIGS. 34A to 34C are schematic diagrams illustrating the liquid ejection head in which the lid member 20 is applied to the print element board 10 when viewed from the lid member 20 and illustrating an arrangement relation between the liquid supply opening 2133 formed at the lid member 20 and the liquid supply path 18 formed at the print element board 10. FIG. 34A illustrates an example in which the width of the liquid supply opening 2133 is larger than the width of the liquid supply path 18. In the case of the shape accuracy or ±5 μm or less and the arrangement accuracy of ±5 μm or less, the width of the liquid supply opening 2133 is set to be larger than the width of the liquid supply path 18 at both sides by 10 μm. Accordingly, a positional relation illustrated in FIG. 34A does not change even when the accuracy changes. When a factor causing a change in accuracy is taken into consideration, the width of the liquid supply opening 2133 may be set to be larger than the width of the liquid supply path 18 at both sides by 15 μm.

Since a positional relation does not change in this way, it is possible to reduce a change in passage resistance from the liquid supply opening 2133 to the liquid supply path 18. Similarly, as illustrated in FIG. 34B, the width of the liquid supply opening 2133 may be set to be smaller than the width of the liquid supply path 18 at both sides by 15 μm. Further, as illustrated in FIG. 34C, the width at one side may be increased by 15 μm and the width at the opposite side may be decreased by 15 μm. In this way, even when the width of each of the liquid supply path 18 and the liquid supply opening 213 is set to be within 30 μm, it is possible to reduce a change in passage resistance.

For example, in the case of the relation of FIG. 34A, an arrangement relation does not change even when a beam width between the liquid supply passage 18 and the liquid collection passage 19 decreases to 65 μm even in a case where a bonded face between the lid member 20 and the print element board 10 needs to be at least 50 μm. Further, in the case of the relation of FIG. 34B, an arrangement relation does not change even when the width of the liquid supply passage 18 decreases to 180 μm even in a case where the width of the liquid supply opening needs to be 150 μm.

Figure 35A:
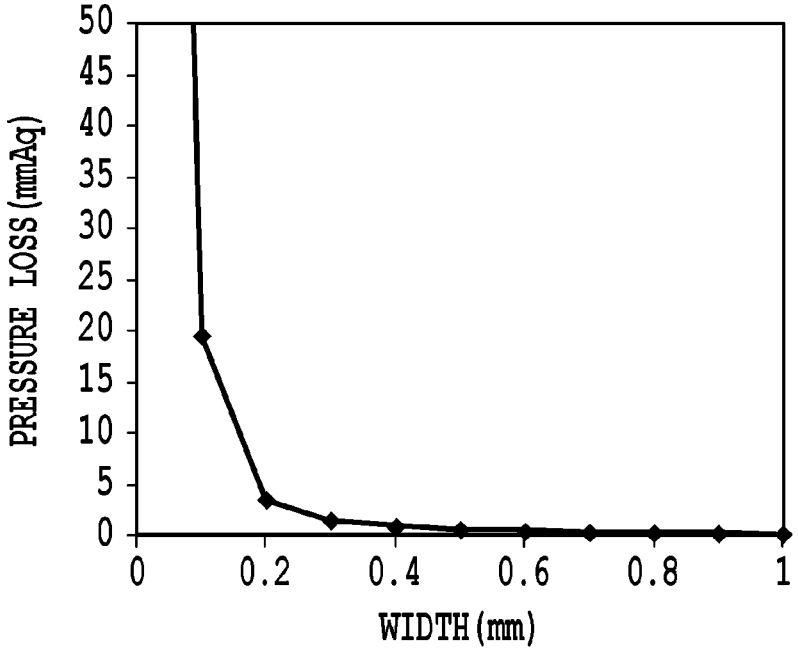
FIG. 35A is a graph illustrating a relation between pressure loss and a width of the supply opening.

FIG. 35A is a graph illustrating a relation between the width of the liquid supply opening and the pressure loss of the supply passage 18. Hereinafter, an effect of the invention will be described. As illustrated in FIG. 35A, when the width of the liquid supply opening decreases, an influence on the pressure loss increases when the width changes. Particularly when the width is 200 μm or less, the pressure loss increases. That is, when the ejection opening rows are disposed with high density and the size of the liquid supply opening decreases, an influence on the shape accuracy of the liquid supply opening with respect to a change in passage resistance increases. In this way, the invention is particularly effective in the liquid ejection head in which the ejection openings are densely arranged. Accordingly, since it is possible to reduce a change in passage resistance, that is, a change in pressure loss generated in the supply passage during the ejection operation, it is possible to reduce a change in pressure of the ejection opening meniscus interface. As a result, since it is possible to eject a liquid droplet having a uniform size, it is possible to form a high-quality image with higher accuracy.

Further, in the liquid ejection head 3 generating the ink circulation flow as in the embodiment, since a change in passage resistance is reduced, it is possible to stabilize a differential pressure generating the ink circulation flow and to reduce a change in ink circulation amount.

Figure 35B:
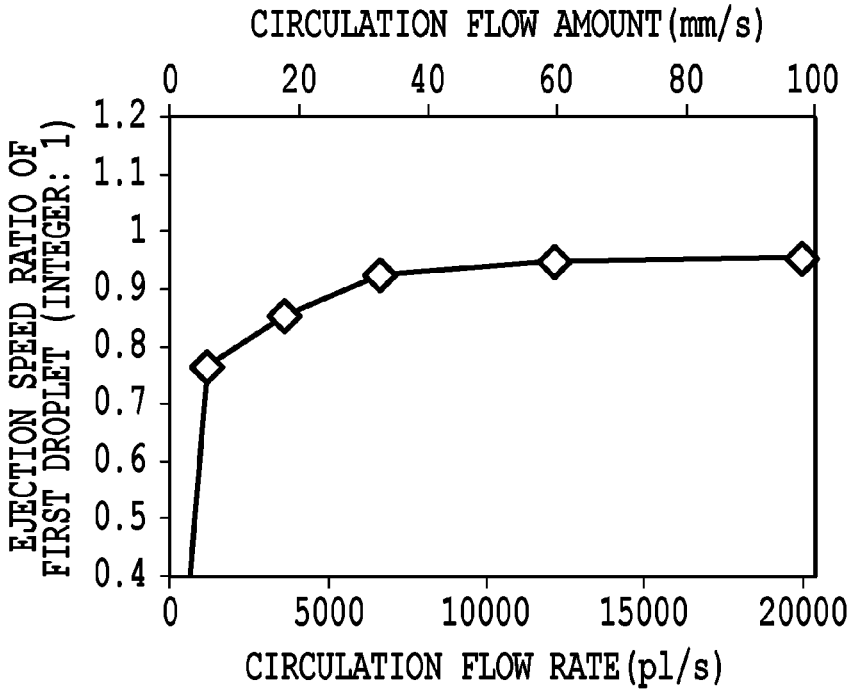
FIG. 35B is a graph illustrating a relation between a change in circulation flow amount and an ejection speed ratio of a first droplet.

FIG. 35B is a graph illustrating an example of an influence of a change in ink circulation amount and illustrating an example of a relation between the ink circulation flow amount at the lower portion (the pressure chamber) of each ejection opening and the ejection speed of the first liquid droplet after a predetermined time of a temporary stop at each ink circulation flow amount. When the circulation flow amount is equal to or larger than about 7000 pl/s, the first liquid droplet can be ejected at an ejection speed of 90% of the normal ejection speed and the ejection speed of the first liquid droplet becomes smaller than 90% at the flow amount equal to or smaller than 7000 pl/s. In this way, when the ejection speed decreases, a deviation in landing position occurs and thus the image quality is deteriorated.

Further, in order to increase the circulation flow amount, there is a need to increase a pressure difference between the first liquid tank 1011 and the second liquid tank 1012 of FIG. 24C or ensure a large flow amount by a pump or the like. Accordingly, since a large ink supply system is needed, the pressure of the ejection opening portion is not easily controlled. Thus, the circulation flow amount may decrease to a degree in which the ejection speed does not decreases too much and the circulation flow amount can easily decrease to a degree in which the ejection speed does not decrease in the liquid ejection head 3 in which a change in circulation flow amount is small.

In this way, in the invention, since it is possible to reduce a change in passage resistance even in the liquid ejection head in which the ejection openings are arranged with high density, it is possible to stabilize a differential pressure causing the ink circulation flow and thus to reduce a change in circulation flow amount. As a result, since it is possible to obtain uniform ejection characteristics regardless of the temporary stop of each ejection opening and the length thereof, it is possible to form a high-quality image with higher accuracy.

(Outer Shape Relation Between Element Board and Lid Member)

Figure 36A:
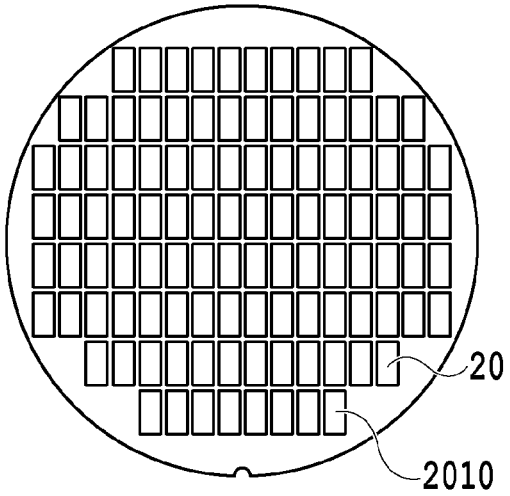
FIG. 36A is a diagram illustrating a relation in outer shape between an element board and a lid member.
Figure 36B:
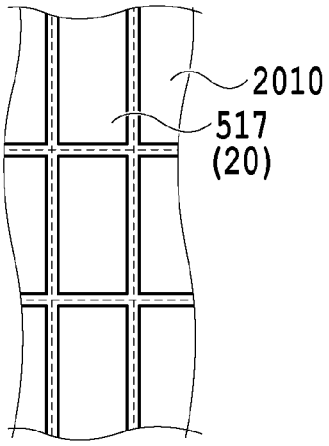
FIG. 36B is a diagram illustrating a relation in outer shape between the element board and the lid member.
Figure 36C:
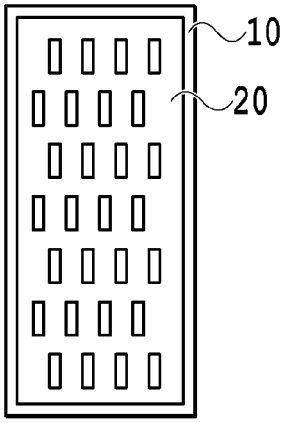
FIG. 36C is a diagram illustrating a relation in outer shape between the element board and the lid member.

FIGS. 36A to 36C are diagrams illustrating a relation in outer shape between an element board 2010 and the lid member 517 (20) and FIG. 36A illustrates a state where the lid member 517 is formed on the wafer-shaped element board 2010. The liquid supply opening 2133 and the liquid collection opening 2143 are not illustrated in the drawings. Finally, the lid member 517 is divided by the unit of one print element board 10. FIG. 36B is a partially enlarged view of FIG. 36A.

When the wafer-shaped element board 2010 is divided, the element board may be divided in an area without the lid member 517. Since the element board is divided in an area without the lid member 517, it is possible to suppress deterioration in shape of the lid member 517 and a separation thereof when the print element board 2010 is divided. That is, since an outer shape size of the lid member is set to be smaller than an outer shape size of the print element board which will be cut and divided, it is possible to manufacture the lid member on the wafer-shaped element board and to suppress a deterioration in shape of the lid member 517 and a separation thereof when the wafer-shaped element board is cut.

For example, various etchings or dicings are used to divide the element board 2010. When the element board is divided by etching, an area without the lid member 517 needs to be divided. Further, when the lid member 517 exists in a divided area in a case where the element board is divided by blade-dicing, deterioration in shape of the lid member 517 or a separation thereof and a deterioration of the blade occur. Further, when the element board is divided by blade-dicing, there is a need to divide an area without the lid member 517 as in the etching.

FIG. 36C illustrates one divided print element board 10 and the lid member 20. As illustrated in FIGS. 36A and 36B, when the print element board 2010 is divided at an area without the lid member 20, a relation between the outer shape of the print element board 10 and the outer shape of the lid member 20 may be set such that the lid member 20 enters the outer shape of the print element board 10 as illustrated in FIG. 36C.

In this way, in the embodiment, since the outer shape of the lid member enters the outer shape of the print element board, it is possible to cut the wafer-shaped print element board after the lid member is formed at the wafer-shaped print element board and thus to suppress a deterioration in shape of the lid member or a separation thereof. That is, in a case where the lid member is formed at the wafer-shaped print element board, the outer shape of the lid member needs to be essentially smaller than the outer shape of the print element board. In addition, it is possible to suppress the outer shape of the lid member from partially entering the outer shape of the print element board without causing a protrusion of one outer shape from the other outer shape.

(Structure (1) of Suppressing Change in Ink Circulation Flow Amount and Pressure)

Furthermore, in the embodiment, a following structure is provided in order to suppress a change in ink circulation flow amount and a change in pressure of each pressure chamber 23. That is, as illustrated in FIGS. 25 and 26, the plurality of liquid supply openings 2133 communicate with one liquid supply path 18. Similarly, the plurality of liquid collection openings 2143 communicate with one liquid collection path 19. The liquid supply opening 2133 and the liquid collection opening 2143 are disposed so that a change in ink circulation flow amount and a change in pressure of each pressure chamber 23 fall into a range in which the ink ejection characteristics are not largely influenced.

Specifically, the liquid supply opening 2133 and the liquid collection opening 2143 are alternately arranged in the first direction in which the ejection opening 13 is arranged in the ejection opening row 14. Accordingly, it is possible to further decrease a gap between the liquid supply opening 2133 and the liquid collection opening 2143 in the first direction. Thus, even in a case where the passage width of each of the liquid supply path 18 and the liquid collection path 19 is relatively small, it is possible to suppress a change in ink circulation flow amount and a change in pressure of each pressure chamber 23.

(Structure (2) of Suppressing Change in Ink Circulation Flow Amount and Pressure)

Furthermore, in the embodiment, a following structure is provided in order to suppress a change in ink circulation flow amount and a change in pressure of each pressure chamber 23. That is, as illustrated in FIGS. 25 and 26, the common supply path 2134 extends in the second direction intersecting the arrangement direction of the ejection opening 13 and communicates with the plurality of liquid supply openings 2133 arranged in the second direction.

Similarly, the common collection path 2144 extends in the second direction and communicates with the plurality of liquid collection openings 2143 arranged in the second direction. Further, the plurality of common supply paths 2134 integrally communicate with one common supply passage 211 through the individual supply opening 2135. Similarly, the plurality of common collection paths 2144 integrally communicate with one common collection passage 212 through the individual collection opening 2145.

In this way, since the ink passage is formed by a six-layer structure, a plurality of the liquid supply paths 18 which are formed at a narrow pitch to match the plurality of ejection opening rows 14 which are densely arranged are finally integrated to one common supply passage 211 through the plurality of liquid supply openings 2133. Similarly, a plurality of the liquid collection paths 19 which are formed at a narrow pitch to match the plurality of ejection opening rows 14 which are densely arranged are finally integrated to one common collection passage 212 through the plurality of liquid collection openings 2143. Thus, it is possible to highly densely arrange the plurality of ejection opening rows 14 without widening the passage widths of the liquid supply path 18 and the liquid collection path 19.

Further, it is possible to suppress a change in ink circulation flow amount and a change in pressure of each of the pressure chambers 23 respectively corresponding to the ejection openings 13 of the plurality of ejection opening rows 14 which are arranged with high density in this way. Further, it is possible to simply supply the ink from the ink tank (not illustrated) and to simply collect the ink to the ink tank while suppressing a change in ink circulation flow amount and a change in pressure of each pressure chamber 23 in the ejection openings 13 which are highly densely arranged. Accordingly, the invention is not limited to the liquid ejection head and the printing apparatus including the same. Thus, the invention can be also applied to various liquid ejection heads and the liquid ejection apparatuses including the same in order to realize a compact size of the entire system.

(Structure (3) of Suppressing Change in Ink Circulation Flow Amount and Pressure)

Further, it is desirable to have a following structure in order to suppress a change in ink circulation flow amount and a change in pressure of each pressure chamber 23. That is, the liquid supply openings 2133 and/or the liquid collection openings 2143 located at both ends of the ejection opening row 14 are formed to be smaller than the liquid supply openings 2133 and/or the liquid collection openings 2143 located at positions other than both ends. That is, the openings of the liquid supply openings 2133 and/or the liquid collection openings 2143 located at both ends of the ejection opening row 14 are formed to be smaller than the openings of the liquid supply openings 2133 and/or the liquid collection openings 2143 located at positions other than both ends of the ejection opening row 14. The ejection opening 13 of the ejection opening row 14 is located only at one side of the liquid supply openings 2133 located at both ends of the ejection opening row 14.

For that reason, the ink flow amount at the liquid supply openings 2133 located at both ends of the ejection opening row 14 becomes smaller than the ink flow amount of the other liquid supply openings 2133. Similarly, the ejection opening 13 of the ejection opening row 14 is located only at one side of the liquid collection openings 2143 located at both ends of the ejection opening row 14. For that reason, the ink flow amount of the liquid collection openings 2143 located at both ends of the ejection opening row 14 becomes smaller than the ink flow amount of the other liquid collection openings 2143.

In this way, the liquid supply openings 2133 and/or the liquid collection openings 2143 located at both ends of the ejection opening row 14 have small shapes so that the passage resistances thereof increase. Accordingly, the pressure loss generated at the liquid supply opening 2133 and/or the liquid collection opening 2143 can be substantially equal to the pressure loss generated at the other liquid supply opening 2133 and/or the other liquid collection opening 2143. Thus, it is possible to decrease a difference between the ink flow amount of the ink flowing inside the pressure chamber 23 through the liquid supply openings 2133 and/or the liquid collection openings 2143 at both ends and the ink flow amount of the ink flowing inside the pressure chamber 23 through the other liquid supply openings 2133 and/or the other liquid collection openings 2143. As a result, it is possible to further suppress a change in ink circulation flow amount of each pressure chamber 23.

(Structure (4) of Suppressing Change in Ink Circulation Flow Amount and Pressure)

Figure 37A:
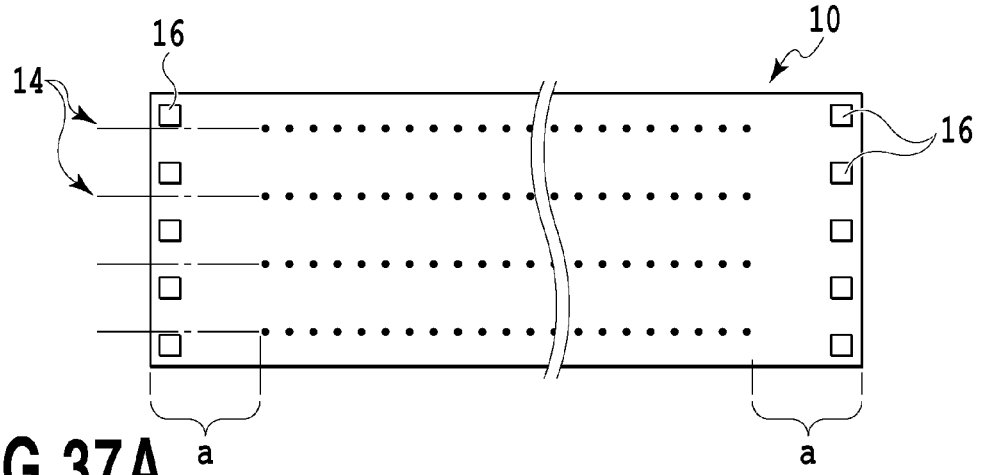
FIG. 37A is a diagram illustrating positions of a print element board, a liquid supply opening, and a liquid collection opening.

FIG. 37A to FIG. 37D are a diagram illustrating a position of the print element board 10 and positions of the liquid supply opening and the liquid collection opening of the print element board 10. It is desirable that the print element board 10 have a following structure in order to suppress a change in ink circulation flow amount and a change in pressure of each pressure chamber 23. That is, as illustrated in FIG. 37A, an area a between the end of the ejection opening row 14 and the end of the print element board 10 is set to be large.

Figure 37B:
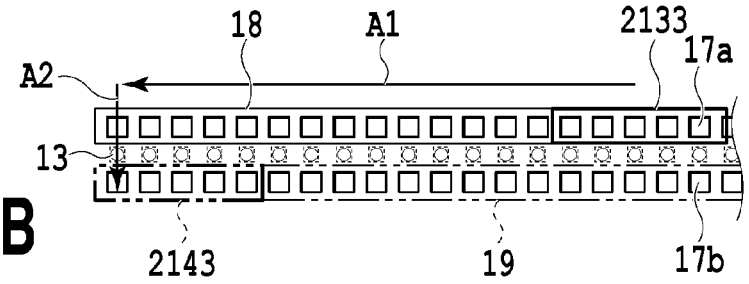
FIG. 37B is a diagram illustrating positions of a print element board, a liquid supply opening, and a liquid collection opening.
Figure 37C:
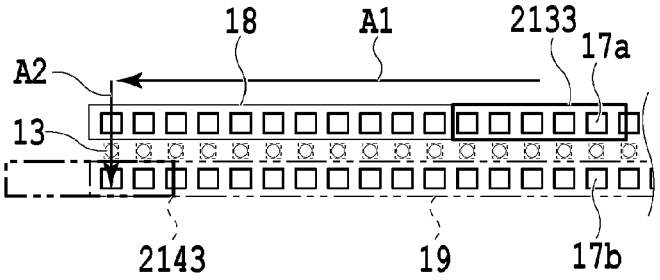
FIG. 37C is a diagram illustrating positions of a print element board, a liquid supply opening, and a liquid collection opening.

The area a can be used as, for example, an arrangement space of a pad terminal 16 transmitting and receiving an electric signal to and from the print element board 10 and a driving circuit of the print element 15. Further, it is desirable to dispose the liquid collection opening 2133 by using such an area a as illustrated in the perspective views of FIG. 37B and FIG. 37C. That is, the liquid collection opening 2133 is disposed to overlap the ejection opening 13 located at the end of the ejection opening row 14 in the first direction in which the ejection opening row 14 extends. In FIG. 37B and FIG. 37C, the left end of the liquid collection path 19 and the left end of the liquid collection opening 2143 are located at the same position. Further, in FIG. 37C, the left ends of the liquid collection path 19 and the liquid collection opening 2143 are largely swollen in the left direction in relation to the collection opening 17*b* located at the left end.

In FIG. 37B and FIG. 37C, the ink passing through the pressure chamber 23 located at the end of the ejection opening row 14 first flows from the liquid supply opening 2133 into the liquid supply path 18 and the supply opening 17*a* as indicated by the arrow A1. Subsequently, the ink passes through the pressure chamber 23, the collection opening 17*b*, and the liquid collection path 19 located at the end of the ejection opening row 14 and flows out from the liquid collection opening 2143 as indicated by the arrow A2.

Figure 37D:
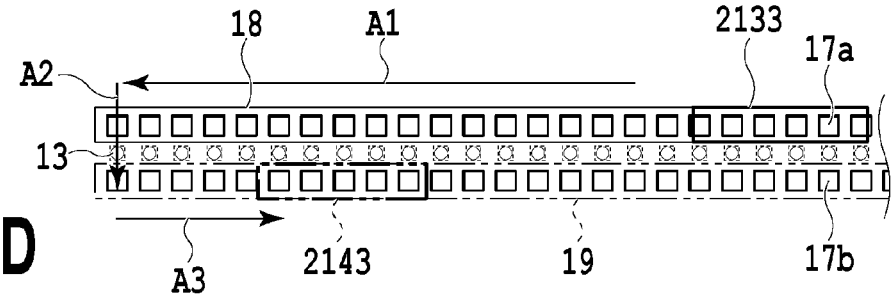
FIG. 37D is a diagram illustrating positions of a print element board, a liquid supply opening, and a liquid collection opening.

FIG. 37D is a comparative example illustrating a case where the liquid collection opening 2143 is disposed so as not to overlap the ejection opening 13 located at the end of the ejection opening row 14 in the first direction. In FIG. 37D, the ink passing through the pressure chamber 23 located at the end of the ejection opening row 14 first flows from the liquid supply opening 2133 into the liquid supply path 18 and the supply opening 17*a* as indicated by the arrow A1. Subsequently, the ink passes through the pressure chamber 23 and the collection opening 17*b* located at the end of the ejection opening row 14 as indicated by the arrow A2. Then, the ink passes through the liquid collection path 19 and flows out from the liquid collection opening 2143 as indicated by the arrow A3.

In FIG. 37B and FIG. 37C, it is possible to shorten the length of the ink passage from the liquid supply opening 2133 located at the end of the first direction to the liquid collection opening 2143 through the pressure chamber 23 compared to the configuration of FIG. 37D. That is, since the maximal pressure loss generated inside the liquid supply path 18 and the liquid collection path 19 located in the vicinity of the end of the ejection opening row 14 decreases, it is possible to suppress a change in ink circulation flow amount inside each pressure chamber 23. Additionally, in a case where the liquid supply opening 2133 is located at the end in the first direction instead of the liquid collection opening 2143, the liquid supply opening 2133 may be disposed to overlap the ejection opening 13 located at the end of the ejection opening row 14 in the first direction.

(Temperature Distribution Suppressing Structure)

In the embodiment, a following structure is provided in order to suppress a temperature distribution inside the liquid ejection head 3. That is, as illustrated in FIGS. 25 and 26, the liquid collection opening 2143 is disposed at both ends of the ejection opening row 14. As in this example, in a case where the ink is forcedly circulated through each pressure chamber 23, heat emitted from the print element 15 or the like is generally collected by the ink. Accordingly, the temperature of the ink inside the ink outflow side passage becomes higher than that of each pressure chamber 23.

Further, even when the ink circulation flow amount which is sufficient to suppress an influence caused by the evaporation of moisture in the ink in the ejection opening 13 is ensured, there is a case where the amount of the ink ejected from the plurality of ejection openings 13 at the same time becomes larger than the ink circulation flow amount. In such a case, the ink is also supplied from the common collection passage 212 into the pressure chamber 23. That is, the ink is supplied from the common collection passage 212, passes through the individual collection opening 2145, the common collection path 2144, the liquid collection opening 2143, the liquid collection path 19, and the collection opening 17*b*, and is supplied into the pressure chamber 23. For that reason, there is a case where the high-temperature ink inside the liquid collection opening 2143 is supplied into the pressure chamber 23 when the ink is ejected from the plurality of ejection openings 13 at the same time.

In such a case, the temperature of the ink in the vicinity of the liquid collection opening 2143 becomes higher than the temperature in the vicinity of the liquid supply opening 2133. Accordingly, there is concern that a difference in ink ejection speed may occur between the ejection opening 13 in the vicinity of the liquid supply opening 2133 and the ejection opening 13 in the vicinity of the liquid collection opening 2143. Further, in a case where the liquid supply opening 2133 is located at one end of both ends of the ejection opening row 14 and the liquid collection opening 2143 is located at the other end thereof, a thermal distribution in the arrangement direction of the entire ejection opening row 14 is inclined and thus a thermal distribution width in the entire liquid ejection head becomes large. As a result, there is concern that the ink ejection characteristics may change in each ejection opening 13.

In the embodiment, since the liquid collection opening 2143 is disposed at both ends of the ejection opening row 14, it is possible to suppress a change in ink ejection characteristic by suppressing an inclination in thermal distribution. Additionally, the same effect is obtained even in a case where the liquid supply opening 2133 is disposed at both ends of the ejection opening row 14. However, as in the embodiment, it is desirable to dispose the liquid collection openings 2143 at both ends of the ejection opening row 14.

That is, as described above, in the print element board 10, the area a which is not used to dispose the ejection opening 13 therein is set to be large between the end of the print element board 10 and each of both ends of the ejection opening row 14 and thus the heat generated during the ink ejection operation is radiated from the area a. For that reason, there is a tendency that the temperatures at both ends of the ejection opening row 14 become lower than those of the other portions in a case where the ink is ejected from the plurality of ejection openings 13. Since the liquid collection opening 2143 is disposed at both ends of the ejection opening row 14, it is possible to supply the high-temperature ink to both ends of the ejection opening row 14 in such a case.

Thus, since the temperatures at both ends of the ejection opening row 14 are set to be high, a temperature difference with respect to the other portions can be decreased. As a result, since the thermal distribution width in the entire liquid ejection head decreases, it is possible to suppress a change in ink ejection characteristic.

In this way, the lid member is formed on the wafer-shaped element board and the element board is cut into a chip of the print element board. Accordingly, it is possible to realize the liquid ejection head capable of suppressing a change in pressure of the pressure chamber, the liquid ejection apparatus, and the manufacturing method.

(Second Embodiment)

Hereinafter, a second embodiment of the invention will be described with reference to the drawings. Additionally, since a basic configuration of the embodiment is similar to the first embodiment, only characteristic configurations will be described below.

Figure 38:
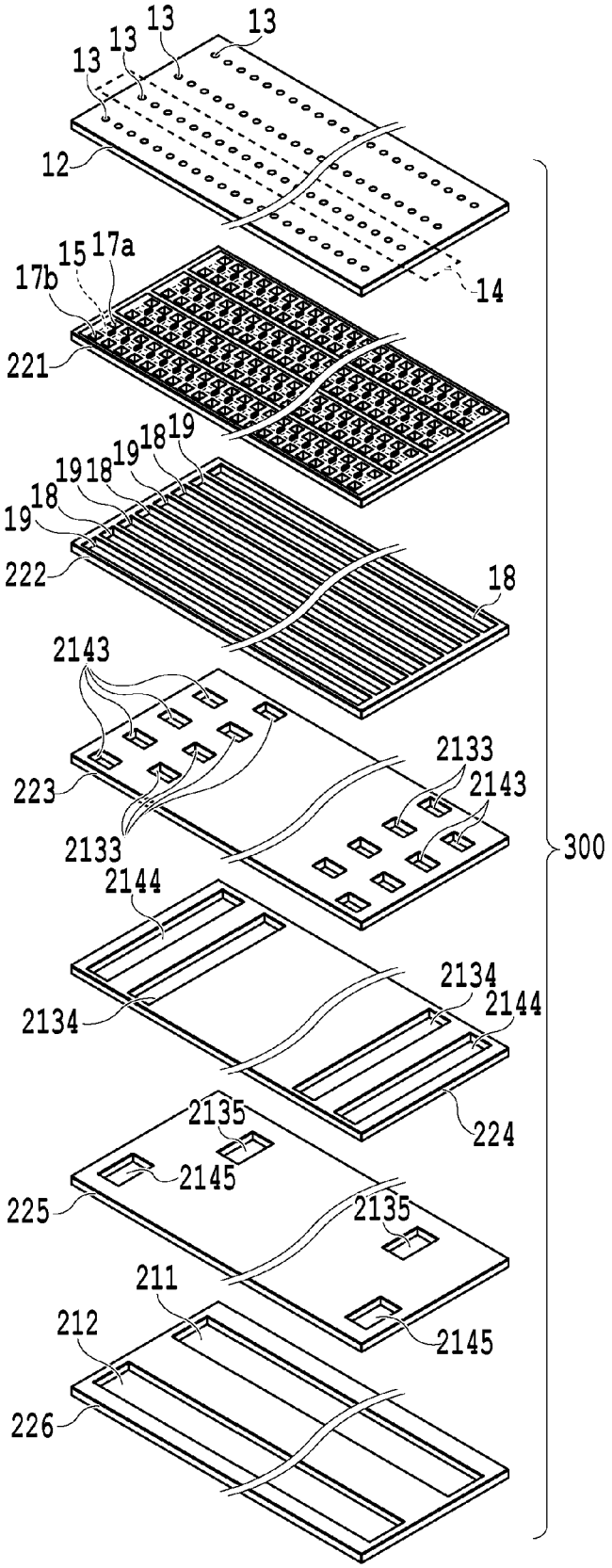
FIG. 38 is a diagram illustrating the liquid ejection unit.
Figure 39:
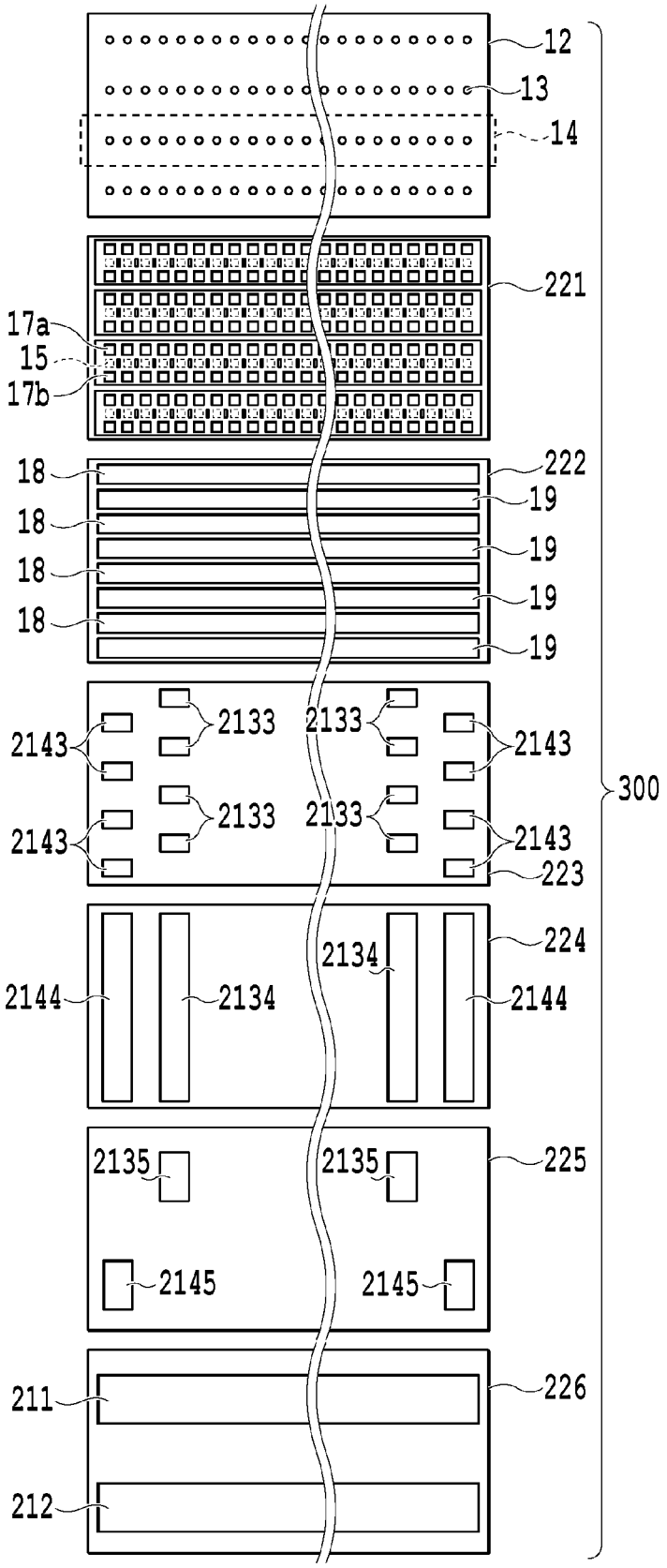
FIG. 39 is a diagram illustrating the liquid ejection unit.

FIGS. 38 and 39 are diagrams illustrating the liquid ejection unit 300 of the embodiment. Here, the same reference numerals will be given to the same components as those of the above-described embodiment and a description thereof will be omitted. FIG. 38 is an exploded perspective view of the liquid ejection unit 300 and FIG. 39 is an exploded top view of the liquid ejection unit 300. In the embodiment, the liquid supply path 18 and the liquid supply opening 2133 communicate with each other and the liquid collection path 19 and the liquid collection opening 2143 communicate with each other at one end position of the ejection opening row 14. Similarly, the liquid supply path 18 and the liquid supply opening 2133 communicate with each other and the liquid collection path 19 and the liquid collection opening 2143 communicate with each other even at the other end position of the ejection opening row 14.

Since the liquid supply opening 2133 and the liquid collection opening 2143 are disposed at both ends of the ejection opening row 14, it is possible to suppress a change in ink circulation flow amount and a change in pressure inside each pressure chamber 23 in the first direction in which the ejection opening row 14 extends compared to a first application example. Further, each of the common supply path 2134 and the common collection path 2144 may be disposed at two positions.

In this way, in the embodiment, it is possible to simplify the ink passage structure by decreasing the number of the liquid supply openings and the liquid collection openings.

(Third Embodiment)

Hereinafter, a third embodiment of the invention will be described with reference to the drawings. Additionally, since a basic configuration of the embodiment is similar to the first embodiment, only characteristic configurations will be described below.

Figure 40:
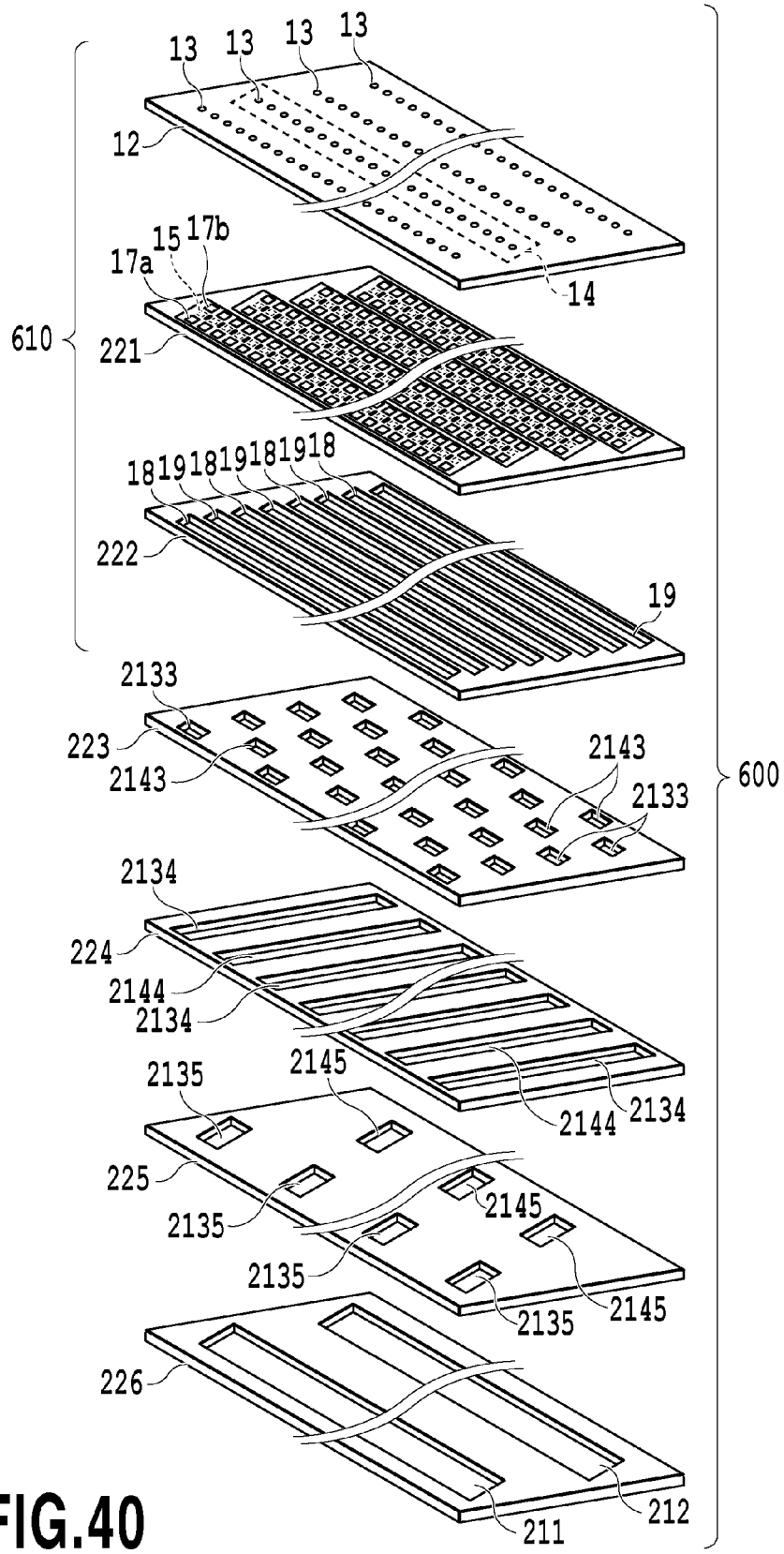
FIG. 40 is a diagram illustrating the liquid ejection unit.
Figure 41:
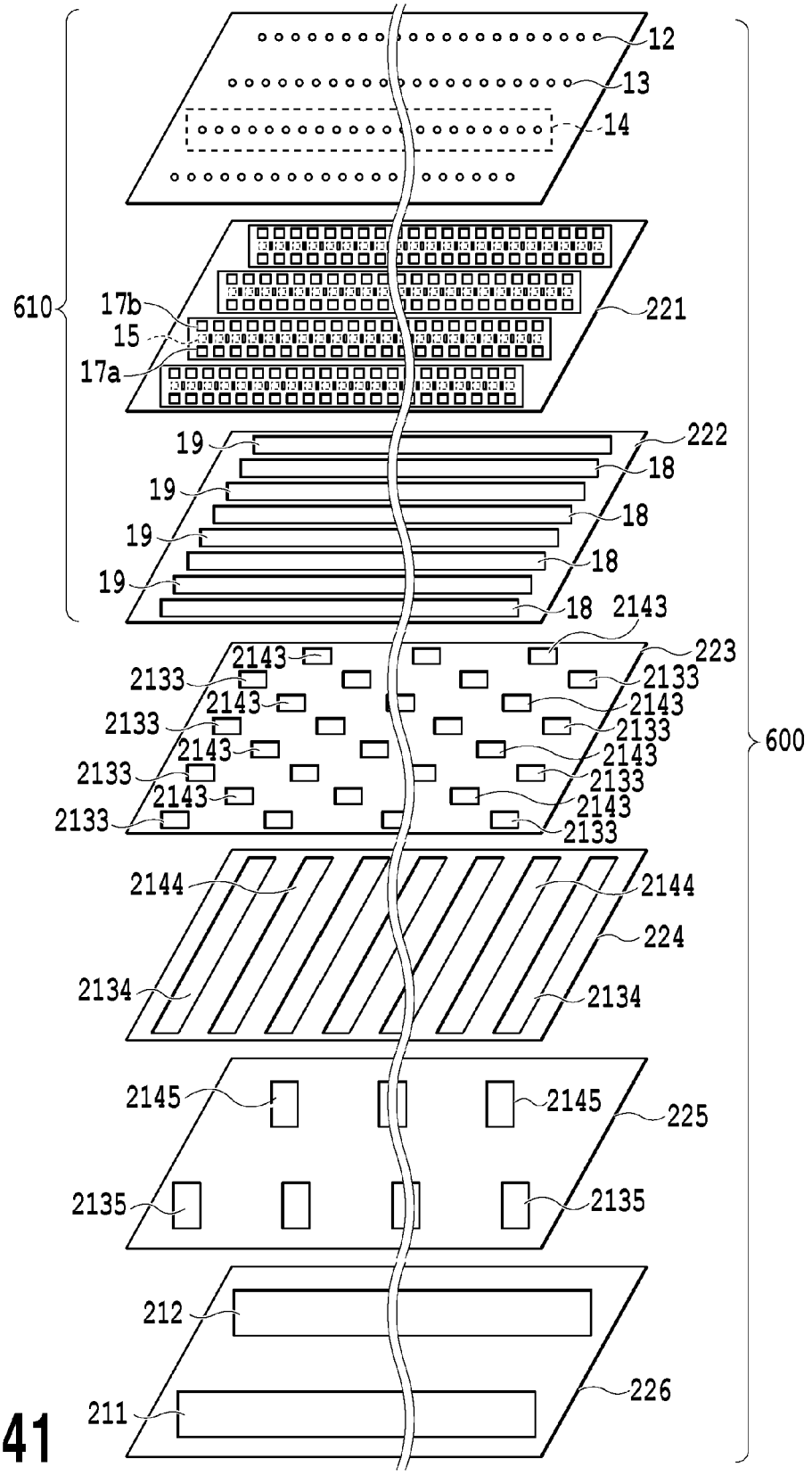
FIG. 41 is a diagram illustrating the liquid ejection unit.
Figure 42A:
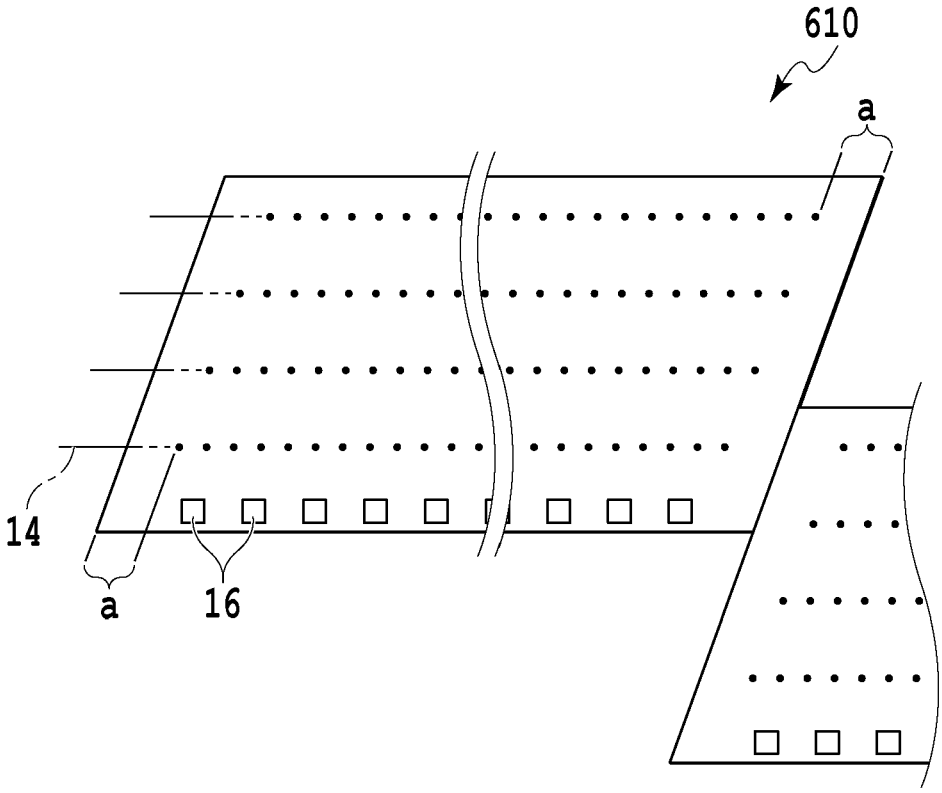
FIG. 42A is a diagram illustrating the liquid ejection unit.
Figure 42B:
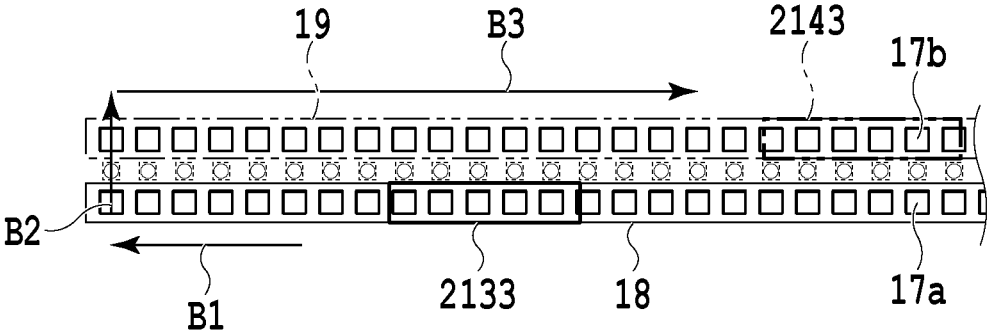
FIG. 42B is a diagram illustrating positions of a liquid supply opening and a liquid collection opening.

FIG. 40 to FIGS. 42A and 42B are diagrams illustrating a liquid ejection unit 600 of the embodiment. Here, the same reference numerals will be given to the same components as those of the above-described embodiment and a description thereof will be omitted. FIG. 40 is an exploded perspective view of the liquid ejection unit 600 and FIG. 41 is an exploded top view of the liquid ejection unit 600. FIG. 42A is a top view of a print element board 610 of the embodiment and FIG. 42B is a perspective view illustrating a structure of the end of the ejection opening row 14.

The print element board 610 of the embodiment is formed such that an outer shape thereof is formed in a parallelogram shape. Then, the area a between the end of the ejection opening row 14 and the end of the element board is small compared to the print element board 10 of FIG. 37A of the first application example (see FIG. 42A). In the embodiment, a driving circuit of the print element 15 and a connection pad 16 transmitting and receiving an electric signal between the print element board 610 and the outside are disposed at the long side of the print element board 610 as illustrated in FIG. 42A.

Additionally, the outer shape is not limited to the parallelogram shape, but may be a rectangular shape. In a case where an elongated liquid ejection head (a line head) is formed by the combination of the print element boards 610, the print element boards 10 are disposed in a substantial one row shape as illustrated in FIGS. 23D and 23E or FIG. 42A instead of a zigzag shape.

That is, the adjacent element boards are arranged so that all ends of the liquid ejection head in the longitudinal direction and the width direction partially overlap one another. With such an arrangement, the ends of the ejection opening rows 14 of the adjacent print element boards 10 can easily overlap each other in the second direction corresponding to the vertical direction of FIG. 42A.

Here, the "substantial one-row-shaped arrangement" indicates a state where the adjacent print element boards 610 are disposed to overlap each other in both the first direction in which the ejection opening 13 extends in the ejection opening row 14 and the second direction intersecting the first direction as illustrated in FIG. 42A.

In this way, in the embodiment, the ejection opening 13 is disposed to the vicinity of the end of the print element board 610. In such a structure, it is difficult to dispose the liquid supply opening 2133 or the liquid collection opening 2143 at a position overlapping the end of the ejection opening row 14 of the print element board 610 as illustrated in FIG. 37B and FIG. 37C of the first application example. Thus, in the embodiment, the liquid supply opening 2133 or the liquid collection opening 2143 is disposed at a position deviated to the center in relation to the end of the ejection opening row 14 as illustrated in FIG. 42B.

In the embodiment, the liquid supply opening 2133 is disposed in the vicinity of both ends of the ejection opening row 14 as illustrated in FIGS. 40 and 41 in order to suppress a change in ink circulation flow amount and a change in pressure of each pressure chamber 23 and to suppress a temperature distribution inside the print element board 610.

As in the embodiment, in a case where the liquid supply opening 2133 is disposed in the vicinity of the end of the ejection opening row 14, the differential pressure between the liquid supply path 18 and the liquid collection path 19 located at the end of the ejection opening row 14 is large during the ink ejection operation compared to the initial differential pressure during the ink circulation operation. Meanwhile, in a case where the liquid collection opening 2133 is disposed at the end of the ejection opening row 14 as in the first application example, the differential pressure between the liquid supply path 18 and the liquid collection path 19 at the end of the ejection opening row 14 is small during the ink ejection operation compared to the initial differential pressure during the ink circulation operation.

When the differential pressure between the liquid supply path 18 and the liquid collection path 19 decreases, the ink circulation flow amount decreases. Accordingly, an effect of suppressing an influence caused by the evaporation of moisture in the ink of the ejection opening 13, that is, a decrease in ink ejection speed and a change in color concentration of the ink decreases. For that reason, the differential pressure may be large. When the liquid supply opening 2133 is disposed at both ends of the ejection opening row 14 as in the embodiment, an influence of a change in ink circulation flow amount can be reduced.

The pressure inside the liquid supply opening 2133 is set to be higher than the pressure inside the liquid collection opening 2143 in order to generate the ink circulation flow. Thus, the ink inside the pressure chamber 23 can be easily supplied through the liquid supply opening 2133 during the ink ejection operation. In this way, since the liquid supply opening 2133 used to easily supply the ink is disposed in the vicinity of the end of the ejection opening row 14, it is possible to decrease the pressure loss generated at the liquid supply path 18 and the liquid collection path 19 when the ink is ejected from the plurality of ejection openings 13 at the same time.

Further, in the embodiment, as described above, since the area a between the end of the ejection opening row 14 and the end of the element board is small, a degree in which the heat generated during the ink ejection operation is radiated from the area a is small. Since the area a is small, as illustrated in FIG. 42B, the length of the liquid supply path 18 from the liquid supply opening 2133 to the end of the ejection opening row 14 increases. Similarly, the length of the liquid collection path 19 from the liquid collection opening 2143 to the end of the ejection opening row 14 increases. Thus, the ink which passes through the liquid supply path 18 and the liquid collection path 19 easily receives heat from the print element board 610.

For that reason, there is a tendency that the temperature of the end of the ejection opening row 14 becomes higher than those of the other portions when the ink is ejected from the plurality of ejection openings 13 at the same time. Further, the pressure loss generated in each ink passage increases during the ink ejection operation and thus the pressure at the end of the ejection opening row 14 becomes uneven.

Further, in the embodiment, as described above, the liquid supply opening 2133 is disposed at both ends of the ejection opening row 14. For that reason, a large amount of the ink is supplied from the adjacent liquid supply opening 2133 to the ejection opening 13 in the vicinity of the end of the ejection opening row 14. As a result, when the ink is ejected from the plurality of ejection openings 13 at the same time, the amount of the high-temperature ink supplied from the liquid supply opening 2133 decreases and thus an increase in temperature of the end of the ejection opening row 14 can be reduced.

Specifically, the ink which is supplied from the liquid supply opening 2133 first flows from the liquid supply path 18 into the supply opening 17*a* as indicated by the arrow B1 of FIG. 42B. Subsequently, the ink passes through the pressure chamber 23 and the collection opening 17*b* located at the end of the ejection opening row 14 as indicated by the arrow B2. Then, the ink passes through the liquid collection path 19 and flows out from the liquid collection opening 2143 as indicated by the arrow A3.

In this way, in the embodiment, since the liquid supply opening 2133 is disposed at both ends of the ejection opening row 14, it is possible to suppress a change in circulation flow amount and a change in pressure of the ink and to decrease a temperature distribution inside the liquid ejection head. Thus, since it is possible to suppress a decrease in ink ejection speed and a change in color concentration of the ink caused by the evaporation of moisture in the ink in the ejection opening 13 and to suppress a change in ink ejection characteristic, it is possible to print a high-quality image with high accuracy.

(Arrangement Configuration of Liquid Supply Opening and Liquid Collection Opening)

Figure 43A:
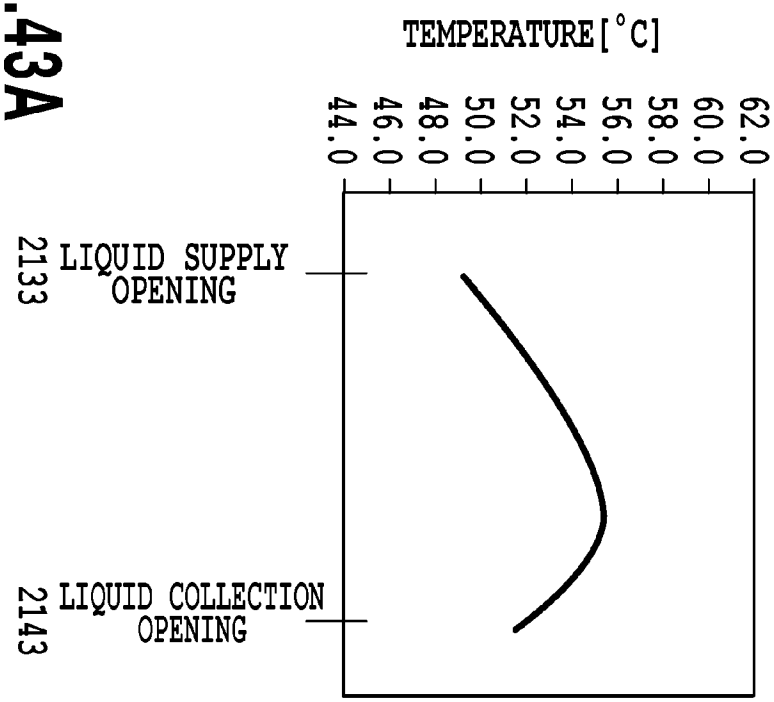
FIG. 43A is a graph illustrating a temperature distribution of the print element board when a liquid is ejected from all ejection opening.
Figure 43B:
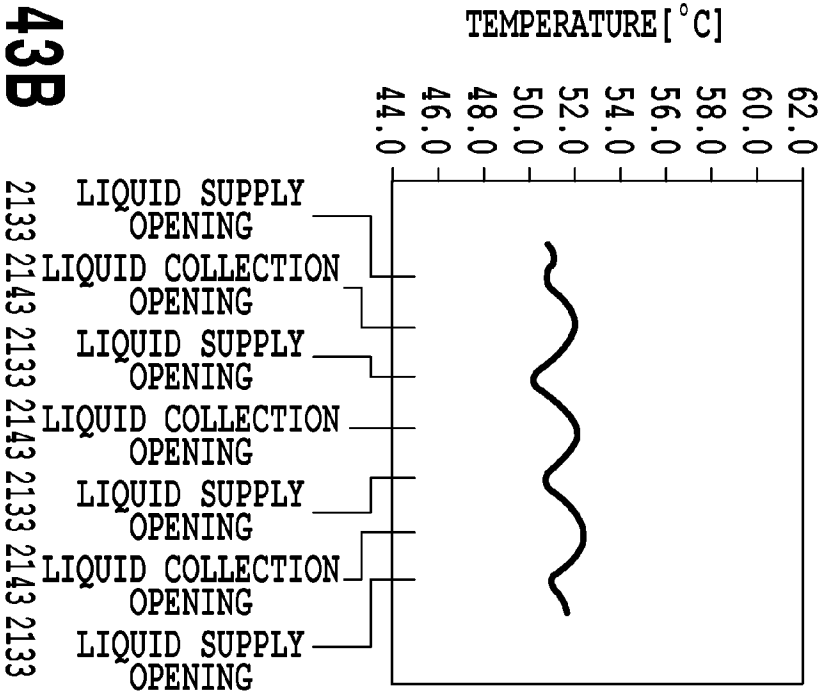
FIG. 43B is a graph illustrating a temperature distribution of the print element board when a liquid is ejected from all ejection openings.

FIG. 43A and FIG. 43B are a graph illustrating a temperature distribution of the print element board 610 when the ink is ejected from all ejection openings. Next, a temperature distribution of the entire print element board 610 of the embodiment will be described. The print element board 610 is controlled at the temperature of 50° C. Since the flow amount at the ejection operation is larger than the flow amount of the ink circulation flow, the direction of the ink flow in the liquid collection opening 2143 is directed toward the ejection opening. Further, there is a tendency that the flow amount of the liquid supply opening 2133 is larger among the liquid supply opening 2133 and the liquid collection opening 2143. FIG. 43A illustrates a temperature distribution in which each of the liquid supply opening 2133 and the liquid collection opening 2143 is disposed in one ejection opening row 14 as a comparative example.

The ink which flows through the liquid supply path 18 or the liquid collection path 19 receives heat from the print element board 610 so that the temperature of the center portion increases. Further, when the temperatures of the liquid supply opening 2133 and the liquid collection opening 2143 are compared with each other, the temperature of the liquid supply opening 2133 is low in that the flow amount of the liquid supply opening 2133 is large. Additionally, even in a case where the ink does not flow reversely in the liquid collection opening 2143, the ink which flows through the print element board 610 and receives heat flows to the liquid collection opening 2143. Accordingly, there is a tendency that the temperature of the liquid supply opening 2133 decreases.

FIG. 43B illustrates a temperature distribution in a case where the liquid supply opening 2133 and the liquid collection opening 2143 are alternately disposed at a plurality of positions in one ejection opening row of the embodiment. Since a distance with respect to the liquid supply opening 2133 and the liquid collection opening 2143 is short, the length of the liquid supply path 18 and the liquid collection path 19 becomes shortened. For this reason, a temperature therebetween does not increase too much. In particular, the temperature becomes equal to the temperature of the liquid collection opening 2143. Further, since the liquid supply opening 2133 and the liquid collection opening 2143 are alternately disposed, the maximal length of the liquid supply path 18 and the liquid collection path 19 becomes shortened and thus the temperature does not increase too much.

In this way, in the embodiment, since the liquid supply opening 2133 and the liquid collection opening 2143 are disposed alternately at a plurality of positions in one ejection opening row, it is possible to reduce a temperature difference inside the print element board 610 compared to FIG. 43A corresponding to the comparative example. Thus, since it is possible to suppress a change in ejection characteristic, it is possible to form a high-quality image with higher accuracy. Further, an effect of the embodiment can be obtained as long as any one of the liquid supply opening 2133 and the liquid collection opening 2143 is provided in at least two positions.

Figure 44A:
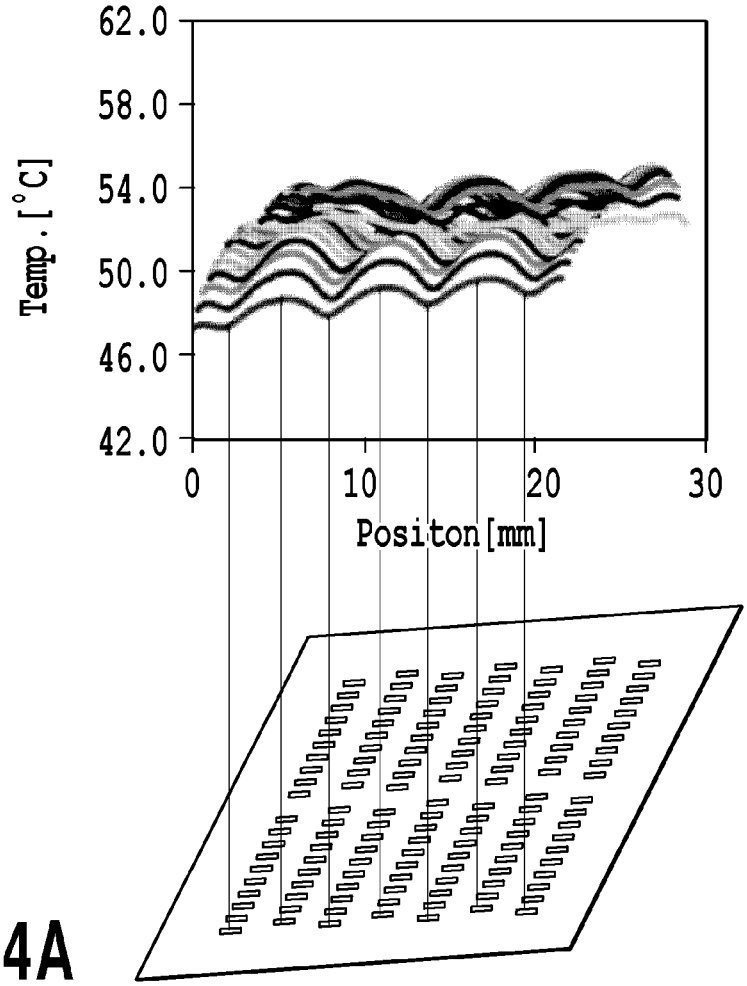
FIG. 44A is a graph illustrating a temperature distribution of the print element board.
Figure 44B:
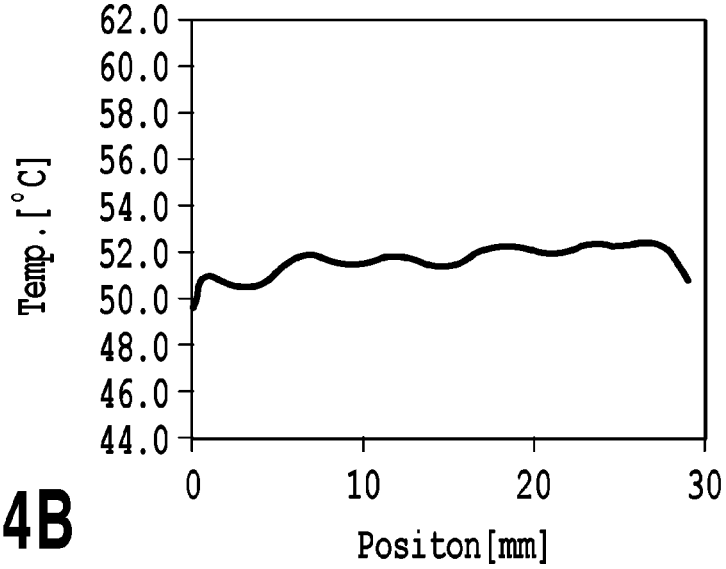
FIG. 44B is a graph illustrating a temperature distribution of the print element board.

FIG. 44A is a graph illustrating a temperature distribution of each ejection opening row 14 in a case where the liquid supply openings 2133 and the liquid collection openings 2143 are deviated in the plurality of ejection opening rows 14 in accordance with the print element board 610 having a parallelogram shape. Although there is a difference among absolute temperature values in each ejection opening row in accordance with the position of the ejection opening row, a high-temperature position and a low-temperature position are different in accordance with a difference between the liquid supply opening 21*a* and the liquid collection opening 21*b*. FIG. 44B is a graph illustrating an average temperature distribution of FIG. 44A in the row direction of the ejection opening row 14.

Since the high-temperature position and the low-temperature position in each ejection opening row are different, a temperature difference inside the print element board 610 becomes smaller than a temperature difference in all ejection opening rows of FIG. 44A in an average state. Thus, when a print material scan direction (a relative scan direction between the liquid ejection head and the print material) is perpendicular to the row direction of the ejection opening row 14, it is possible to obtain an average of an influence of a change in ejection characteristic caused by a temperature difference for the print material.

In this way, since the liquid supply opening 2133 and the liquid collection opening 2143 are disposed to be deviated from each other, it is possible to obtain an average of a temperature difference caused by the arrangement of the liquid supply opening 2133 and the liquid collection opening 2143. Thus, since it is possible to suppress a change in ejection characteristic, it is possible to form a high-quality image with higher accuracy.

(Modified Example of Shapes of Liquid Supply Opening and Liquid Collection Opening)

Figure 45A:
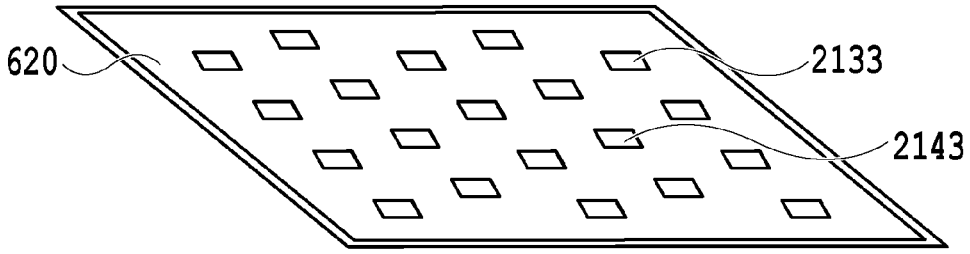
FIG. 45A is a diagram illustrating a modified example of a shape of the liquid supply opening.
Figure 45B:
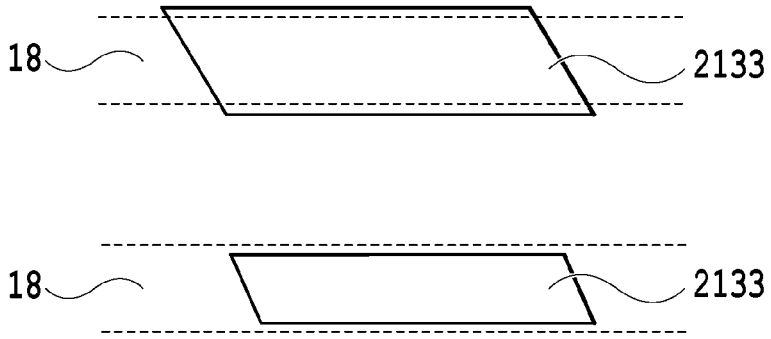
FIG. 45B is a diagram illustrating a modified example of a shape of the liquid supply opening.
Figure 45C:
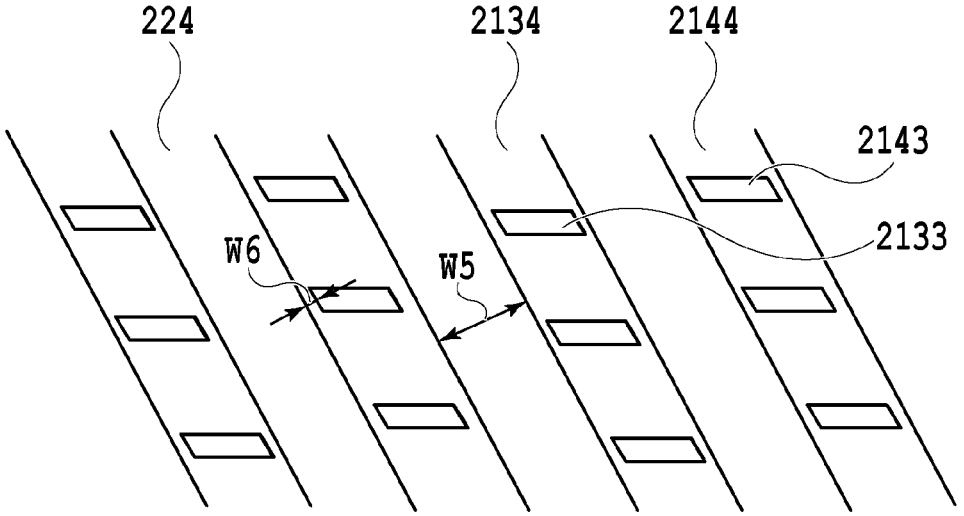
FIG. 45C is a diagram illustrating a modified example of a shape of the liquid supply opening.

FIGS. 45A to 45C are diagrams illustrating a modified example of a shape of the liquid supply opening 2133 or the liquid supply opening 2143. FIG. 45A is a diagram illustrating a lid member 620 and the print element board 610 when viewed from the opposite side to the ejection opening. FIG. 45B is a diagram illustrating a detail of the liquid supply opening 2133 of FIG. 45A in accordance with the liquid supply path 18 on the print element board 10. FIG. 45C is a diagram illustrating a state where the first passage member 50 or the support member 30 including the fourth passage layer 224 is bonded to the lid member 620. As illustrated in FIG. 45B, the liquid supply opening 2133 is formed in a parallelogram shape to match the outer shape of the print element board 610.

In such a parallelogram shape, a width W5 of a bonded face between the lid member 620 and the fourth passage layer 224 of FIG. 45C or a cross-sectional area perpendicular to the liquid flow direction of the liquid supply opening 21*a* can be increased. That is, it is desirable to increase a minimal gap W6 of an outer shape of each of the liquid supply opening 2133 and the common supply path 2134 in consideration of the protrusion of the adhesive used to bond the lid member 620 and the fourth passage layer 224 to each other. Since the liquid supply opening 2133 is formed in a parallelogram shape, it is possible to further increase the cross-sectional area of the liquid supply opening 2133, the width W5, and the gap W6. Since it is possible to process a microscopic or complex shape as in the embodiment by lithography, it is possible to increase the cross-sectional area of the liquid supply opening 2133 or the liquid collection opening 2143 and the bonded face between the lid member 620 and the support member 30 or the first passage member 50.

(Linear Expansion Coefficient of Lid Member)

In the liquid ejection head in which the plurality of print element boards are arranged, since the lid member 620 is separately provided at each print element board, it is possible to suppress deterioration in arrangement accuracy of the print element boards. That is, in the liquid ejection head illustrated in FIG. 23D or 24E, when the lid member integrated in the longitudinal direction is used in the plurality of print element boards as disclosed in the specification of U.S. Pat. No. 7,347,534, the linear expansion coefficient of the lid member is influenced by a change in temperature and thus the arrangement accuracy of the print element board is deteriorated. On the contrary, as in the embodiment, since the lid member 620 is separately provided at each print element board, deterioration in arrangement accuracy of the print element board caused by a change in temperature of the liquid ejection head in the longitudinal direction is largely caused by the linear expansion coefficient of the member supporting the print element board instead of the linear expansion coefficient of the lid member.

In a case where the resin film is used in the lid member 620, the linear expansion coefficient becomes about 30 ppm in general. On the contrary, for example, when alumina is used in the member supporting the plurality of print element boards 610, the linear expansion coefficient becomes about 7 ppm. Then, when a resin material filled by filler reducing the linear expansion coefficient is used, the linear expansion coefficient can be set to about 20 ppm. That is, since the lid member 620 is separately provided at each print element board and the linear expansion coefficient of the member integrally supporting the plurality of print element boards 610 decreases, it is possible to improve the arrangement accuracy of the print element board.

(Gap Portion Between Adjacent Boards)

In the embodiment, since the individual lid member 620 is provided at each print element board, it is possible to reduce a deviation width of the ejection opening row at the joint of the print element boards 610. That is, in a case where the lid member is formed across the adjacent print element boards, there is a case where the adhesive is needed when the print element board is bonded to the lid member. In such a case, there is a need to widen a gap between the adjacent print element boards in consideration of the expansion or creep-up of the adhesive. On the contrary, in the embodiment, when configurations (1) and (2) of a gap portion between adjacent boards of a fourth embodiment to be described later are employed, it is possible to reduce a gap between the adjacent print element board without considering the expansion or creep-up of the adhesive. As a result, it is possible to reduce a deviation width between the print element boards in the print material scan direction at the joint of the print element boards and to reduce a deviation width of the ejection opening row. Thus, since a problem such as unevenness in an image of the joint is reduced, a high-quality image can be formed.

(Fourth Embodiment)

Hereinafter, a fourth embodiment of the invention will be described with reference to the drawings. Additionally, since a basic configuration of the embodiment is similar to the first embodiment, only characteristic configurations will be described below.

(Configuration (1) of Gap Portion Between Adjacent Boards)

Figure 46A:
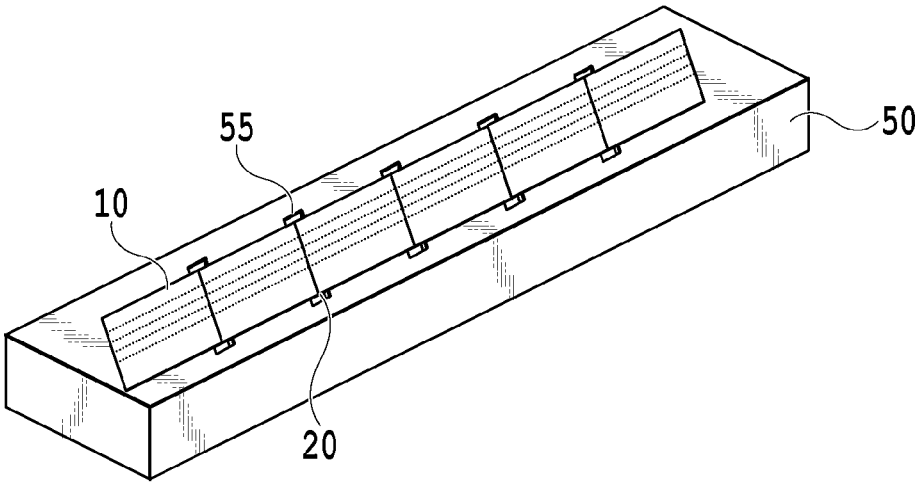
FIG. 46A is a diagram illustrating an example of a configuration of a gap portion between the adjacent print element boards.
Figure 46B:
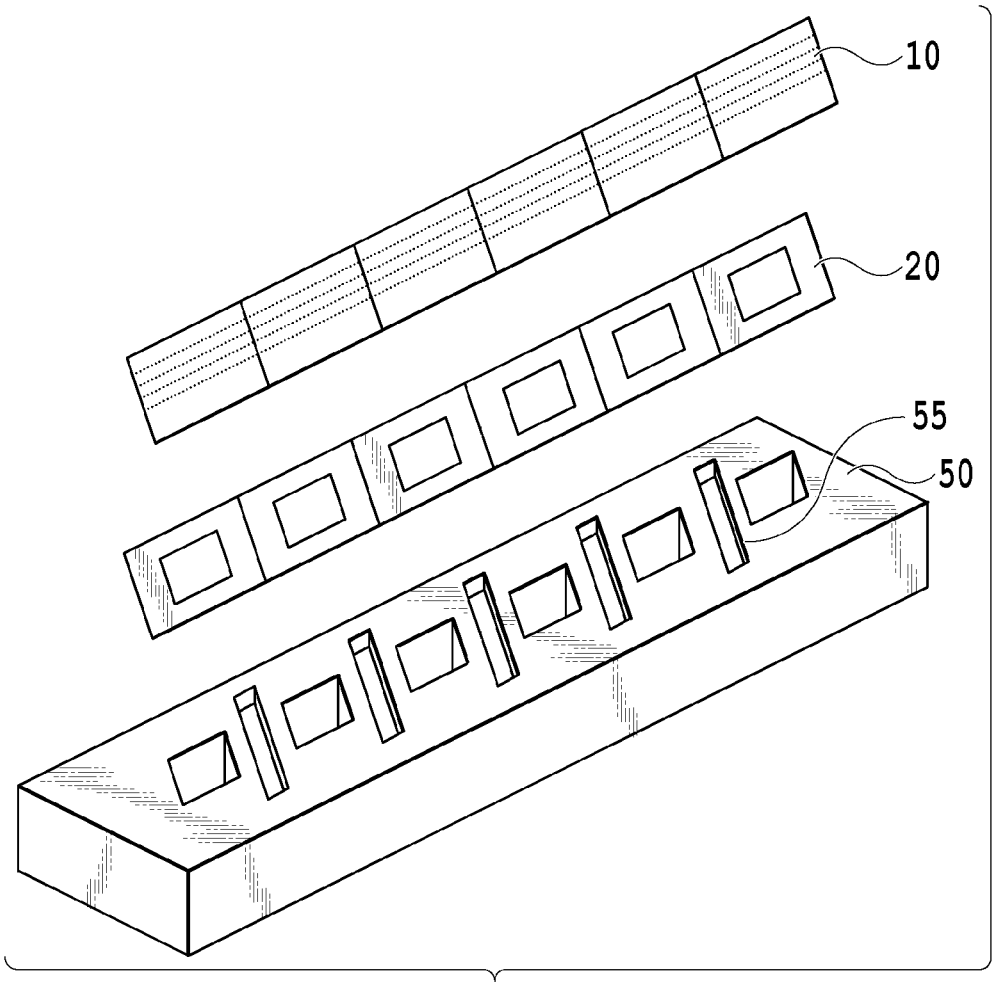
FIG. 46B is a diagram illustrating an example of a gap portion between the adjacent print element boards.
Figure 47A:
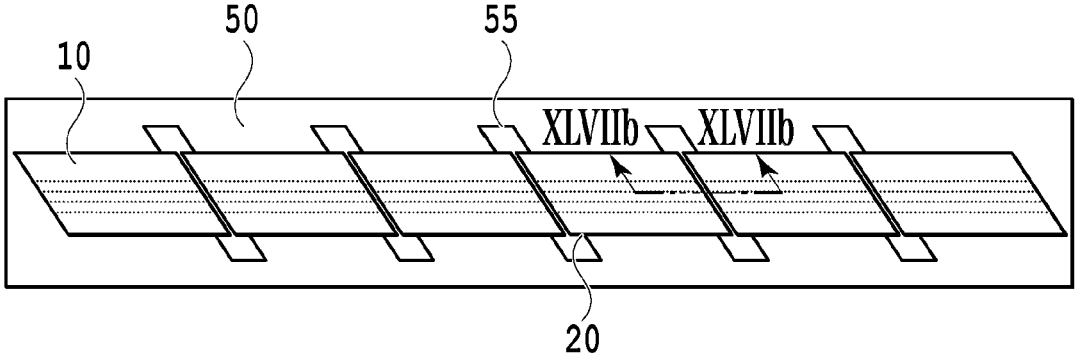
FIG. 47A is a diagram illustrating an example of a configuration of a gap portion between the adjacent print element boards.
Figure 47B:
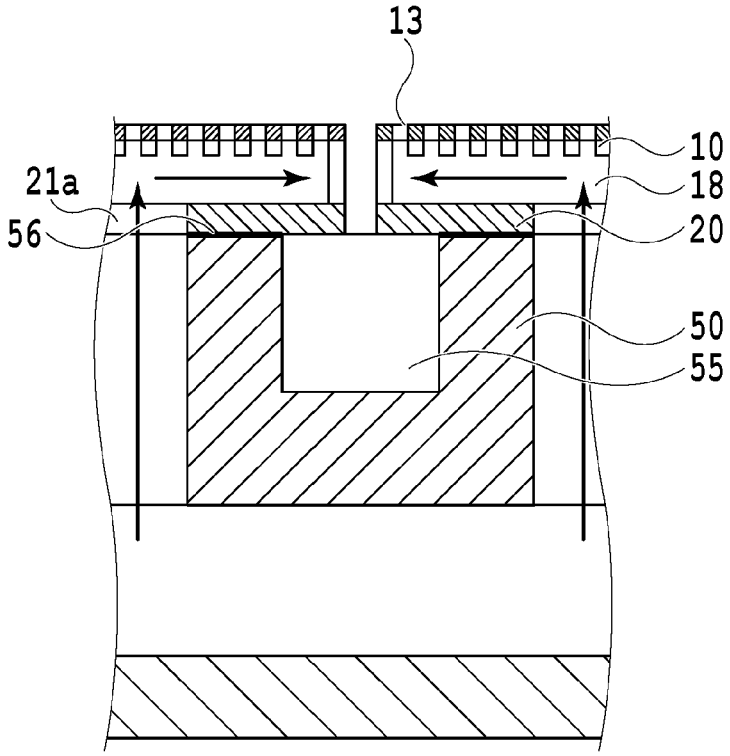
FIG. 47B is a diagram illustrating an example of a configuration of a gap portion between the adjacent print element boards.

FIGS. 46A, 46B, 47A, and 47B are diagrams illustrating an example of a configuration of a gap portion between the adjacent print element boards of the embodiment. FIG. 46A and FIG. 46B are a schematic diagram of the liquid ejection head of the embodiment, FIG. 46A is a perspective view, and FIG. 46B is an exploded perspective view. FIG. 47A and FIG. 47B are a schematic diagram illustrating a gap between the adjacent element boards of the embodiment, FIG. 47A is a top view, and FIG. 47B is a cross-sectional view taken along a line XLVIIb-XLVIIb of FIG. 47A.

In the embodiment, the lid member 20 is disposed at the rear face of the print element board 10, the liquid supply path 18 supplying the liquid to the ejection opening 13 is provided at the rear face of the print element board 10, and the lid member 20 is used to cover the liquid supply path 18. Further, the liquid supply opening 2133 supplying the liquid to the liquid supply path 18 is provided at the lid member 20 and communicates with the supply path provided inside the support member.

In the embodiment, since the ejection opening 13 is also disposed at an area of the print element board 50 protruding toward the upside of a groove 55 of the first passage member 50 of the support member, the deviation width of the ejection opening row at the joint of the print element board is reduced. As illustrated in FIG. 47B, the liquid supply path 18 is also disposed at the print element board 10 protruding toward the upside of the groove of the first passage member 50 at the gap portion between the adjacent print element boards 10 and the lid member 20 is used to cover the liquid supply path 18. Then, a bonded portion between the lid member 20 and the support member 50 at the adjacent gap portions enters inward from the outer edge of the print element board.

In this way, since the liquid supply path 18 at a position protruding toward the upside of the groove 55 is covered by the lid member 20, the liquid can be also supplied to the ejection opening 13 at a position protruding outward in relation to the end of the first passage member 50 through the liquid supply path 18 disposed at the rear face of the print element board 50. That is, since the width of the groove 55 (the length of the first passage member 50 in the longitudinal direction) formed on the first passage member is set to be larger than the width of the gap between the print element boards, a gap between the adjacent print element boards can be decreased. Further, since the liquid supply path 18 at a position protruding toward the upside of the groove 55 of the first passage member 50 is covered by the lid member 20, the ejection opening 13 can be disposed to the end of the print element board 10. Accordingly, it is possible to further reduce a deviation width of the ejection opening row at the joint of the print element board.

For example, a case where a gap between the print element boards is reduced from 0.2 mm to 0.03 mm by using the embodiment will be compared. In a case where the ejection opening of the end of the ejection opening row can be disposed at a position of 0.05 mm from the end of the print element and an angle of an inclined side is 45°, the deviation width of the ejection opening row becomes from about 0.42 mm to about 0.18 mm. Accordingly, it is possible to largely reduce the deviation width of the ejection opening row by the invention.

In this way, even in a case where the adhesive is used to bond the print element board 10 and the first passage member 50 to each other, it is possible to reduce a deviation width between the print element boards in the print material scan direction at the joint of the print element board and to reduce the deviation width of the ejection opening row. As a result, since a problem such as unevenness in an image of the joint is reduced, a high-quality image can be formed.

Further, in the embodiment, the outer shape of the lid member 20 may be smaller than the outer shape of the print element board 10. That is, since the adjacent print element boards can be closer to each other regardless of the processing accuracy of the lid member 20 at the joint, it is possible to reduce a deviation width between the print element boards the print material scan direction at the joint of the print element board and to reduce the deviation width of the ejection opening row. As a result, since a problem such as unevenness in an image of the joint is reduced, a high-quality image can be formed.

(Configuration (2) of Gap Portion Between Adjacent Boards)

Figure 48A:
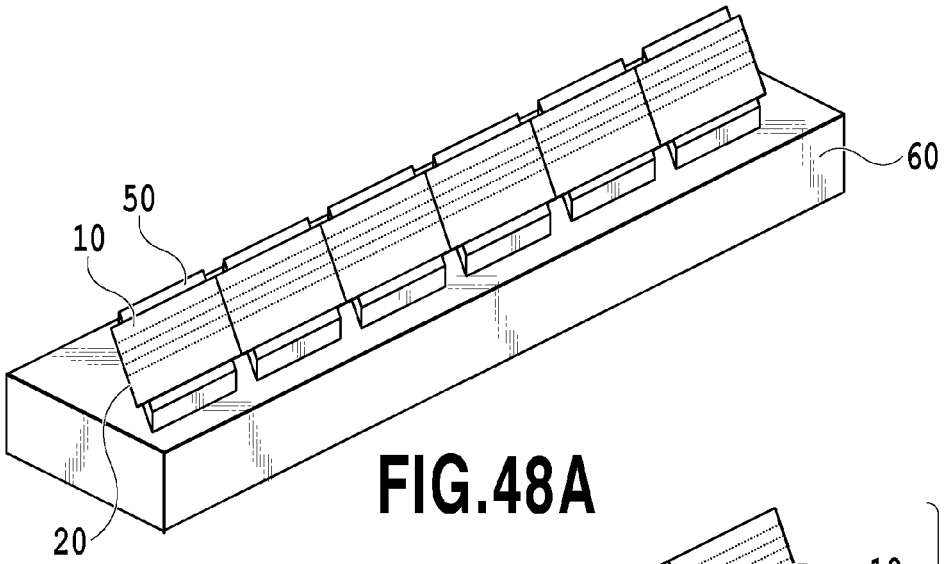
FIG. 48A is a diagram illustrating an example of a configuration of a gap portion between the adjacent boards.
Figure 48B:
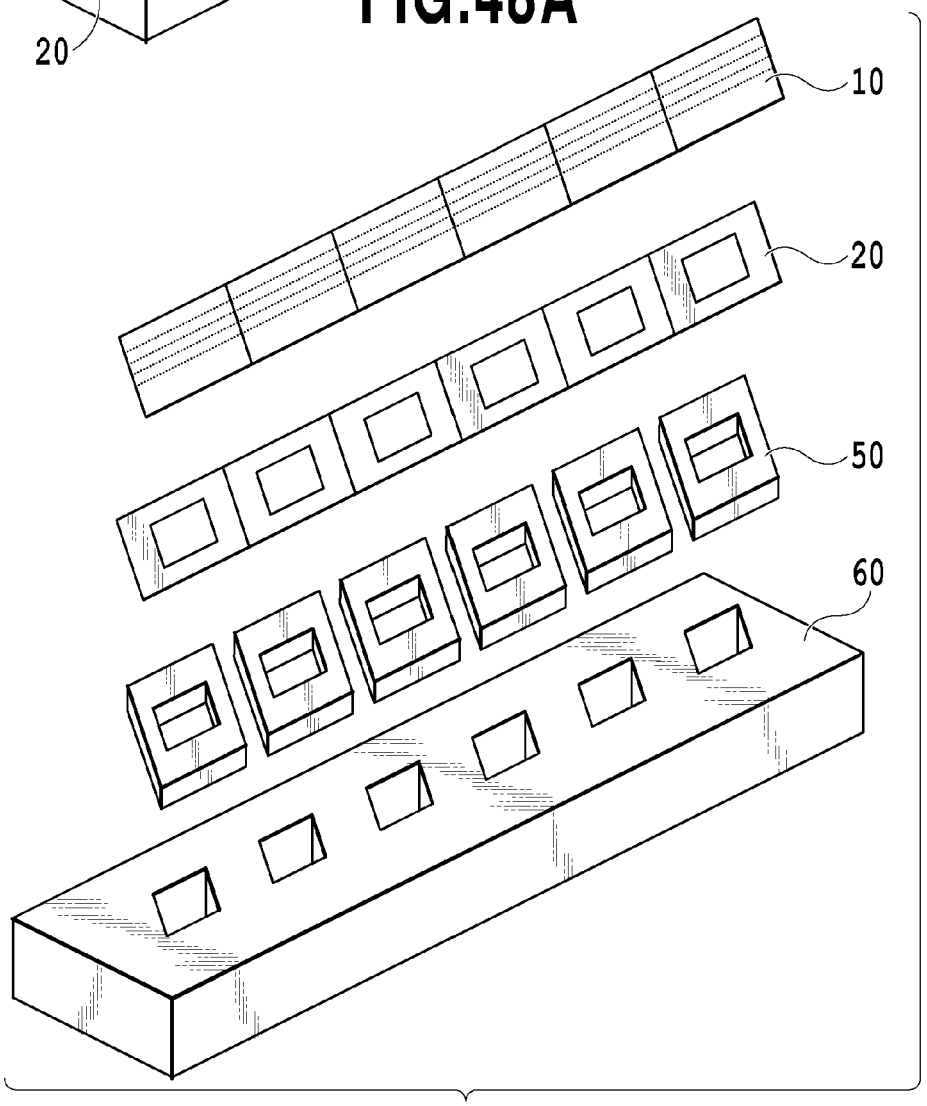
FIG. 48B is a diagram illustrating an example of a configuration of a gap portion between the adjacent boards.
Figure 49A:
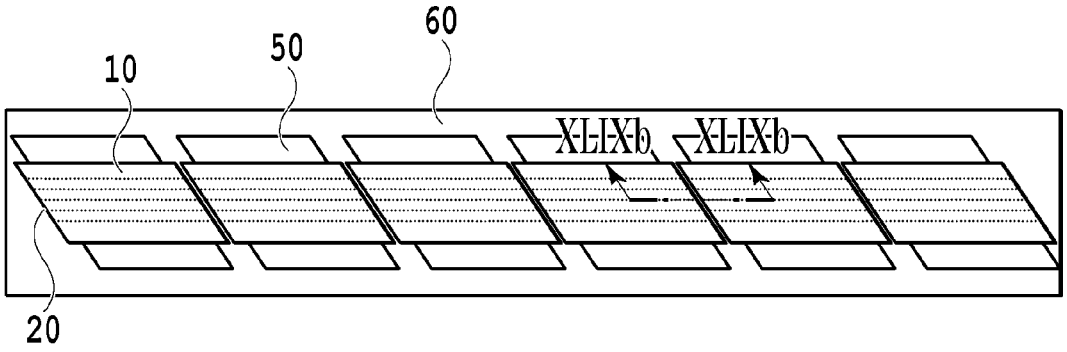
FIG. 49A is a diagram illustrating an example of a configuration of a gap portion between the adjacent boards.
Figure 49B:
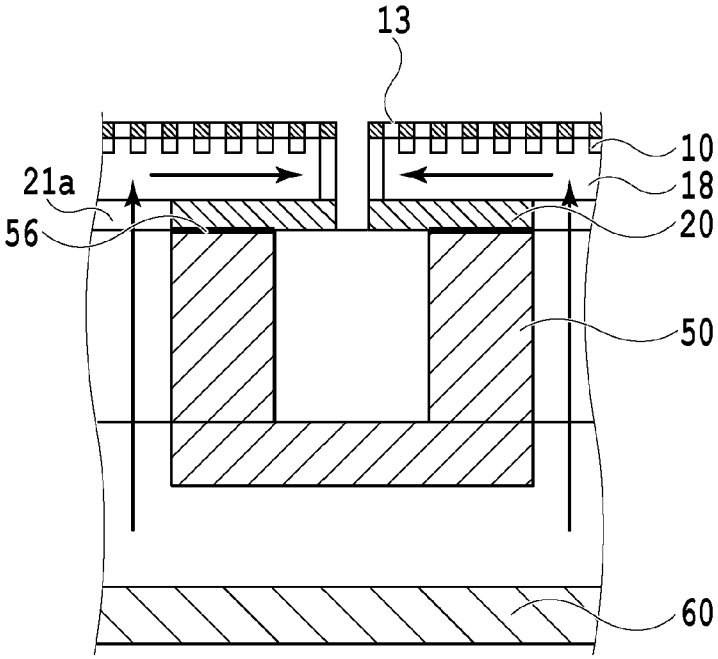
FIG. 49B is a diagram illustrating an example of a configuration of a gap portion between the adjacent boards.

FIGS. 48A, 48B, 49A, and 49B are diagrams illustrating an example of a configuration of a gap portion between the adjacent boards of the embodiment. FIGS. 48A and 48B are schematic diagrams illustrating the liquid ejection head of the configuration example, FIG. 48A is a perspective view, and FIG. 48B is an exploded perspective view. FIGS. 49A and 49B are schematic diagrams illustrating a gap between the adjacent element boards of the embodiment, FIG. 49A is a top view, and FIG. 49B is a cross-sectional view taken along a line XLIXb-XLIXb of FIG. 49A.

Here, a case where a gap between the adjacent print element boards is reduced from 0.2 mm to 0.02 mm will be compared. In a case where the ejection opening of the end of the ejection opening row can be disposed at a position of 0.05 mm from the end of the print element and the angle of the inclined side of the chip is 45°, the deviation width of the ejection opening row becomes from about 0.42 mm to about 0.17 mm. Accordingly, it is possible to largely reduce the deviation width of the ejection opening row by the invention.

In this way, according to the invention, it is possible to reduce a deviation width between the elements in the print material scan direction at the joint of the print element board 10 and to reduce the deviation width of the ejection opening row. As a result, since a problem such as unevenness in an image of the joint is reduced, a high-quality image can be formed.

Further, it is possible to suppress the creep-up of the adhesive of the ejection opening face at the adjacent portion of the print element board similarly to the above-described configuration example. When the adhesive is used to bond the lid member 20 and the first passage member 50 to each other, the adhesive which protrudes due to the protruding ends of the lid member 20 and the print element board 10 protruding outward from the first passage member 50 as in the embodiment is accumulated at the rear face of the lid member 20. Thus, it is possible to suppress the creep-up of the adhesive at the ejection opening face of the adjacent portion compared to the configuration in which the ends do not protrude outward.

Additionally, a configuration of the gap portion between the adjacent boards has been described by the use of the print element board 10 having a parallelogram shape of the embodiment, but the invention is not limited to the parallelogram shape. For example, the invention is also applied to a liquid ejection head in which a plurality of rectangular print element boards 10 are arranged.

(Fifth Embodiment)

Hereinafter, a fifth embodiment of the invention will be described with reference to the drawings. Additionally, since a basic configuration of the embodiment is similar to the first embodiment, only characteristic configurations will be described below. Even in the embodiment, the third passage layer 223 is provided as the lid member similarly to the above-described embodiments.

Figure 50:
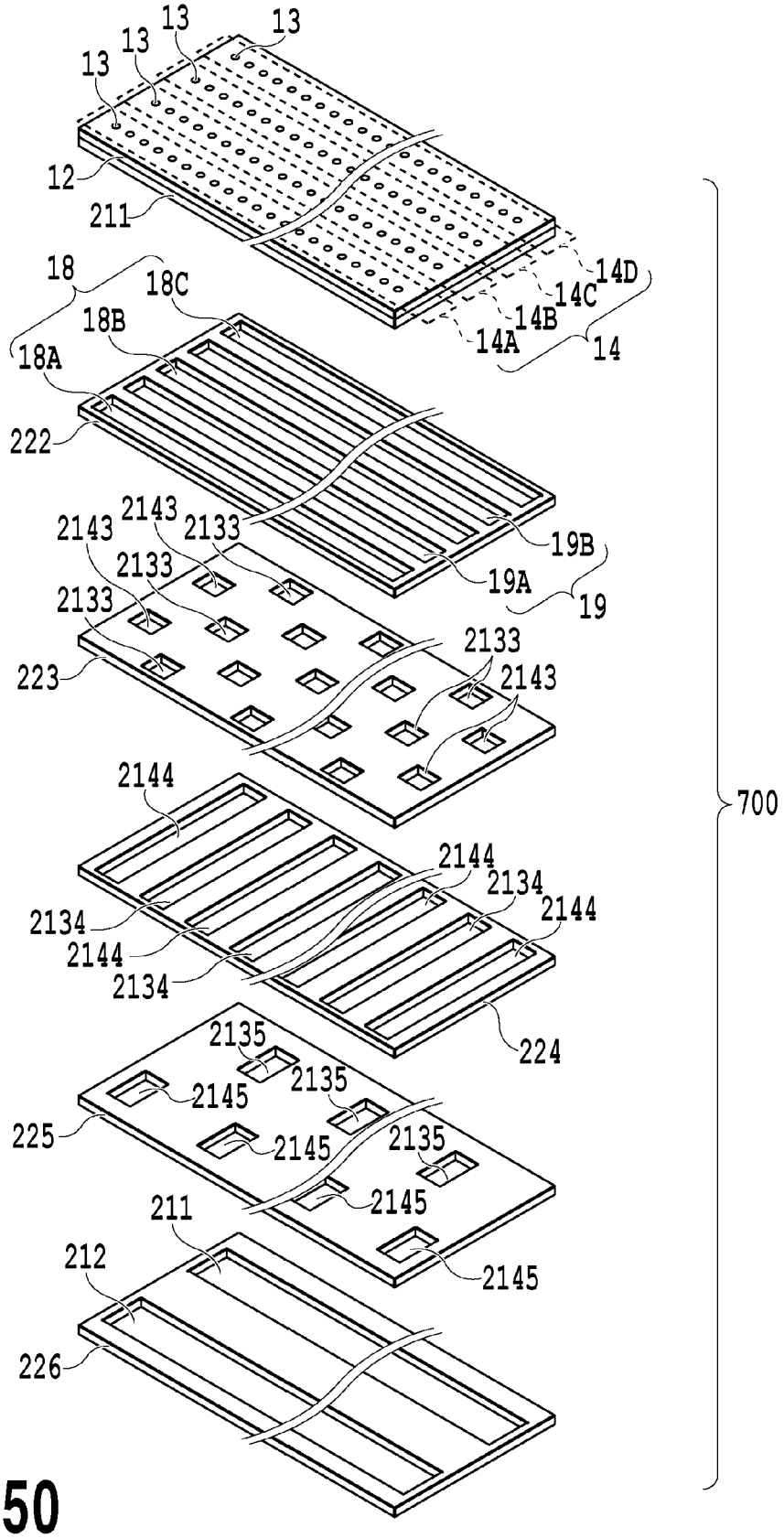
FIG. 50 is an exploded perspective view illustrating the liquid ejection unit.
Figure 51:
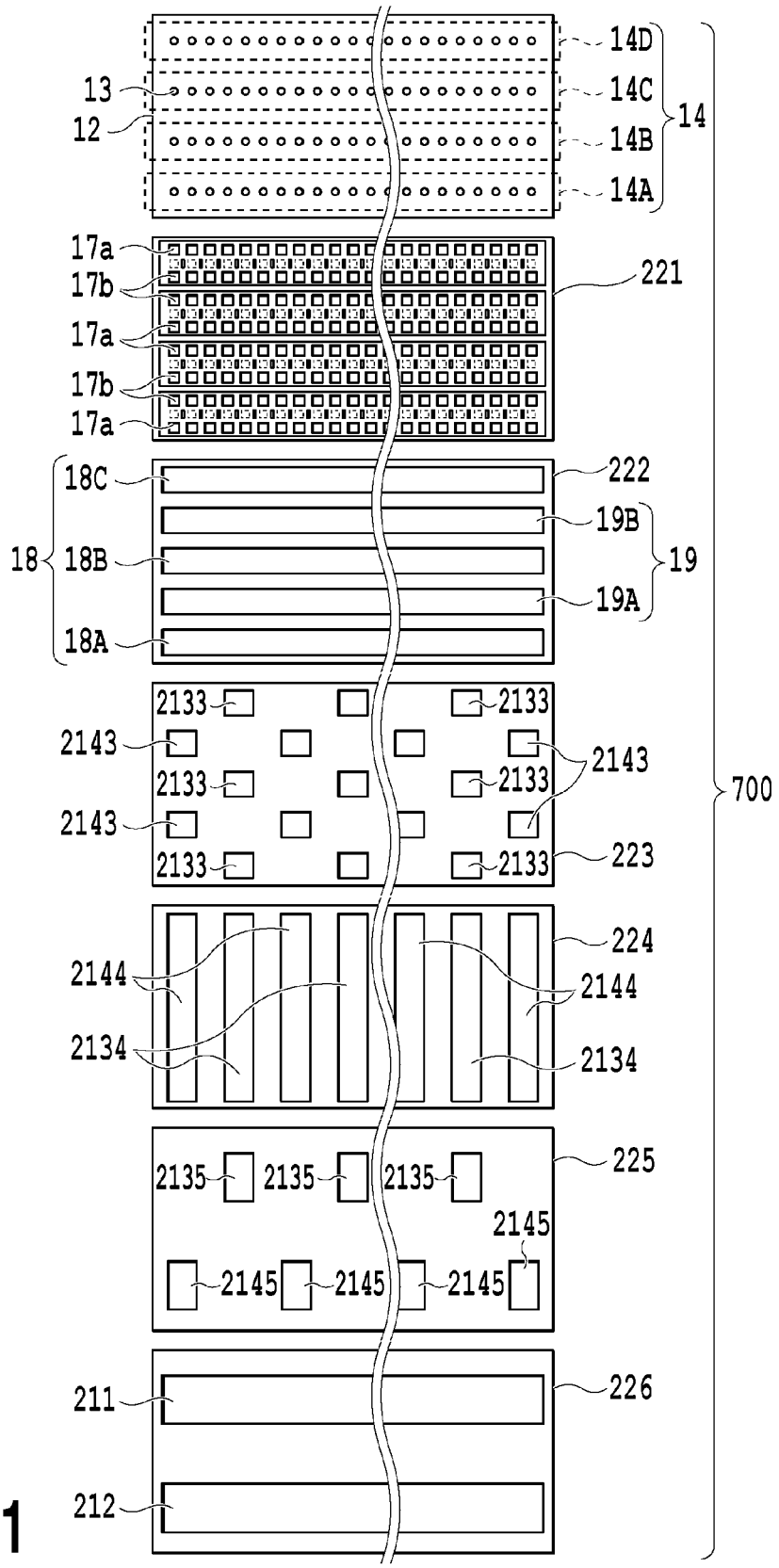
FIG. 51 is an exploded top view illustrating the liquid ejection unit.

FIGS. 50 and 51 are diagrams illustrating a liquid ejection unit 700 of the embodiment. Here, the same reference numerals will be given to the same components as those of the above-described embodiment and a description thereof will be omitted. FIG. 50 is an exploded perspective view of the liquid ejection unit 700 and FIG. 51 is an exploded top view of the liquid ejection unit 700.

In the embodiment, as illustrated in FIG. 50, three liquid supply paths 18 (18A, 18B, and 18C) and two liquid collection paths 19 (19A and 19B) are disposed for four ejection opening rows 14 (14A, 14B, 14C, and 14D). As illustrated in FIG. 51, the common collection opening 17*b* is disposed between the ejection opening rows 14A and 14B and the collection opening 17*b* communicates with the liquid collection path 19A.

Further, the common supply opening 17*a* is disposed between the ejection opening rows 14B and 14C and the supply opening 17*a* communicates with the liquid supply path 18B. Further, the common collection opening 17*b* is disposed between the ejection opening rows 14C and 14D and the collection opening 17*b* communicates with the liquid collection path 19B. The supply opening 17*a* of the ejection opening row 14A communicates with the liquid supply path 18A and the supply opening 17*a* of the ejection opening row 14D communicates with the liquid supply path 18C.

In this way, one liquid supply path 18B communicates with the pressure chamber 23 at the ejection opening rows 14B and 14C through the common supply opening 17*a* of two ejection opening rows 14B and 14C. Further, one liquid collection path 19A communicates with the pressure chamber 23 of the ejection opening rows 14A and 14B through the common collection opening 17*b* of two ejection opening rows 14A and 14B. Similarly, one liquid collection path 19B communicates with the pressure chamber 23 of the ejection opening rows 14C and 14D through the common collection opening 17*b* of two ejection opening rows 14C and 14D.

According to the embodiment, a following effect can be obtained in addition to the effects of the above-described embodiments. That is, since two adjacent ejection opening rows share the liquid supply path 18 and the liquid collection path 19, the number of the partition walls between the ink passages and the number of the ink passages can be decreased. Thus, it is possible to narrow the gap between the ejection opening row 14 and to increase the width of the ink passage.

As a result, it is possible to further suppress a change in ink circulation flow amount and a change in pressure of each pressure chamber 23. Further, it is possible to decrease the sizes of the liquid ejection unit 700 and the liquid ejection head by further densely dispose the ejection opening row 14 compared to the above-described embodiments. Further, in a case where the ejection opening rows 14 are arranged at the same arrangement density, it is possible to further suppress a change in ink circulation flow amount and a change in pressure of each pressure chamber 23 and to decrease the number of the liquid supply openings 2133 and the liquid collection openings 2143. For this reason, it is possible to simplify the ink passage structure of the liquid ejection unit 700.

(Sixth Embodiment)

Hereinafter, a sixth embodiment of the invention will be described with reference to the drawings. Additionally, since a basic configuration of the embodiment is similar to the first embodiment, only characteristic configurations will be described below. Even in the embodiment, the third passage layer 223 is provided as the lid member similarly to the above-described embodiments.

Figure 52:
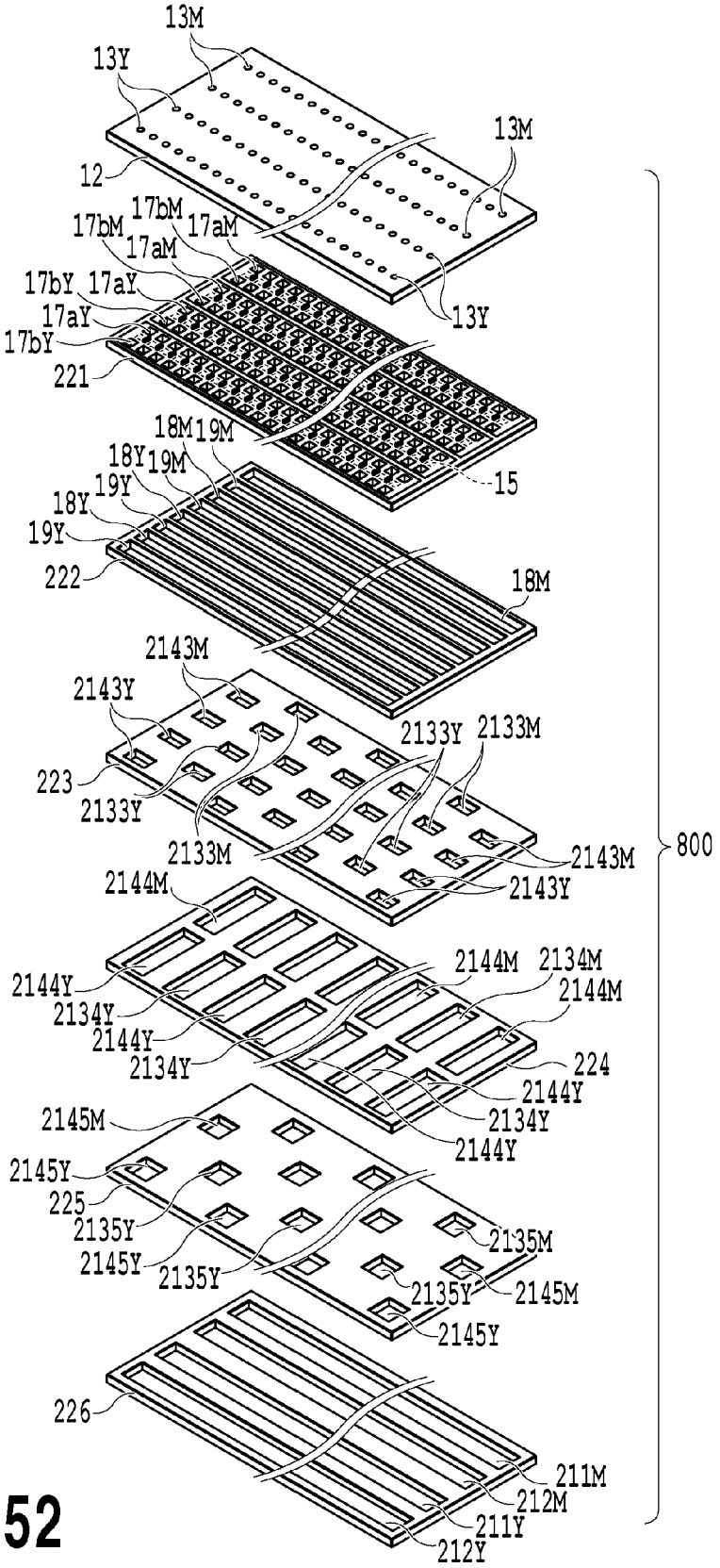
FIG. 52 is a diagram illustrating the liquid ejection unit.
Figure 53:
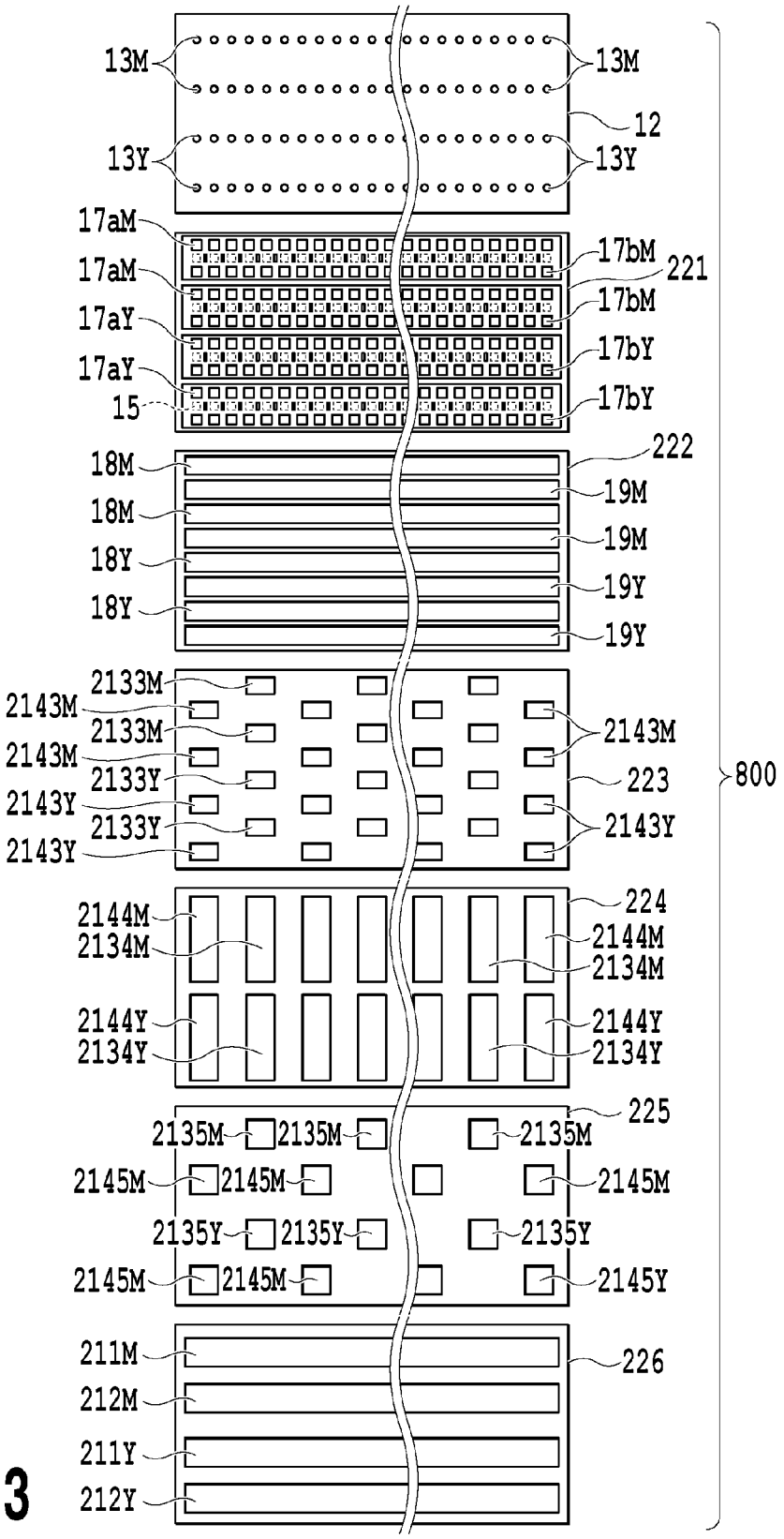
FIG. 53 is a diagram illustrating the liquid ejection unit.

FIGS. 52 and 53 are diagrams illustrating a liquid ejection unit 800 of the embodiment. Here, the same reference numerals will be given to the same components as those of the above-described embodiment and a description thereof will be omitted. FIG. 52 is an exploded perspective view of the liquid ejection unit 800 and FIG. 53 is an exploded top view of the liquid ejection unit 800.

In the embodiment, an ejection opening row having ejection openings 13M for first ink and an ejection opening row having ejection openings 13Y for second ink are formed in order to eject different colors or different types of inks into one liquid ejection unit 800. The second passage layer 222 is provided with a liquid supply path 18M for first ink, a liquid supply path 18Y for second ink, a liquid collection path 19M for first ink, and a liquid collection path 19Y for second ink. The third passage layer 223 is provided with a liquid supply opening 2133M for first ink, a liquid supply opening 2133Y for second ink, a liquid collection opening 2143M for first ink, and a liquid collection opening 2143Y for second ink.

The fourth passage layer 224 is provided with a common supply path 2134M for first ink, a common supply path 2134Y for second ink, a common collection path 2144M for first ink, and a common collection path 2144Y for second ink. The fifth passage layer 225 is provided with an individual supply opening 2135M for first ink, an individual supply opening 2135Y for second ink, an individual collection opening 2145M for first ink, and an individual collection opening 2145Y for second ink. The sixth passage layer 226 is provided with a common supply passage 211M for first ink, a common supply passage 211Y for second ink, a common collection passage 212M for first ink, and a common collection passage 212Y for second ink.

As in the first application example, the first and second inks are respectively supplied from the common supply passage 211M and 211Y, pass through the corresponding pressure chambers 23, and flow out from the common collection passages 212M and 212Y.

Additionally, as in the fifth embodiment, one liquid supply path may commonly communicate with the pressure chambers of two ejection opening row. Similarly, one liquid collection path may commonly communicate with the pressure chambers of two ejection opening rows. Further, a width of the sixth passage layer 226 in the second direction may be set to be larger than a width of the print element board 10 in the second direction.

In this way, even in the liquid ejection head that ejects a plurality of colors of inks or a plurality of types of inks, it is possible to suppress a change in ink circulation flow amount and a change in pressure of each pressure chamber without widening the widths of the liquid supply path and the liquid collection path. Thus, since it is possible to suppress a decrease in ink ejection speed and a change in color concentration of the ink due to the evaporation of moisture in the ink in the ejection opening, it is possible to print a high-quality image with high accuracy.

(Arrangement Relation of Passages 18M and 19M and Arrangement Relation of Passages 18Y and 19Y)

Figure 54:
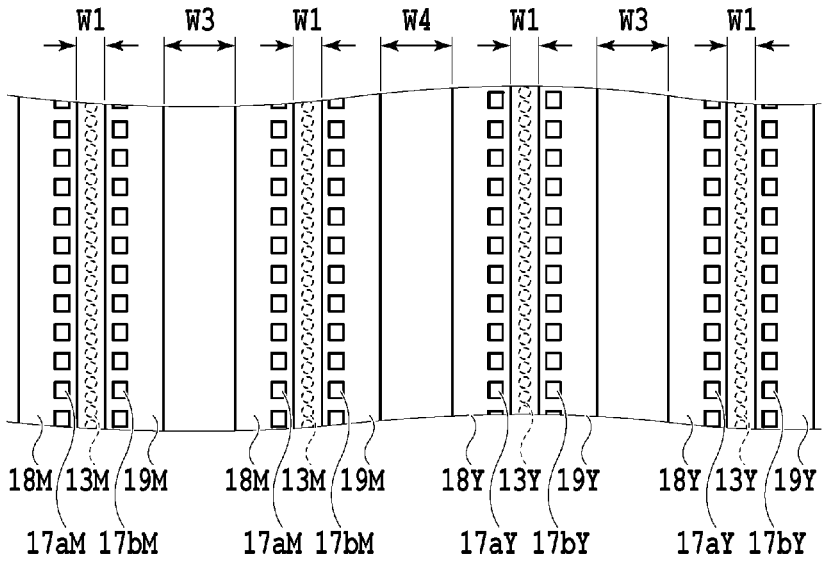
FIG. 54 is a diagram illustrating an arrangement relation between first and second ink passages.

Furthermore, an arrangement relation of the liquid supply path 18M and the liquid collection path 19M for the first ink and an arrangement relation of the liquid supply path 18Y and the liquid collection path 19Y for the second ink may be set as below. That is, as illustrated in FIG. 54, a beam width between the common outflow passage 19M and the common supply passage 18Y between the first ink ejection opening row and the second ink ejection opening row is set to a beam width W4 and the beam width W4 is set to be larger than a beam width W1.

Since the beam width W4 is set to be large, it is possible to suppress a problem in which ink colors are mixed with each other due to an ink leakage between the common outflow passage 19M and the common supply passage 18Y. Here, a relation between the beam width W3 and the beam width W4 may be equal or different. Particularly, when the beam width W3 is large, it is possible to reduce the pressure loss of the passage with respect to the ink flow. Thus, the ejection characteristics become satisfactory. In this way, it is possible to suppress the ink colors from being mixed with each other while keeping the pressure inside the liquid supply path at a negative pressure and suppressing the reverse flow of the ink circulation flow.

(Seventh Embodiment)

Hereinafter, a seventh embodiment of the invention will be described with reference to the drawings. Additionally, since a basic configuration of the embodiment is similar to the first embodiment, only characteristic configurations will be described below.

In the embodiment, the liquid ejection head does not generate the ink circulation flow differently from the above-described embodiment. In each ejection opening row, the supply opening, the liquid supply path, the liquid supply opening, the individual supply passage, the communication opening, and the common supply opening communicate with one another.

Even in the liquid ejection head not generating the ink circulation flow, since the shape accuracy of the liquid supply opening improves the arrangement accuracy, it is possible to reduce a change in passage resistance, that is, a change in pressure loss in the supply passage even in the liquid ejection head in which the ejection openings are densely arranged. Thus, since it is possible to reduce a change in pressure of the meniscus interface of the ejection opening and to eject a liquid droplet having a uniform size, it is possible to form a high-quality image with higher accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-003077 filed Jan. 8, 2016, and No. 2016-239697 filed Dec. 9, 2016, which are hereby incorporated by reference herein in their entirety.

What is claimed is:

1. A liquid ejection head comprising:

an element board which includes an ejection opening ejecting a liquid, an element provided corresponding to the ejection opening and generating energy used to eject the liquid from the ejection opening, and a pressure chamber having the element provided therein; and a resin film which is provided at a rear face provided with the ejection opening in the element board and which includes a supply opening supplying the liquid to the pressure chamber, wherein a supply path for supplying the liquid supplied from the supply opening to the pressure chamber is formed between the rear face of the element board and the resin film, and wherein an outer shape of the resin film is partially smaller than an outer shape of the element board so as not to protrude from the outer shape of the element board.

2. The liquid ejection head according to claim 1, wherein the rear face of the element board is provided with a part of a liquid path which is formed by the resin film and a collection path which collects a liquid of the pressure chamber, and wherein the resin film is provided with a collection opening communicating with the collection path.

3. The liquid ejection head according to claim 2, wherein the supply path and the collection path are provided to correspond to a length of an ejection opening row in a first direction serving as an extension direction of the ejection opening row having a plurality of ejection openings arranged therein.

4. The liquid ejection head according to claim 3, wherein the supply path and the collection path are alternately disposed in a second direction intersecting the first direction.

5. The liquid ejection head according to claim 2, wherein the element board is provided with a plurality of supply openings which supply the liquid of the supply path to the pressure chamber and a plurality of collection openings which collect the liquid of the pressure chamber to the collection path.

6. The liquid ejection head according to claim 5, wherein the supply openings and the collection openings define a liquid path having a longitudinal direction in the thickness direction of the element board.

7. The liquid ejection head according to claim 1, wherein a thickness of the resin film is smaller than 25 μm.

8. The liquid ejection head according to claim 1, wherein an adhesive is not interposed between the element board and the resin film.

9. The liquid ejection head according to claim 1, wherein an outer shape of the element board is formed in a parallelogram shape.

10. The liquid ejection head according to claim 1, wherein a support member supporting the element board with the resin film interposed therebetween is provided and an adhesive is provided between the support member and the resin film.

11. The liquid ejection head according to claim 10, wherein the support member supports a plurality of element boards, wherein a groove is provided at an adjacent portion in which the element boards are adjacent to each other in the support member, a width of the groove is larger than a width of a gap between the element boards, and a bonded portion between the resin film and the support member at the adjacent portion enters from an outer edge of the element board.

12. The liquid ejection head according to claim 10, wherein a linear expansion coefficient of the support member is smaller than a linear expansion coefficient of the resin film.

13. The liquid ejection head according to claim 10, wherein a plurality of support members each supporting the element board are provided, and wherein a bonded portion between the support member and the resin film enters from an outer edge of the element board at an adjacent portion in which the element boards are adjacent to each other.

14. The liquid ejection head according to claim 1, wherein a plurality of the supply openings are provided to communicate with one supply path.

15. The liquid ejection head according to claim 1, wherein the liquid ejection head includes a plurality of element boards, the resin film is disposed on each element board, and adjacent element boards are disposed to partially overlap each other in a longitudinal direction of the liquid ejection head.

16. The liquid ejection head according to claim 1, wherein the liquid ejection head is a page wide type liquid ejection head in which a plurality of element boards are linearly arranged.

17. The liquid ejection head according to claim 1, wherein the liquid inside the pressure chamber is circulated to the outside of the pressure chamber.

18. A liquid ejection head ejecting a liquid, comprising:

an element board which includes an ejection opening ejecting the liquid, an element provided corresponding to the ejection opening and generating energy used to eject the liquid from the ejection opening, and a pressure chamber having the element provided therein; and a resin film which is provided at a rear face of a face provided with the ejection opening in the element board and includes a supply opening supplying the liquid to the pressure chamber and a collection opening collecting the liquid from the pressure chamber, wherein the rear face of the element board is provided with a supply path supplying the liquid supplied from the supply opening to the pressure chamber and a collection path collecting the liquid collected from the pressure chamber to the collection opening, and wherein a part of the supply path and the collection path are formed by the resin film.

19. The liquid ejection head according to claim 18, wherein an outer shape of the element board is a parallelogram shape and at least one of the supply opening and the collection opening has a parallelogram shape.

20. The liquid ejection head according to claim 18, wherein the supply opening and the collection opening are alternately disposed in the first direction serving as an extension direction of an ejection opening row having a plurality of ejection openings arranged therein.

21. The liquid ejection head according to claim 18, wherein an outer shape of the resin film is smaller than an outer shape of the element board so as not to protrude from the outer shape of the element board.

22. A liquid ejection apparatus with a liquid ejection head including an element board which includes an ejection opening ejecting a liquid, an element provided corresponding to the ejection opening and generating energy used to eject the liquid from the ejection opening, and a pressure chamber having the element provided therein, and a resin film which is provided at a rear face of a face provided with the ejection opening in the element board and includes a supply opening supplying the liquid to the pressure chamber and a collection opening collecting the liquid from the pressure chamber, wherein the rear face of the element board is provided with a supply path supplying the liquid supplied from the supply opening to the pressure chamber and a collection path collecting the liquid collected from the pressure chamber to the collection opening, and wherein a part of the supply path and the collection path are formed by the resin film.

* * * * *